US008400374B2

(12) United States Patent
Kimura

(10) Patent No.: US 8,400,374 B2
(45) Date of Patent: Mar. 19, 2013

(54) SEMICONDUCTOR DEVICE

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1000 days.

(21) Appl. No.: 11/565,203

(22) Filed: Nov. 30, 2006

(65) Prior Publication Data

US 2007/0126668 A1 Jun. 7, 2007

(30) Foreign Application Priority Data

Dec. 2, 2005 (JP) ..... 2005-350023

(51) Int. Cl.
*G09G 3/30* (2006.01)

(52) U.S. Cl. ..... 345/76; 315/169.3

(58) Field of Classification Search ..... 345/76, 345/36, 45; 315/169.3
See application file for complete search history.

(56) References Cited

U.S. PATENT DOCUMENTS

| | | | | |
|---|---|---|---|---|
| 4,742,292 | A | 5/1988 | Hoffman | |
| 6,087,821 | A | 7/2000 | Kojima | |
| 6,114,844 | A | 9/2000 | Chang et al. | |
| 6,222,357 | B1 * | 4/2001 | Sakuragi | 323/315 |
| 6,229,506 | B1 | 5/2001 | Dawson et al. | |
| 6,316,927 | B1 | 11/2001 | Chang et al. | |
| 6,373,454 | B1 | 4/2002 | Knapp et al. | |
| 6,437,550 | B2 | 8/2002 | Andoh et al. | |
| 6,556,475 | B2 | 4/2003 | Yamazaki et al. | |
| 6,600,305 | B2 | 7/2003 | Andoh et al. | |
| 6,661,180 | B2 | 12/2003 | Koyama | |
| 6,693,388 | B2 | 2/2004 | Oomura | |
| 7,027,014 | B2 | 4/2006 | Sato et al. | |
| 7,327,170 | B2 | 2/2008 | Omori et al. | |
| 7,432,891 | B2 | 10/2008 | Fruehauf | |
| 7,463,223 | B2 | 12/2008 | Kimura | |
| 7,852,330 | B2 | 12/2010 | Kimura | |
| 2001/0020844 | A1 | 9/2001 | Andoh et al. | |

(Continued)

FOREIGN PATENT DOCUMENTS

| | | |
|---|---|---|
| CN | 1773590 A | 5/2006 |
| EP | 0 282 725 B1 | 6/1992 |

(Continued)

OTHER PUBLICATIONS

European Search Report (European Patent Application No. 06024143.7), dated Jul. 23, 2009, 10 pages.

(Continued)

*Primary Examiner* — Kevin M Nguyen
*Assistant Examiner* — Kenneth B Lee, Jr.
(74) *Attorney, Agent, or Firm* — Fish & Richardson P.C.

(57) ABSTRACT

The invention provides a semiconductor device which is capable of decreasing an effect of a variation in characteristics of transistors, supplying a predetermined current even when voltage-current characteristics of a load change, and improving a write speed of a signal sufficiently even when the amount of a signal current is small. In the semiconductor device, a current-voltage converting element and a transistor are connected in series; and an amplifier circuit detects a voltage which is applied when a current flows to the current-voltage converting element, and sets a gate-source voltage of the transistor depending on the voltage. Therefore, since the amplifier circuit has low output impedance, a write speed of a signal can be improved sufficiently even when the amount of a signal current is small.

10 Claims, 67 Drawing Sheets

U.S. PATENT DOCUMENTS

| | | | | |
|---|---|---|---|---|
| 2002/0135312 | A1 | 9/2002 | Koyama | |
| 2002/0153844 | A1 | 10/2002 | Koyama | |
| 2002/0175664 | A1 | 11/2002 | Andoh et al. | |
| 2003/0020413 | A1 | 1/2003 | Oomura | |
| 2003/0048669 | A1 | 3/2003 | Abe | |
| 2003/0128199 | A1 | 7/2003 | Kimura | |
| 2003/0128200 | A1 | 7/2003 | Yumoto | |
| 2003/0156102 | A1 | 8/2003 | Kimura | |
| 2003/0169250 | A1 | 9/2003 | Kimura | |
| 2003/0205993 | A1 | 11/2003 | Andoh et al. | |
| 2004/0085029 | A1 | 5/2004 | Kimura | |
| 2004/0085270 | A1 | 5/2004 | Kimura | |
| 2004/0100202 | A1 | 5/2004 | Koyama | |
| 2005/0057189 | A1* | 3/2005 | Kimura | 315/291 |
| 2005/0140607 | A1 | 6/2005 | Sato et al. | |
| 2005/0168905 | A1 | 8/2005 | Kimura | |
| 2007/0217275 | A1 | 9/2007 | Abe | |
| 2009/0134920 | A1 | 5/2009 | Kimura | |

FOREIGN PATENT DOCUMENTS

| | | | |
|---|---|---|---|
| EP | 1 103 946 | A2 | 5/2001 |
| EP | 1 130 565 | A1 | 9/2001 |
| EP | 1 333 422 | A1 | 8/2003 |
| JP | 63-229509 | | 9/1988 |
| JP | 11-149783 | | 6/1999 |
| JP | 2000-081920 | | 3/2000 |
| JP | 2000-112548 | | 4/2000 |
| JP | 2001-005426 | | 1/2001 |
| JP | 2001-284464 | | 10/2001 |
| JP | 2001-343933 | | 12/2001 |
| JP | 2002-514320 | | 5/2002 |
| JP | 2002-517806 | | 6/2002 |
| JP | 2002-351357 | | 12/2002 |
| JP | 2003-043993 | | 2/2003 |
| JP | 2003-058106 | | 2/2003 |
| JP | 2003-108069 | | 4/2003 |
| JP | 2004192000 | A | 7/2004 |
| JP | 2005157123 | A | 6/2005 |
| JP | 2005266089 | A | 9/2005 |
| WO | WO 98/48403 | | 10/1998 |
| WO | WO 99/65011 | | 12/1999 |
| WO | WO 01/06484 | | 1/2001 |
| WO | WO 02/39420 | | 5/2002 |
| WO | WO 03/038793 | | 5/2003 |
| WO | WO 03/038794 | | 5/2003 |
| WO | WO 03/038795 | | 5/2003 |
| WO | WO 03/038796 | | 5/2003 |
| WO | WO 03/038797 | | 5/2003 |
| WO | 2004107078 | A1 | 12/2004 |
| WO | 2004109638 | A1 | 12/2004 |

OTHER PUBLICATIONS

Office Action, Chinese Application No. 200610064264.9, dated Jul. 29, 2011, 21 pages With English translation.

* cited by examiner

SEMICONDUCTOR DEVICE

BACKGROUND OF THE INVENTION

1. Field of the Invention

The present invention relates to a semiconductor device provided with a function to control a current supplied to a load with a transistor. In particular, the invention relates to a pixel formed of a current-drive light emitting element of which luminance is changed by a current and a display device including a signal line driver circuit for driving a pixel.

2. Description of the Related Art

As a driving method of a display device using a self-light emitting element typified by an organic light emitting diode (also referred to as an OLED, an organic EL element, an electroluminescence (EL) element, or the like), a simple matrix driving method and an active matrix driving method are known. The former method has a simple structure, but has a problem such as difficulty in realizing a large and high luminance display device. In recent years, an active matrix method has been developed, in which a current flowing to a light emitting element is controlled by a thin film transistor (TFT) provided inside a pixel circuit.

It has been known that an active matrix display device has a problem that a current flowing to a light emitting element changes due to variations in current characteristics of driving TFTs, thereby causing luminance variation. That is, in the case of an active matrix display device, driving TFTs for applying a current flowing to a light emitting element is used for a pixel circuit, and it is a problem that characteristics of the driving TFTs vary, thereby a current flowing to the light emitting element changes and luminance varies. In view of this problem, various circuits for suppressing luminance variation without changing a current flowing to a light emitting element even when characteristics of driving TFTs in a pixel circuit vary are suggested (for example, see Patent Documents 1 to 4).

Patent Documents 1 to 3 each disclose a circuit configuration for preventing a change in current values flowing to a light emitting element due to variation in characteristics of driving TFTs arranged in a pixel circuit. The configuration is called a current-write pixel, a current-input pixel, or the like. Further, Patent Document 4 discloses a circuit configuration for suppressing a change in a signal current due to variation of TFTs in a source driver circuit.

FIG. 54 shows a first configuration example of a conventional active matrix display device which has been disclosed in Patent Document 1. A pixel in FIG. 54 includes a source signal line 5401, first to third gate signal lines 5402 to 5404, a current supplying line 5405, TFTs 5406 to 5409, a storage capacitor 5410, an EL element 5411, and a signal current inputting current source 5412.

Operations from writing of a signal current to light emission are described with reference to FIGS. 55A to 55E. A reference numeral denoting each portion in drawings correspond to those in FIG. 54. FIGS. 55A to 55C each schematically shows a current flow. FIG. 55D shows a relation of a current flowing through each path at the time of writing a signal current. FIG. 55E shows a voltage accumulated in the storage capacitor 5410 at the time of writing a signal current, that is, a gate-source voltage of the TFT 5408.

First, a pulse is inputted to the first gate signal line 5402 and the second gate signal line 5403 and the TFTs 5406 and 5407 are turned on. At this time, a current flowing through the source signal line, that is, a signal current is Idata.

Since the current Idata flows through the source signal line, the current path is divided into I1 and I2 in the pixel as shown in FIG. 55A. These relations are shown in FIG. 55D. Note that, it is needless to say that Idata=I1+I2 is satisfied.

A charge is not held in the capacitor 5410 yet at the moment that the TFT 5406 is turned on; therefore, the TFT 5408 is in an off state. Accordingly, I2=0 and Idata=I1 are satisfied. In other words, only a current for accumulating a charge in the storage capacitor 5410 flows in the meantime.

After that, as the charges are gradually accumulated in the storage capacitor 5410, a potential difference starts to be generated between both electrodes (FIG. 55E). When the potential difference between the both electrodes reaches Vth (point A in FIG. 55E), the TFT 5408 is turned on and I2 is generated. As described above, since Idata=I1+I2 is satisfied, a current still flows and a charge is further accumulated in the storage capacitor while I1 is decreased gradually.

The charge keeps being accumulated in the storage capacitor 5410 until the potential difference between the both electrodes, that is a gate-source voltage of the TFT 5408 reaches a desired voltage, that is a voltage (VGS) high enough to apply the current Idata to the TFT 5408. When the charge stops being accumulated (point B in FIG. 55E), the current I1 stops flowing and a current corresponding to VGS at that time flows to the TFT 5408; thus, Idata=I2 is satisfied (FIG. 55B), which leads to a steady state. Thus, a writing operation of a signal is terminated. At last, selections of the first gate signal line 5402 and the second gate signal line 5403 are terminated to turn off the TFTs 5406 and 5407.

Subsequently, a light emitting operation starts. A pulse is inputted to the third gate signal line 5404 to turn on the TFT 5409. Since the storage capacitor 5410 holds VGS which has been written before, the TFT 5408 is in an on state and the current Idata flows from the current supply line 5405, thereby the EL element 5411 emits light. Provided that the TFT 5408 is set to operate in a saturation region, Idata can keep flowing without change even when a source-drain voltage of the TFT 5408 changes.

In this manner, an operation to output a set current is hereinafter referred to as an output operation. As a merit of the current-write pixel, a desired current can be accurately supplied to an EL element because a gate-source voltage required to apply the current Idata is held in the storage capacitor 5410 even when the TFTs 5408 have a variation in characteristics and the like. Therefore, a luminance variation due to the variation in characteristics of the TFTs can be suppressed.

The aforementioned examples relate to a technique for correcting a change in a current due to a variation of driving TFTs in a pixel circuit; however, the same problem occurs in a source driver circuit as well. Patent Document 4 discloses a circuit configuration for preventing a change in a signal current due to a variation in the TFTs in the source driver circuit, which is generated in fabrication.

Further, a driver circuit of a light emitting element is known, which is provided with a current supply circuit (1) and a drive control circuit (2*a*) which have configurations where a current (Is) having the same current value as a current (Ir) flowing from a supply transistor (M5) which supplies a current to drive a light emitting element (EL) can be led to a drive control circuit (2*a*) through a reference transistor (M4), and a control can be conducted so that the current (Is) approaches a desired set current value (Idrv) and source-drain voltage data (Vs, Vr) become equal to each other based on the current (Is), the source-drain voltage data (Vs) of the reference transistor (M4) and source-drain voltage data (Vr, Vdrv) of the supply transistor (M5) (see Patent Document 5).

Further, a driver circuit is known, which is formed of a light emitting element provided in series between a first power source and a second power source; a driving transistor for driving the light emitting element; a first switching transistor for leading a control signal for controlling the driving transistor to a gate of the driving transistor; a differential amplifier for comparing a voltage at a connecting point of the light emitting element and the driving transistor, and a control voltage showing luminance of a pixel, which is inputted to the display device, in order to generate the control signal, and configured so that the control signal is led to the gate of the driving transistor through the first switching transistor (see Patent Document 6).

In this manner, in a conventional technique, a driver circuit is configured so that a signal current and a current for driving a TFT, or a signal current and a current which flows to a light emitting element when it emits light are equal or in proportion to each other.

[Patent Document 1] Japanese Translation of PCT International Application No. 2002-517806

[Patent Document 2] PCT International Publication No. 01/06484

[Patent Document 3] Japanese Translation of PCT International Application No. 2002-514320

[Patent Document 4] PCT International Publication No. 02/39420

[Patent Document 5] Japanese Translation of PCT International Application No. 2003-108069

[Patent Document 6] Japanese Translation of PCT International Application No. 2003-58106

SUMMARY OF THE INVENTION

However, parasitic capacitance of wiring used for supplying a signal current to a driving TFT and a light emitting element is quite large; therefore, a time constant for charging parasitic capacitance of the wiring becomes large when the amount of the signal current is small, which makes a signal write speed slow. That is, the problem is that even when a signal current is supplied to a transistor, it takes a long time until a voltage required to apply the current is generated at a gate terminal, thus a signal write speed becomes slow.

Moreover, as shown in FIG. 55A, a gate terminal and a drain terminal of the TFT 5408 are connected to each other when a current is inputted. Therefore, a gate-source voltage (Vgs) and a drain-source voltage (Vds) are equal. As shown in FIG. 55C, on the other hand, a drain-source voltage is determined by characteristics of a load when a current is supplied to the load.

FIG. 56 shows a relation of a current flowing to the TFT 5408 and the EL element 5411 and a voltage applied to each of them. Moreover, FIG. 57 shows voltage-current characteristics 5701 of the EL element 5411 and voltage-current characteristics of the TFT 5408 in the configuration shown in FIG. 56. Each intersection in a graph corresponds to an operating point.

First, in the case where a current value is large (the case where an absolute value of a gate-source voltage of the TFT 5408 is large), the TFT 5408 operates at an operating point 5704 since Vgs=Vds is satisfied when a current is inputted with voltage-current characteristics 5702*a* of the TFT 5408. Then, when a current is supplied to the EL element 5411, an intersection of the voltage-current characteristics 5701 of the EL element 5411 and the voltage-current characteristics 5702*a* of the TFT 5408 is an operating point 5705*a*. That is, a drain-source voltage differs between when a current is inputted and when a current is supplied to the EL element 5411. However, a current value is constant in a saturation region; therefore, a proper amount of current can be supplied to the EL element 5411.

However, in an actual transistor, a current of a constant value does not flow in many cases due to a kink (Early) effect. Therefore, when a current is supplied to the EL element 5411, an intersection of the voltage-current characteristics 5701 of the EL element 5411 and voltage-current characteristics 5702*c* of the TFT 5408 is an operating point 5705*c*, which changes a current value.

On the other hand, in the case where a current value is small (the case where an absolute value of a gate-source voltage of the TFT 5408 is small), operation is performed at an operating point 5706 since Vgs=Vds is satisfied when a current is inputted with voltage-current characteristics 5703*a* of the TFT 5408. When a current is supplied to the EL element 5411, an intersection of the voltage-current characteristics 5701 of the EL element 5411 and the voltage-current characteristics 5703*a* of the TFT 5408 is an operating point 5707*a*.

In consideration of the kink (Early) effect, an intersection of the voltage-current characteristics 5701 of the EL element 5411 and the voltage-current characteristics 5703*c* of the TFT 5408 is an operating point 5707*c* when a current is supplied to the EL element 5411. Therefore, a current value at the time of supplying a current to the EL element 5411 differs from that at the time of inputting a current.

When the case where a current value is large (the case where an absolute value of a gate-source voltage of the TFT 5408 is large) and the case where a current value is small (the case where an absolute value of a gate-source voltage of the TFT 5408 is small) are compared, a current value at the operating point 5704 and that at the operating point 5705*c* do not deviate so largely from each other in the former case. That is, a drain-source voltage of a transistor does not vary so much between the time of inputting a current and the time of supplying a current to the EL element 5411. However, in the case where a current value is small, a current value at the operating point 5706 and that at the operating point 5707*c* do not deviate from each other so largely. That is, a drain-source voltage of a transistor varies largely between the time of inputting a current and the time of supplying a current to the EL element 5411. Therefore, current values deviate largely as well.

As a result, a larger amount of current flows to the EL element 5411. Therefore, in the case of displaying an image with low luminance, a brighter image is actually displayed. Therefore, a little light emission occurs even when black is required to be displayed. As a result, contrast is deteriorated.

In the case of the configuration shown in FIG. 54, the gate and drain of the TFT 5408 are connected at the time of inputting a signal current. That is, Vgs=Vds is satisfied. In a normal transistor, a current hardly flows in the case where Vgs=0 is satisfied. However, a current flows depending on a value of a threshold voltage (Vth). For example, a current flows when Vth>0 is satisfied in the case of a p-channel transistor, and when Vth<0 is satisfied in the case of an n-channel transistor. In such cases, a transistor operates in a linear region, not in a saturation region when Vgs=Vds is satisfied. Therefore, a transistor operates in a linear region in FIG. 55A. Therefore, provided that a transistor operates in a saturation region in FIG. 55C, a current value changes between FIG. 55A and FIG. 55C.

That is, a transistor of which threshold voltage (Vth) allows a current to flow when Vgs=0 is satisfied operates only in a linear region when Vgs=Vds is satisfied; thus, it cannot operate in a saturation region.

For example, in the configurations shown in FIG. 54 and FIGS. 55A to 55E, the TFT 5408 operates in a saturation region. Therefore, as shown in FIG. 58, an operating point only changes from the operating point 5705*a* to an operating point 5705*b* when the voltage-current characteristics 5701*a* of the EL element 5411 shift due to deterioration. That is, even when a voltage applied to the EL element 5411 or a drain-source voltage of the TFT 5408 changes, a current flowing to the EL element 5411 does not change. Accordingly, an image burn-in of the EL element 5411 can be reduced.

In the case of a configuration described in Patent Document 6, a voltage of a connection point of an EL element and a driving transistor and a control voltage which shows luminance of a pixel inputted to the display device are compared. Therefore, when voltage-current characteristics of the EL element shift, a current flowing to the EL element 5411 changes. That is, an image burn-in of the EL element 5411 occurs.

In the case of a configuration described in Patent Document 5, a transistor M7 and a transistor M9 are required to be equal in current characteristics. If the current characteristics vary, a current flowing to the light emitting element (EL) varies as well. Similarly, a transistor M8 and a transistor M11, and a transistor M10 and a transistor M12 are required to be equal in current characteristics. Thus, current characteristics are required to be equal in many transistors. If the current characteristics are not equal, a current flowing to the EL element varies. Therefore, problems occur, such as a decrease in manufacturing yield, higher cost, a larger layout area of a circuit, and an increase in power consumption.

In view of the aforementioned problems, the invention provides a semiconductor device which is capable of decreasing an effect of a variation in characteristics of transistors, supplying a predetermined current even when voltage-current characteristics of a load changes, and improving a write speed of a signal sufficiently even when a signal current is small.

In a semiconductor device of the invention, a current-voltage converting element and a transistor are connected in series; and an amplifier circuit detects a voltage which is applied when a current flows to the current-voltage converting element, and sets a gate-source voltage of the transistor depending on the voltage.

A first structure of a semiconductor device of the invention is that a current-voltage converting element, a transistor, and an amplifier circuit are included; the current-voltage converting element is connected to one of a source terminal and a drain terminal of the transistor; a first input terminal of the amplifier circuit is connected to one of the source terminal and the drain terminal of the transistor; a predetermined potential is inputted to a second input terminal of the amplifier circuit; an output terminal of the amplifier circuit is connected to a gate terminal of the transistor; and the amplifier circuit controls a potential of the gate terminal of the transistor so that the first input terminal and the second input terminal of the amplifier circuit have a predetermined potential difference.

One mode of the invention is a semiconductor device including a circuit for controlling a current to be supplied to a load with a transistor, in which one of a source terminal and a drain terminal of the transistor is connected to a current-voltage converting element; and an amplifier circuit for controlling a voltage generated in the current-voltage converting element by controlling a potential of a gate terminal of the transistor so that the transistor operates in a saturation region is provided.

One mode of the invention is a semiconductor device including a transistor having one of a source terminal and a drain terminal of the transistor to which a predetermined potential is supplied and the other of the source terminal and the drain terminal connected to a current-voltage converting element; and an amplifier circuit having a first input terminal connected to the other of the source terminal and the drain terminal of the transistor, a second input terminal to which a predetermined potential is supplied, and an output terminal connected to a gate terminal of the transistor.

One mode of the invention is a semiconductor device including a transistor which is provided with a capacitor between a gate terminal and one of a source terminal and a drain terminal, and has the other of the source terminal and the drain terminal connected to a current-voltage converting element; and an amplifier circuit having a first input terminal connected to the other of the source terminal and the drain terminal of the transistor, a second input terminal to which a predetermined potential is supplied, and an output terminal connected to a gate terminal of the transistor.

One mode of the invention is a semiconductor device including a transistor having one of a source terminal and a drain terminal to which a predetermined potential is supplied and the other of the source terminal and the drain terminal connected to a current-voltage converting element; an amplifier circuit having a first input terminal connected to the other of the source terminal and the drain terminal of the transistor, a second input terminal to which a predetermined potential is supplied, and an output terminal connected to a gate terminal of the transistor; and a capacitor having one electrode connected to the gate terminal of the transistor and the other electrode to which a predetermined potential is supplied.

One mode of the invention is a semiconductor device having the aforementioned structure, in which the transistor is an n-channel transistor.

One mode of the invention is a semiconductor device having the aforementioned structure, in which the transistor is a p-channel transistor.

A second structure of a semiconductor device of the invention is that a current-voltage converting element, a transistor, and an amplifier circuit are included; the current-voltage converting element is connected to one of a source terminal and a drain terminal of the transistor; a predetermined potential is supplied to a gate terminal of the transistor; a first input terminal of the amplifier circuit is connected to one of the source terminal and the drain terminal of the transistor; a second input terminal of the amplifier circuit is connected to the gate terminal of the transistor; an output terminal of the amplifier circuit is connected to the other of the source terminal and the drain terminal of the transistor; and the amplifier circuit controls a potential of the other of the source terminal and the drain terminal of the transistor so that the first input terminal and the second input terminal have a predetermined potential difference.

Hereinafter, the second structure of a semiconductor device of the invention is described specifically.

One mode of the invention is a semiconductor device including a circuit for controlling a current to be supplied to a load with a transistor. In the semiconductor device, one of a source terminal and a drain terminal of the transistor is connected to a current-voltage converting element; and an amplifier circuit for controlling a voltage generated in the current-voltage converting element by controlling a potential of the other of the source terminal and the drain terminal of the transistor so that the transistor operates in a saturation region is provided.

One mode of the invention is a semiconductor device including a transistor having one of a source terminal and a drain terminal connected to a current-voltage converting element and a gate terminal to which a predetermined potential is supplied; and an amplifier circuit having a first input terminal connected to one of the source terminal and the drain terminal of the transistor, a second input terminal connected to the gate terminal of the transistor, and an output terminal connected to the other of the source terminal and the drain terminal of the transistor.

One mode of the invention is a semiconductor device including a transistor which is provided with a capacitor between a gate terminal and one of a source terminal and a drain terminal, and which has the other of the source terminal and the drain terminal connected to a current-voltage converting element; and an amplifier circuit having a first input terminal connected to the other of the source terminal and the drain terminal of the transistor and a second input terminal connected to the gate terminal of the transistor, and an output terminal connected to the one of the source terminal and the drain terminal of the transistor.

One mode of the invention is a semiconductor device including a transistor having one of a source terminal and a drain terminal connected to a current-voltage converting element and a gate terminal to which a predetermined potential is supplied; an amplifier circuit having a first input terminal connected to one of the source terminal and the drain terminal of the transistor, a second input terminal connected to the gate terminal of the transistor, and an output terminal connected to the other of the source terminal and the drain terminal of the transistor; and a capacitor having one electrode connected to the gate terminal of the transistor and the other electrode to which a predetermined potential is supplied.

One mode of the invention is a semiconductor device having the aforementioned structure, in which the transistor is an n-channel transistor.

One mode of the invention is a semiconductor device having the aforementioned structure, in which the transistor is a p-channel transistor.

Note that various modes can be applied to a switch used in this specification as far as it can control a current flow, thus an electrical switch, a mechanical switch, or the like can be applied. It may be a transistor, a diode, or a logic circuit configured with them. Therefore, in the case of using a transistor as a switch, polarity (conductivity) thereof is not particularly limited. However, when an off current is preferred to be small, a transistor of polarity with a smaller off current is preferably used. For example, a transistor which has an LDD region or a multi-gate structure has a small off current. Further, it is desirable that an n-channel transistor be employed when a potential of a source terminal of the transistor operating as a switch is closer to a low potential side power source (Vss, GND, 0 V or the like), whereas a p-channel transistor be employed when a potential of the source terminal is closer to a high potential side power source (Vdd or the like). This helps a transistor operate as a switch efficiently since the absolute value of the gate-source voltage of the transistor can be increased. It is to be noted that a CMOS switch can also be applied by using both n-channel and p-channel transistors.

In the invention, "being connected" means "being electrically connected". Therefore, another element, a switch, or the like may be provided in a predetermined connection.

Note that various modes can be applied to a display element. For example, a display medium in which contrast is changed by an electromagnetic effect can be used, such as an EL element (an organic EL element, an inorganic EL element, or an EL element containing an organic material and an inorganic material), an electron discharging element, a liquid crystal element, or an electronic ink. It is to be noted that a display device using an EL element includes an EL display; a display device using an electron discharging element includes a field emission display (FED), an SED type flat panel display (Surface-conduction Electron-emitter Display), and the like; a display device using a liquid crystal element includes a liquid crystal display; and a display device using an electronic ink includes electronic paper.

It is to be noted that kinds of transistors applicable to the invention are not limited. Accordingly, the following transistors are applicable to the invention: a thin film transistor (TFT) using a non-single crystalline semiconductor film typified by amorphous silicon and polycrystalline silicon; a MOS transistor which is formed using a semiconductor substrate or an SOI substrate; a junction transistor; a bipolar transistor; a transistor using an organic semiconductor or a carbon nanotube; and other transistors. Kinds of substrates over which a transistor is provided are not limited; therefore, a transistor can be provided over a single crystalline substrate, an SOI substrate, a glass substrate, a plastic substrate, or the like.

It is to be noted that any type of transistor can be used and formed over any substrate as a transistor of the invention. Therefore, all of the circuits may be formed over a glass substrate, a plastic substrate, a single crystalline substrate, an SOI substrate, or any other substrate. Alternatively, a part of a circuit may be formed over a certain substrate and another part of the circuit may be formed over another substrate. That is, not all of the circuit is required to be formed over the same substrate. For example, a part of a circuit may be formed over a glass substrate using a TFT and another part of the circuit may be formed over a single crystalline substrate into an IC chip which may be provided over the glass substrate by COG (Chip On Glass). Alternatively, the IC chip may be connected to a glass substrate using TAB (Tape Auto Bonding) or a printed substrate.

It is to be noted in this specification that one pixel corresponds to the smallest unit of an image. Therefore, in the case of a full-color display device formed of color elements of R (red), G (green), and B (blue), one pixel is formed of a dot of an R color element, a dot of a G color element, and a dot of a B color element.

It is to be noted in this specification that a case where pixels are arranged in matrix corresponds to a case where pixels are arranged in a grid pattern where longitudinal stripes and lateral stripes cross each other and to a case where dots of three color elements are arranged in what is called a delta pattern when a full-color display is performed using the three color elements (for example, RGB). Further, the size of a light emitting region may be different depending on the dot of a color element.

It is to be noted that a transistor is an element having at least three terminals including a gate electrode, a drain region, and a source region. A channel forming region is provided between a drain region and a source region. Here, it is difficult to determine the source region or the drain region since they depend on the structure, operating condition, and the like of the transistor. Therefore, in this embodiment mode, each of the region functioning as a source and the region functioning as a drain may be referred to as a first terminal or a second terminal.

It is to be noted in this specification that a semiconductor device corresponds to a device including a circuit having a semiconductor element (transistor, diode, or the like). Further, a display device may include not only a main body of a display panel in which a plurality of pixels including display elements and a peripheral driver circuit for driving the pixels are formed over a substrate but also the one provided with a flexible printed circuit (FPC) or a printed wiring board (PWB). A light emitting device corresponds to a display device using a self-light emitting display element in particular.

A semiconductor device of the invention can reduce an influence of a variation in characteristics of a transistor, supply a predetermined current even when voltage-current characteristics of a load are changed, and improve signal write speed even in the case where the amount of a signal current is small.

DETAILED DESCRIPTION OF THE INVENTION

Although the invention will be fully described by way of embodiment modes and an embodiment with reference to the accompanying drawings, it is to be understood that various changes and modifications will be apparent to those skilled in the art. Therefore, unless such changes and modifications depart from the spirit and the scope of the invention, they should be construed as being included therein.

Embodiment Mode 1

A basic principle of the invention can be applied to a display device of which a pixel is formed of a light emitting element capable of controlling light emission luminance by a current value flowing therethrough. An EL element is given as a typical light emitting element.

Moreover, the invention can be applied not only to a pixel having a light emitting element such as an EL element, but also to various analog circuits having a current source. In this embodiment mode, the principle of the invention is described.

Figure 1:
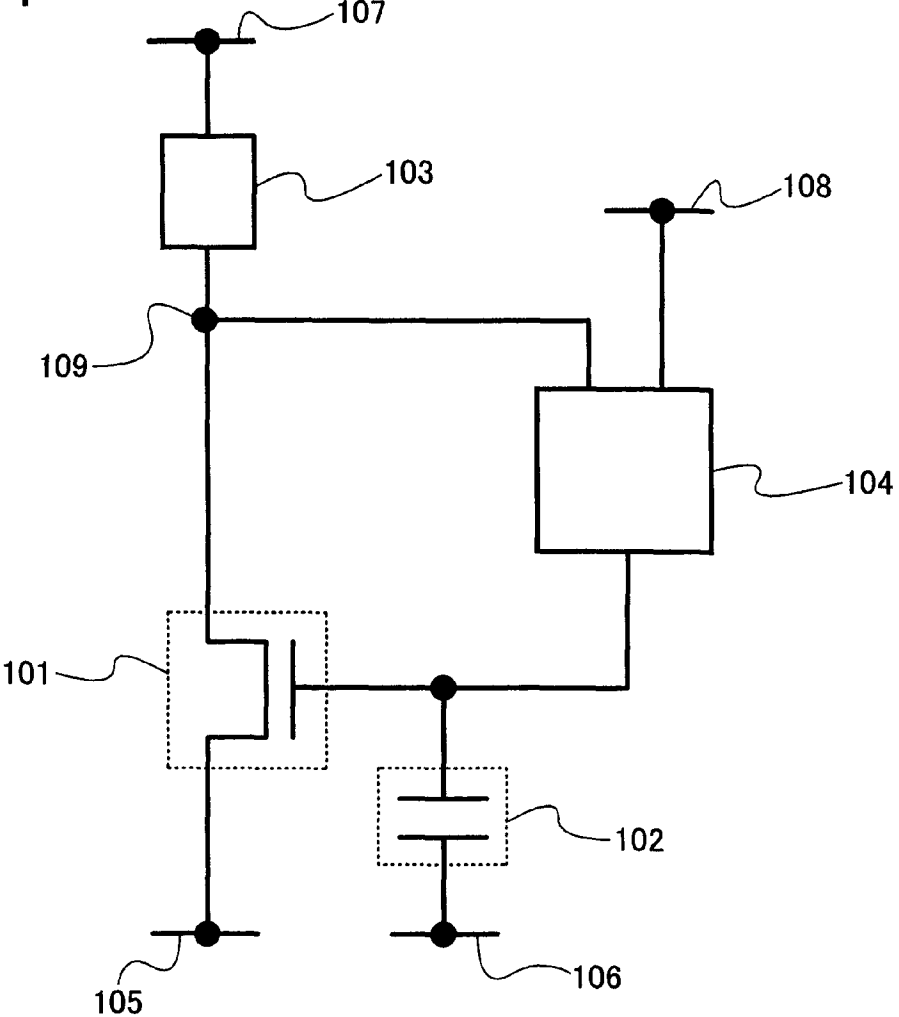
FIG. 1 is a diagram showing a semiconductor device of the invention.

First, a basic structure of a semiconductor device based on the basic principle of the invention is shown in FIG. 1. The semiconductor device includes a transistor 101, a capacitor 102, a current-voltage converting element 103, and an amplifier circuit 104. It is to be noted that the transistor 101 is an n-channel transistor.

The transistor 101 has a first terminal (one of a source terminal and a drain terminal) connected to a wire 105, a second terminal (the other of the source terminal and the drain terminal) connected to a wire 107 through the current-voltage converting element 103, and a gate terminal connected to a wire 106 through the capacitor 102. A high power source potential Vdd is supplied to the wire 107, whereas a low power source potential Vss is supplied to the wires 105 and 106. Note that Vdd>Vss is satisfied.

Note that the capacitor 102 is only required to hold a gate-source voltage of the transistor 101. In other words, the capacitor 102 is only required to hold a gate potential of the transistor 101 when a potential of the wire 105 connected to the first terminal to be the source terminal of the transistor 101 is constant. Therefore, when the capacitor 102 can hold a gate potential of the transistor 101, a potential to be supplied to the wire 106 is not limited. Potentials to be supplied to the wires 105 and 106 may be the same; thus, the wires 105 and 106 may be a continuous wire, not separate wires. Note that the capacitor 102 is not required to be provided when the capacitor 102 can be substituted by gate capacitance of the transistor 101 since the capacitor 102 is provided for holding the gate potential of the transistor 101.

The amplifier circuit 104 has a first input terminal connected to a wire between the second terminal of the transistor 101 and the current-voltage converting element 103, a second input terminal connected to the wire 108, and an output terminal connected to the gate terminal of the transistor 101. Note that a predetermined potential is supplied to the wire 108. Further, a connecting point of the wire between the second terminal of the transistor 101 and the current-voltage converting element 103, and the first input terminal of the amplifier circuit 104 is a node 109.

Subsequently, an operation is described. The first input terminal of the amplifier circuit 104 detects a voltage of the current-voltage converting element 103. In other words, a potential of the node 109 is inputted to the first input terminal of the amplifier circuit 104. Further, the amplifier circuit 104 outputs a potential from the output terminal so that the first input terminal and the second input terminal have a predetermined potential difference. In other words, the amplifier circuit 104 controls the gate potential of the transistor 101 so that the node 109 and the wire 108 have a predetermined potential difference. It is to be noted that the predetermined potential difference includes a case of 0 V.

Thus, the transistor 101 can obtain a gate potential for making the node 109 have a desired potential. The node 109 is made to have a desired potential, thereby a voltage applied to the current-voltage converting element 103 can be a desired voltage. In this case, the current Idata with respect to the desired voltage applied to the current-voltage converting element 103 flows to the current-voltage converting element 103. Further, the current Idata also flows to the transistor 101. The transistor 101 has a gate-source voltage required to apply the Idata.

The transistor 101 in this case has a proper level of gate-source voltage for applying the Idata without depending on current characteristics (such as mobility and a threshold voltage) or a size (a gate width or a gate length). Therefore, the current Idata can be applied to the transistor 101 even when the current characteristics or the sizes of transistors in the semiconductor device each corresponding to the transistor 101 vary. Accordingly, the transistor 101 can operate as a current source and supply a current to various loads (another transistor, a pixel, a signal line driver circuit, or the like).

It is to be noted that an operating region of a transistor (n-channel transistor here for simplification) can be generally divided into a linear region and a saturation region. When a drain-source voltage is Vds, a gate-source voltage is Vgs, and a threshold voltage is Vth, a boundary between the linear region and the saturation region is when (Vgs−Vth)=Vds is satisfied. In the case where (Vgs−Vth)>Vds is satisfied, a transistor operates in a linear region and a current value is determined in accordance with the levels of Vds and Vgs. On the other hand, in the case where (Vgs−Vth)<Vds is satisfied, a transistor operates in a saturation region and ideally, a current value hardly changes even when Vds changes. That is, a current value is determined only by the level of Vgs.

Therefore, one of the regions in which the transistor 101 operates is determined depending on the drain-source voltage Vds, the gate-source voltage Vgs, and the threshold voltage Vth of the transistor 101. That is, in the case where (Vgs−Vth)<Vds is satisfied, the transistor 101 operates in a saturation region. In the saturation region, a current value flowing through the transistor hardly changes even when Vds changes in an ideal case. Therefore, even when the Vds changes between when the current Idata flows to the transistor 101, that is the case of performing a set operation and the case of supplying a current to a load from the transistor 101, a current value flowing through the transistor 101 does not change.

However, a current value may change due to the kink (Early) effect even when the transistor operates in a saturation region. In that case, the potential of the node 109, that is a potential of the second terminal of the transistor 101 (drain terminal in this case) can be controlled by controlling a potential of the second input terminal of the amplifier circuit 104; therefore, the kink (Early) effect can be reduced.

For example, Vds can be approximately equal between the case of performing the set operation and the case of performing the output operation by controlling the potential of the second input terminal of the amplifier circuit 104 appropriately in accordance with the amount of the current Idata.

Even in the case where voltage-current characteristics of a load change due to deterioration and the like, Vds in the case of performing the set operation can be made approximately equal to Vds in the case of performing the output operation by controlling the potential to be inputted to the second input terminal of the amplifier circuit 104 appropriately. Therefore, an appropriate amount of current can be supplied. Thus, an image burn-in can be prevented in the case where the load is an EL element or the like.

Note that the amplifier circuit 104 has low output impedance. Therefore, it can supply a large amount of current. Thus, it can make the gate terminal of the transistor 101 have a desired potential rapidly. That is, a write speed of the current Idata is increased, which can complete writing rapidly. Further, even when the amount of the current Idata is small, the gate terminal of the transistor 101 can be made to have a desired potential rapidly; therefore, a writing defect of a signal can be prevented.

The amplifier circuit 104 has a function to detect a potential difference of the first input terminal and the second input terminal, and amplify it to be outputted. In FIG. 1, the first input terminal of the amplifier circuit 104 and the second terminal (a drain terminal in this case) of the transistor 101 are connected, and the output terminal of the amplifier circuit 104 and the gate terminal of the transistor 101 are connected. When the gate potential of the transistor 101 changes, the drain potential of the transistor 101 also changes, thus the potential of the first input terminal of the amplifier circuit 104 also changes. When the drain potential of the transistor 101 changes, the first input terminal of the amplifier circuit 104 also changes, which changes the output potential of the amplifier circuit 104 as well. In addition, the gate potential of the transistor 101 also changes. That is, a feedback circuit is formed. Therefore, a potential which stabilizes the state of each terminal is outputted from the amplifier circuit 104 through the aforementioned feedback operation.

That is to say, in FIG. 1, a potential which stabilizes the potential of the second terminal (drain terminal here) of the transistor 101 is outputted to the gate terminal of the transistor 101 from the amplifier circuit 104. The drain potential of the transistor 101 at that time can be controlled by a potential to be supplied to the wire 108. Therefore, a voltage applied to the current-voltage converting element 103 can be controlled by the potential to be applied to the wire 108. In other words, the current Idata to be applied to the transistor 101 can be controlled.

As described above, by using a feedback circuit including the amplifier circuit 104, a gate potential for applying a desired current to the transistor 101 can be set. At this time, setting of the gate potential of the transistor 101 can be completed rapidly since the amplifier circuit 104 is used; thus, writing can be terminated for a short time. Then, the transistor 101 which is set can operate as a current source circuit and supply a current to various loads.

Figure 3:
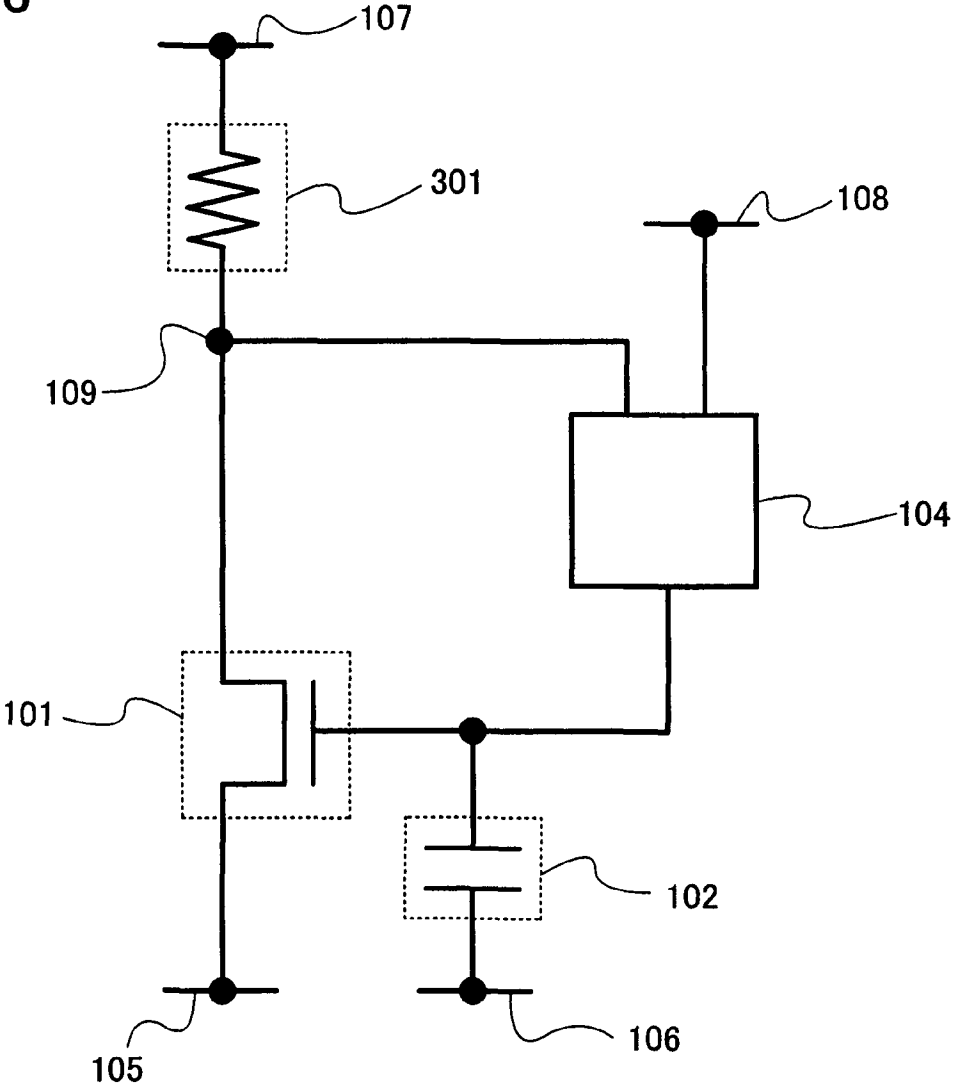
FIG. 3 is a diagram showing a semiconductor device of the invention.
Figure 4B:
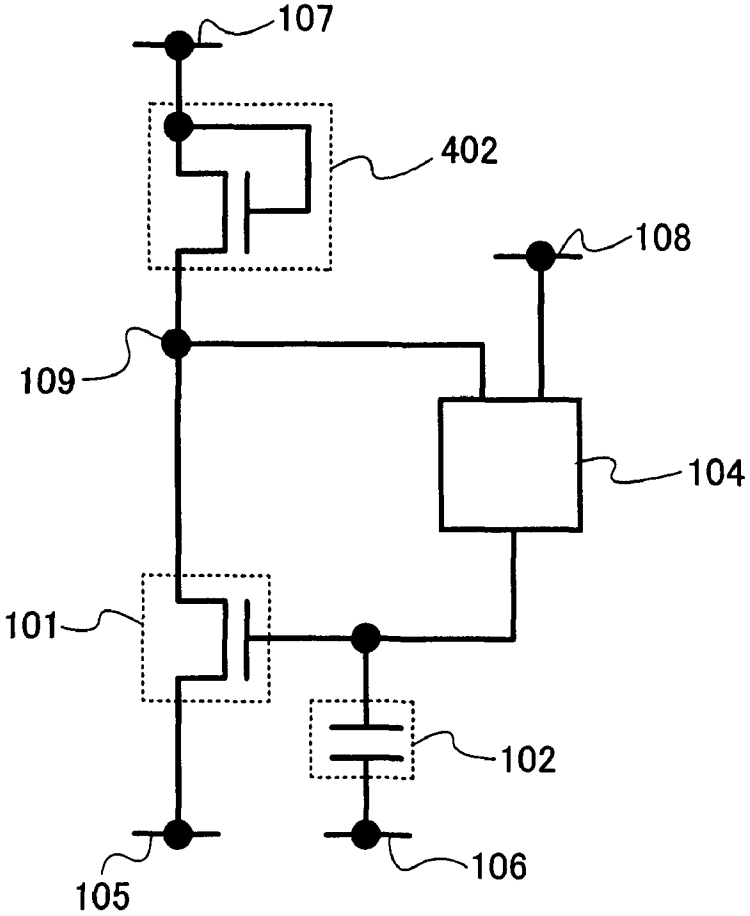
FIGS. 4A and 4B are diagrams each showing a semiconductor device of the invention.
Figure 4A:
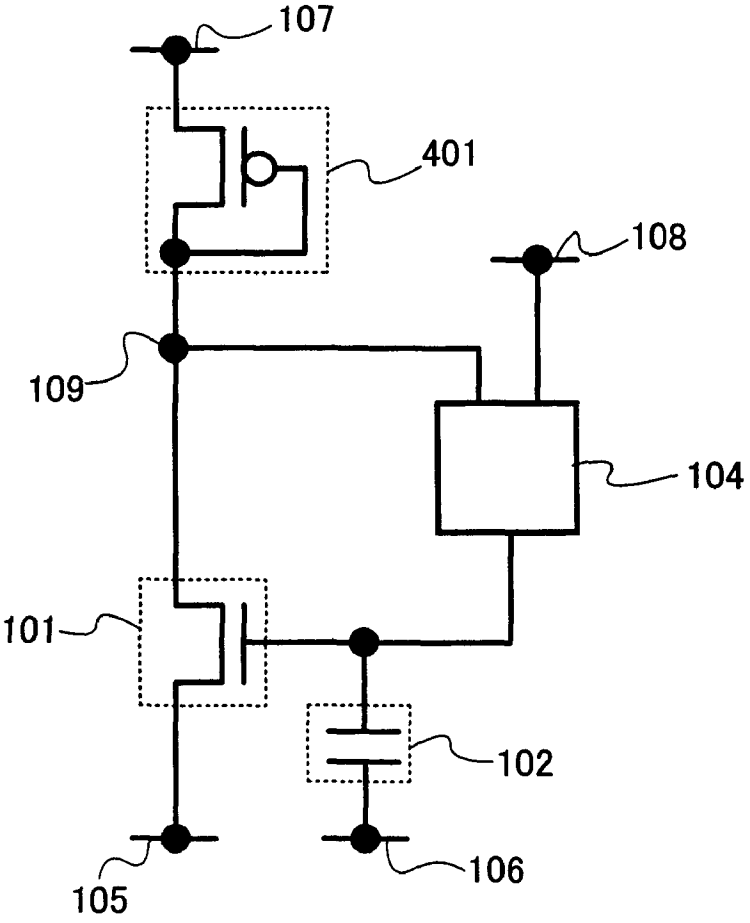

Note that the current-voltage converting element 103 may be an element that a voltage is generated between its terminals when a current is applied, thus a resistor element, a rectifying element, or the like can be applied. FIG. 3 shows a case of applying a resistor element to the current-voltage converting element 103. In a semiconductor device in FIG. 3, a resistor element 303 corresponds to the current-voltage converting element 103 in FIG. 1. Meanwhile, FIGS. 4A and 4B each show a case of applying a diode-connected transistor as a rectifying element to the current-voltage converting element 103 of the semiconductor device in FIG. 1. A transistor 401 of a semiconductor device in FIG. 4A and a transistor 402 of a semiconductor device in FIG. 4B each correspond to the current-voltage converting element 103 in FIG. 1. The p-channel transistor 401 has a first terminal (one of a source terminal and a drain terminal) connected to the wire 107, and a second terminal (the other of the source terminal and the drain terminal) connected to a gate terminal and the second terminal of the transistor 101. The n-channel transistor 402 has a first terminal (one of a source terminal and a drain terminal) connected to the second terminal of the transistor 101, and a second terminal (the other of the source terminal and the drain terminal) connected to a gate terminal and the wire 107.

Figure 12:
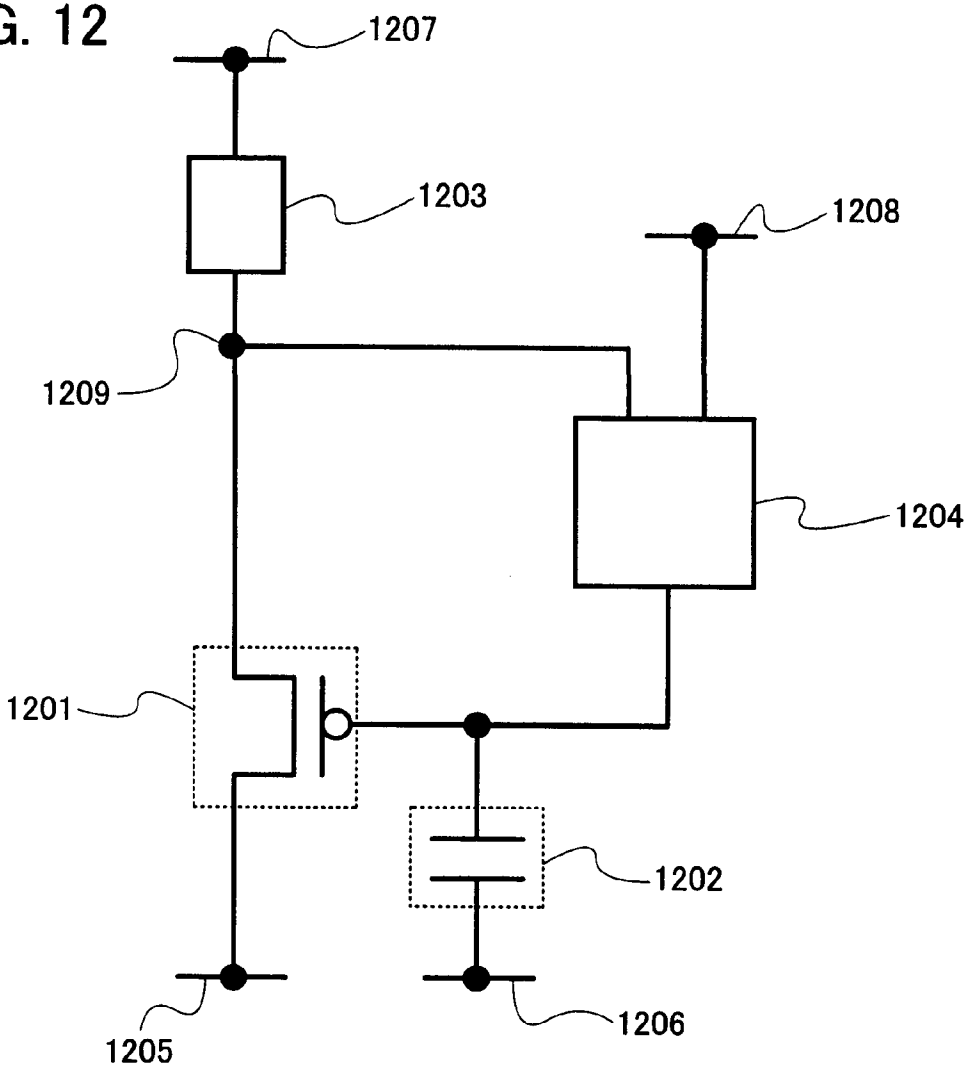
FIG. 12 is a diagram showing a semiconductor device of the invention.

Note that in FIG. 1, an n-channel transistor is used as a transistor which sets a gate-source voltage; however, the invention is not limited to this. FIG. 12 shows a configuration in a case of applying a p-channel transistor.

A semiconductor device shown in FIG. 12 includes a transistor 1201, a capacitor 1202, a current-voltage converting element 1203, and an amplifier circuit 1204. Note that the transistor 1201 is a p-channel transistor.

The transistor 1201 has a first terminal (one of a source terminal and a drain terminal) connected to a wire 1205, a second terminal (the other of the source terminal and the drain terminal) connected to a wire 1207 through the current-voltage converting element 1203, and a gate terminal connected to a wire 1206 through the capacitor 1202. Note that a low power source potential Vss is supplied to the wire 1207, whereas a high power source potential Vdd is supplied to the wires 1205 and 1206. Here, Vss<Vdd is satisfied.

Note that the capacitor 1202 is only required to hold a gate-source voltage of the transistor 1201. In other words, the capacitor 1202 is only required to hold a gate potential of the transistor 1201 when a potential of the wire 1205 connected to the first terminal to be the source terminal of the transistor 1201 is constant. Therefore, when the capacitor 1202 can hold a gate potential of the transistor 1201, a potential to be supplied to the wire 1206 is not limited. Potentials to be supplied to the wires 1205 and 1206 may be the same; thus, the wires 1205 and 1206 may be a continuous wire, not separate wires. Note that the capacitor 1202 is not required to be provided when the capacitor 1202 can be substituted by gate capacitance of the transistor 1201 since the capacitor 1202 is provided for holding the gate potential of the transistor 1201.

The amplifier circuit 1204 has a first input terminal connected to a wire between the second terminal of the transistor 1201 and the current-voltage converting element 1203, a second input terminal connected to the wire 1208, and an output terminal connected to the gate terminal of the transistor 1201. Note that a predetermined potential is supplied to the wire 1208. Further, an intersection of a wire between the second terminal of the transistor 1201 and the current-voltage converting element 1203, and the first input terminal of the amplifier circuit 1204 is a node 1209.

Subsequently, an operation is described briefly. The first input terminal of the amplifier circuit 1204 detects a voltage of the current-voltage converting element 1203. In other words, a potential of the node 1209 is inputted to the first input terminal of the amplifier circuit 1204. Further, the amplifier circuit 1204 outputs a potential from the output terminal so that the first input terminal and the second input terminal have a predetermined potential difference. In other words, the amplifier circuit 1204 controls the gate potential of the transistor 1201 so that a difference between a potential of the node 1209 and a potential supplied to the wire 1208 is a predetermined potential difference. It is to be noted that the predetermined potential difference includes a case of 0 V.

Thus, the transistor 1201 can obtain a gate potential for making the node 1209 have a desired potential. The node 1209 is made to have a desired potential, thereby a voltage applied to the current-voltage converting element 1203 can be a desired voltage. In this case, the current Idata with respect to the desired voltage applied to the current-voltage converting element 1203 flows to the current-voltage converting element 1203. Further, the current Idata also flows to the transistor 1201. The transistor 1201 has a gate-source voltage required to apply the Idata.

The transistor 1201 in this case has a proper level of gate-source voltage for applying the Idata without depending on current characteristics (such as mobility and a threshold voltage) or a size (a gate width or a gate length) of the transistor 1201. Therefore, the current Idata can be applied to the transistor 1201 even when the current characteristics or the sizes of transistors in the semiconductor device each corresponding to the transistor 1201 vary. Accordingly, the transistor 1201 can operate as a current source and supply a current to various loads (another transistor, a pixel, a signal line driver circuit, or the like).

Further, when the current Idata flows to the transistor 1201, that is, even when the Vds changes between the case of performing a set operation and the case of supplying a current to a load from the transistor 1201, a current value flowing through the transistor 1201 does not change. However, a current value may change due to the kink (Early) effect even when the transistor operates in a saturation region. In that case, the potential of the node 1209, that is the potential of the second terminal (drain terminal here) of the transistor 1201 can be controlled by controlling a potential of the second input terminal of the amplifier circuit 1204; therefore, the kink (Early) effect can be reduced.

For example, Vds can be approximately equal between the case of performing the set operation and the case of performing the output operation by controlling the potential of the second input terminal of the amplifier circuit 104 appropriately in accordance with the amount of the current Idata.

Even in the case where voltage-current characteristics of a load change due to deterioration and the like, Vds in the case of performing the set operation can be made approximately equal to Vds in the case of performing the output operation by controlling the potential to be inputted to the second input terminal of the amplifier circuit 1204 appropriately. Therefore, an appropriate amount of current can be supplied. Thus, an image burn-in can be prevented in the case where the load is an EL element or the like.

Note that the amplifier circuit 1204 has low output impedance. Therefore, it can supply a large amount of current. Thus, it can make the gate terminal of the transistor 1201 have a desired potential rapidly. That is, a writing speed of the current Idata is increased, which can complete writing rapidly. Further, even when the amount of the current Idata is small, the gate terminal of the transistor 1201 can be made to have a desired potential rapidly; therefore, a writing defect of a signal can be prevented.

The amplifier circuit 1204 has a function to detect a potential difference of the first input terminal and the second input terminal, and amplify it to be outputted. In FIG. 12, the first input terminal of the amplifier circuit 1204 and the second terminal (a drain terminal in this case) of the transistor 1201 are connected, and the output terminal of the amplifier circuit 1204 and the gate terminal of the transistor 1201 are connected. When the gate potential of the transistor 1201 changes, the drain potential of the transistor 1201 also changes; thus, the potential of the first input terminal of the amplifier circuit 1204 also changes. When the drain potential of the transistor 1201 changes, the first input terminal of the amplifier circuit 1204 also changes, which changes the output terminal of the amplifier circuit 1204 as well. In addition, the gate potential of the transistor 1201 also changes. That is, a feedback circuit is formed. Therefore, a potential which stabilizes the state of each terminal is outputted from the amplifier circuit 1204 through the aforementioned feedback operation.

That is to say, in FIG. 12, a potential which stabilizes the potential of the drain terminal of the transistor 1201 is outputted to the gate terminal of the transistor 1201 from the amplifier circuit 1204. The drain potential of the transistor 1201 at that time can be controlled by a potential to be supplied to the wire 1208. Therefore, a voltage applied to the current-voltage converting element 1203 can be controlled by the potential to be applied to the wire 1208. In other words, the current Idata to be applied to the transistor 1201 can be controlled.

As described above, by using a feedback circuit including the amplifier circuit 1204, a gate potential for applying a desired current to the transistor 1201 can be set. At this time, setting of the gate potential of the transistor 1201 can be completed rapidly since the amplifier circuit 1204 is used; thus, writing can be terminated for a short time. Then, the transistor 1201 which is set can operate as a current source circuit and supply a current to various loads.

Embodiment Mode 2

In Embodiment Mode 1, a current flowing through a transistor is controlled by detecting a drain potential of a transistor connected to a current-voltage converting element in series and setting a drain potential of the transistor by an amplifier circuit. In this embodiment mode, description is made of a structure where a current flowing through a transistor is controlled by detecting a drain potential of a transistor connected to a current-voltage converting element in series and setting a source potential of the transistor by an amplifier circuit.

Figure 20:
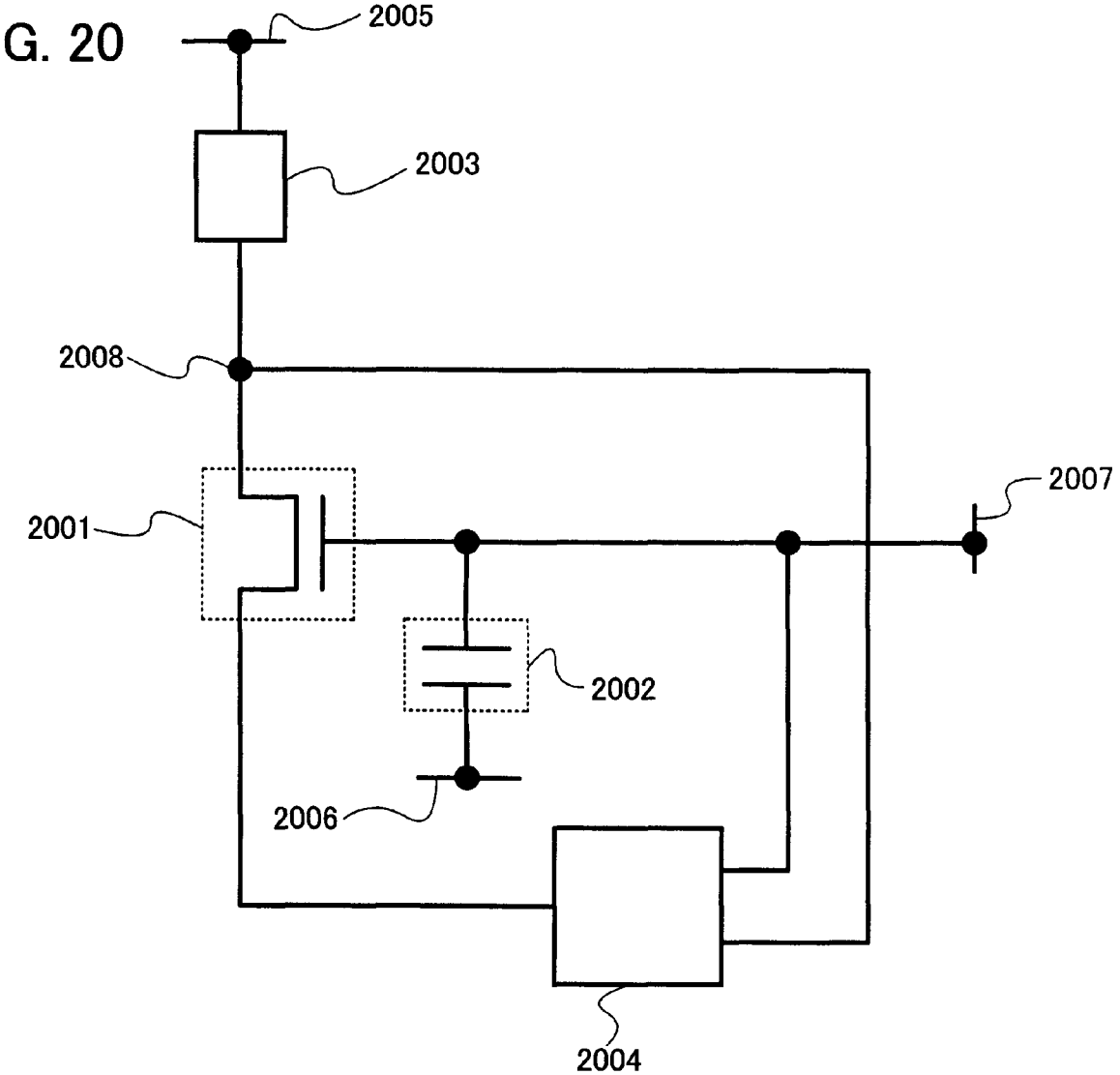
FIG. 20 is a diagram showing a semiconductor device of the invention.

A semiconductor device shown in FIG. 20 includes a transistor 2001, a capacitor 2002, a current-voltage converting element 2003, and an amplifier circuit 2004. It is to be noted that the transistor 2001 is an n-channel transistor.

The transistor 2001 has a first terminal (one of a source terminal and a drain terminal) connected to an output terminal of the amplifier circuit 2004, a second terminal (the other of the source terminal and the drain terminal) connected to a wire 2005 through the current-voltage converting element 2003, and a gate terminal connected to a wire 2007. Moreover, the gate terminal of the transistor 2001 is connected to a second input terminal of the amplifier circuit 2004 as well as being connected to a wire 2006 through the capacitor 2002. Further, the amplifier circuit 2004 has a first terminal connected to a wire between the second terminal of the transistor 2001 and the current-voltage converting element 2003. An intersection of the wire between the second terminal of the transistor 2001 and the current-voltage converting element 2003 and a first input terminal of the amplifier circuit 2004 is a node 2008. A high power source potential Vdd is supplied to the wire 2005, a low power source potential Vss is supplied to the wire 2006, and a predetermined potential is supplied to the wire 2007. Here, Vss<Vdd is satisfied.

Note that the capacitor 2002 is only required to hold a gate-source voltage of the transistor 2001. In other words, the capacitor 2002 is only required to hold a gate potential of the transistor 2001 when an output of the amplifier circuit 2004 keeps to be supplied to the first terminal to be the source terminal of the transistor 2001. Therefore, a potential to be supplied to the wire 2006 is not limited since the capacitor 2002 is only required to hold a gate potential of the transistor 2001. Note that the capacitor 2002 is not required to be provided when the capacitor 2002 can be substituted by gate capacitance of the transistor 2001.

Subsequently, an operation is described briefly. The first input terminal of the amplifier circuit 2004 detects a voltage of the current-voltage converting element 2003. In other words, a potential of the node 2008 is inputted to the first input terminal of the amplifier circuit 2004. Further, the amplifier circuit 2004 outputs a potential from the output terminal so that the first input terminal and the second input terminal have a predetermined potential difference. In other words, the amplifier circuit 2004 controls the source potential of the transistor 2001 so that a difference between a potential of the node 2008 and a potential supplied to the wire 2007 is a predetermined potential difference.

Thus, the transistor 2001 can obtain the source potential for making the node 2008 have a desired potential. The node 2008 is made to have a desired potential, thereby a voltage applied to the current-voltage converting element 2003 can be a desired voltage. In this case, a current Idata with respect to the desired voltage applied to the current-voltage converting element 2003 flows to the current-voltage converting element 2003. Further, the current Idata also flows to the transistor 2001. The transistor 2001 has a gate-source voltage required to apply the Idata.

The transistor 2001 in this case has a proper level of gate-source voltage for applying the Idata without depending on current characteristics (such as mobility and a threshold voltage) or a size (a gate width or a gate length) of the transistor 2001. Therefore, the transistor 2001 can apply the current Idata even when the current characteristics or the sizes of transistors in the semiconductor device each corresponding to the transistor 2001 vary. Accordingly, the transistor 2001 can operate as a current source and supply a current to various loads (another transistor, a pixel, a signal line driver circuit, or the like).

Further, when the current Idata flows to the transistor 2001, that is, even when the Vds changes between the case of performing a set operation and the case of supplying a current to a load from the transistor 2001, a current value flowing through the transistor 2001 does not change. However, a current value may change due to the kink (Early) effect even when the transistor operates in a saturation region. In that case, the potential of the node 2008, that is the potential of the second terminal of the transistor 2001 can be controlled by controlling a potential of the second input terminal of the amplifier circuit 2004; therefore, the kink (Early) effect can be reduced.

For example, Vds can be approximately equal between the case of performing the set operation and the case of performing the output operation by controlling the potential of the second input terminal of the amplifier circuit 2004 appropriately in accordance with the amount of the current Idata.

Even in the case where voltage-current characteristics of a load change due to deterioration and the like, Vds in the case of performing the set operation can be approximately equal to Vds in the case of performing the output operation by controlling the potential to be inputted to the second input terminal of the amplifier circuit 2004 appropriately. Therefore, an appropriate amount of current can be supplied. Thus, an image burn-in can be prevented in the case where the load is an EL element or the like.

Note that the amplifier circuit 2004 has low output impedance. Therefore, it can supply a large amount of current. Thus, it can set a source potential of the transistor 2001 rapidly. That is, a writing speed of the current Idata is increased, which can complete writing rapidly. Further, even when the amount of the current Idata is small, the source terminal of the transistor 2001 can be made to have a desired potential rapidly; therefore, a writing defect of a signal can be prevented.

The amplifier circuit 2004 has a function to detect a potential difference of the first input terminal and the second input terminal, and amplify it to be outputted. In FIG. 20, the first input terminal of the amplifier circuit 2004 and the second terminal (a drain terminal in this case) of the transistor 2001 are connected, and the output terminal of the amplifier circuit 2004 and the first terminal (a source terminal in this case) of the transistor 2001 are connected. When the drain potential of the transistor 2001 changes, a potential of the first input terminal of the amplifier circuit 2004 also changes, thus an output potential of the amplifier circuit 2004 also changes, and the source potential of the transistor 2001 also changes. When the source potential of the transistor 2001 changes, a drain potential thereof also changes. That is, a feedback circuit is formed. Therefore, a potential which stabilizes the state of each terminal is outputted from the amplifier circuit 2004 through the aforementioned feedback operation.

That is to say, in FIG. 20, a potential which stabilizes the potential of the drain terminal of the transistor 2001 is outputted to the source terminal of the transistor 2001 from the amplifier circuit 2004. The drain potential of the transistor 2001 at that time can be controlled by a potential to be supplied to the wire 2007. Therefore, a voltage applied to the current-voltage converting element 2003 can be controlled by the potential to be applied to the wire 2007. In other words, the current Idata to be applied to the transistor 2001 can be controlled.

As described above, by using a feedback circuit including the amplifier circuit 2004, a source potential for applying a desired current to the transistor 2001 can be set. At this time, setting of the source potential of the transistor 2001 can be completed rapidly since the amplifier circuit 2004 is used, thus writing can be terminated for a short time. Then, the transistor 2001 which is set can operate as a current source circuit and supply a current to various loads.

Figure 24:
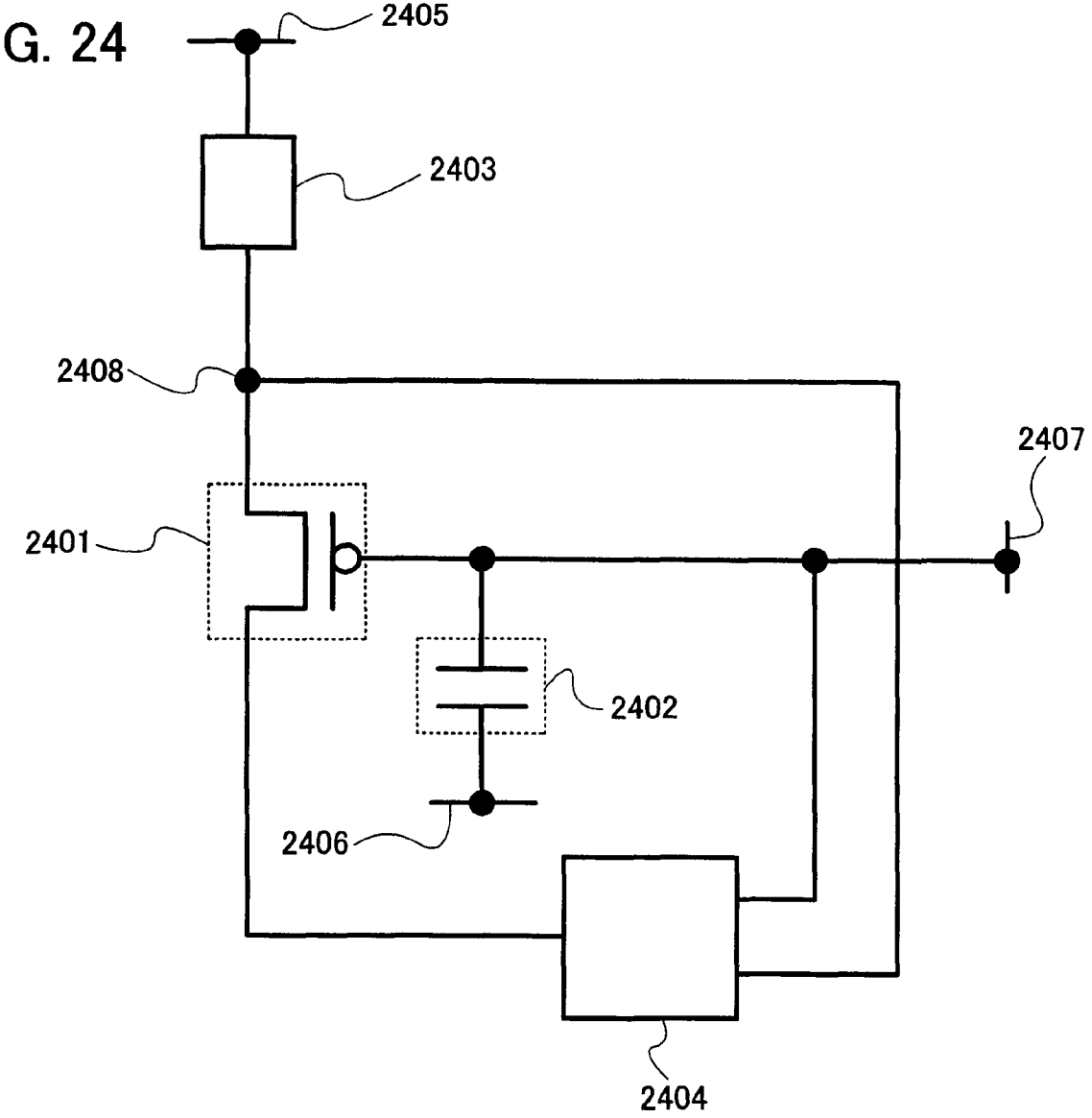
FIG. 24 is a diagram showing a semiconductor device of the invention.

Note that in FIG. 20, an n-channel transistor is used as a transistor; however, a p-channel transistor can be applied to a semiconductor device described in this embodiment mode. FIG. 24 shows a configuration of that case.

A semiconductor device shown in FIG. 24 includes a transistor 2401, a capacitor 2402, a current-voltage converting element 2403, and an amplifier circuit 2404. Note that the transistor 2401 is a p-channel transistor.

The transistor 2401 has a first terminal (one of a source terminal and a drain terminal) connected to an output terminal of the amplifier circuit 2404, a second terminal (the other of the source terminal and the drain terminal) connected to a wire 2405 through the current-voltage converting element 2403, and a gate terminal connected to a wire 2407. Moreover, the gate terminal of the transistor 2401 is connected to a second input terminal of the amplifier circuit 2404 as well as being connected to a wire 2406 through the capacitor 2402. Further, the amplifier circuit 2404 has a first input terminal connected to a wire between the second terminal of the transistor 2401 and the current-voltage converting element 2403. Note that a predetermined potential is supplied to the wire 2407. An intersection of a wire between the second terminal of the transistor 2401 and the current-voltage converting element 2403, and the first input terminal of the amplifier circuit 2404 is a node 2408. A low power source potential Vss is supplied to the wire 2405, a high power source potential Vdd is supplied to the wire 2406, and a predetermined potential is supplied to the wire 2407. Here, Vss<Vdd is satisfied.

Note that the capacitor 2402 is only required to hold a gate-source voltage of the transistor 2401. In other words, the capacitor 2402 is only required to hold a gate potential of the transistor 2401 when an output of the amplifier circuit 2404 keeps to be supplied to the first terminal to be the source terminal of the transistor 2401. Therefore, a potential to be supplied to the wire 2406 is not limited since the capacitor 2402 is only required to hold a gate potential of the transistor 2401. Note that the capacitor 2402 is not required to be provided when the capacitor 2402 can be substituted by gate capacitance of the transistor 2401.

Subsequently, an operation is described briefly. The first input terminal of the amplifier circuit 2404 detects a voltage of the current-voltage converting element 2403. In other words, a potential of the node 2408 is inputted to the first input terminal of the amplifier circuit 2404. Then, the amplifier circuit 2404 outputs a potential from the output terminal so that the first input terminal and the second input terminal have a predetermined potential difference. In other words, the amplifier circuit 2404 controls the source potential of the transistor 2401 so that a difference between a potential of the node 2408 and a potential supplied to the wire 2407 is a predetermined potential difference.

Thus, the transistor 2401 can obtain the source potential for making the node 2408 have a desired potential. The node 2408 is made to have a desired potential, thereby a voltage applied to the current-voltage converting element 2403 can be a desired voltage. In this case, a current Idata with respect to the desired voltage applied to the current-voltage converting element 2403 flows to the current-voltage converting element 2403. Further, the current Idata also flows to the transistor 2401. The transistor 2401 has a gate-source voltage required to apply the Idata.

The transistor 2401 in this case has a proper level of gate-source voltage for applying the Idata without depending on current characteristics (such as mobility and a threshold voltage) or a size (a gate width or a gate length). Therefore, the transistor 2401 can apply the current Idata even when the current characteristics or the sizes of transistors in the semiconductor device each corresponding to the transistor 2401 vary. Accordingly, the transistor 2401 can operate as a current source and supply a current to various loads (another transistor, a pixel, a signal line driver circuit, or the like).

Further, when the current Idata flows to the transistor 2401, that is, even when the Vds changes between the case of performing a set operation and the case of supplying a current to a load from the transistor 2401, a current value flowing through the transistor 2401 does not change. However, a current value may change due to the kink (Early) effect even when the transistor operates in a saturation region. In that case, the potential of the node 2408, that is the potential of the second terminal (drain terminal here) of the transistor 2401 can be controlled by controlling a potential of the second input terminal of the amplifier circuit 2404; therefore, the kink (Early) effect can be reduced.

For example, Vds can be approximately equal between the case of performing the set operation and the case of performing the output operation by controlling the potential of the second input terminal of the amplifier circuit 2404 appropriately in accordance with the amount of the current Idata.

Even in the case where voltage-current characteristics of a load change due to deterioration and the like, Vds in the case of performing the set operation can be approximately equal to Vds in the case of performing the output operation by controlling the potential to be inputted to the second input terminal of the amplifier circuit 2404 appropriately. Therefore, an appropriate amount of current can be supplied. Thus, an image burn-in can be prevented in the case where the load is an EL element or the like.

Note that the amplifier circuit 2404 has low output impedance. Therefore, it can supply a large amount of current. Thus, it can set a source potential of the transistor 2401 rapidly. That is, a writing speed of the current Idata is increased, which can complete writing rapidly. Further, even when the amount of the current Idata is small, the source terminal of the transistor 2401 can be made to have a desired potential rapidly; therefore, a writing defect of a signal can be prevented.

The amplifier circuit 2404 has a function to detect a potential difference of the first input terminal and the second input terminal, and amplify it to be outputted. In FIG. 24, the second input terminal of the amplifier circuit 2404 and the second terminal (drain terminal in this case) of the transistor 2401 are connected, and the output terminal of the amplifier circuit 2404 and the first terminal (source terminal in this case) of the transistor 2401 are connected. When the drain potential of the transistor 2401 changes, a potential of the first input terminal of the amplifier circuit 2404 also changes; thus, an output potential of the amplifier circuit 2404 also changes, and the source potential of the transistor 2401 also changes. When the source potential of the transistor 2401 changes, a drain potential thereof also changes. That is, a feedback circuit is formed. Therefore, a potential which stabilizes the state of each terminal is outputted from the amplifier circuit 2404 through the aforementioned feedback operation.

That is to say, in FIG. 24, a potential which stabilizes the potential of the drain terminal of the transistor 2401 is outputted to the source terminal of the transistor 2401 from the amplifier circuit 2404. The drain potential of the transistor 2401 at that time can be controlled by a potential to be supplied to the wire 2407. Therefore, a voltage applied to the current-voltage converting element 2403 can be controlled by the potential to be applied to the wire 2407. In other words, the current Idata to be applied to the transistor 2401 can be controlled.

As described above, by using a feedback circuit including the amplifier circuit 2404, a source potential for applying a desired current to the transistor 2401 can be set. At this time, setting of the source potential of the transistor 2401 can be completed rapidly since the amplifier circuit 2404 is used; thus, writing can be terminated for a short time. Then, the transistor 2401 which is set can operate as a current source circuit and supply a current to various loads.

Embodiment Mode 3

In this embodiment mode, description is made of a configuration which can be applied to an amplifier circuit of the semiconductor device described in Embodiment Modes 1 and 2. An operational amplifier or a differential amplifier circuit can be used as the amplifier circuit. Further, a voltage feedback operational amplifier or a current feedback operational amplifier may be used as the amplifier circuit. Alternatively, an operational amplifier additionally provided with various correction circuits such as a phase compensation circuit may be used. It is to be noted that the amplifier circuit described in this embodiment mode can be used in other embodiment modes described later.

Note that an operational amplifier normally operates so that a potential of a non-inverting input terminal and a potential of an inverting input terminal are equal to each other; however, the potential of the non-inverting input terminal and the potential of the inverting input terminal are not the same due to a variation in characteristics and the like in some cases. That is, an offset voltage is generated in some cases. In those cases, similarly to a normal operational amplifier, the potential of the non-inverting input terminal and the potential of the inverting input terminal may be controlled to be equal for operation. However, in this embodiment mode, an operational amplifier may be controlled to operate in a saturation region. Therefore, an offset voltage may be generated in an operational amplifier and varied offset voltages do not affect an operation of a semiconductor device as far as the transistor can operate in a saturation region. Thus, even when an operational amplifier is formed using a transistor of which current characteristics vary significantly, the semiconductor device operates normally.

Figure 2:
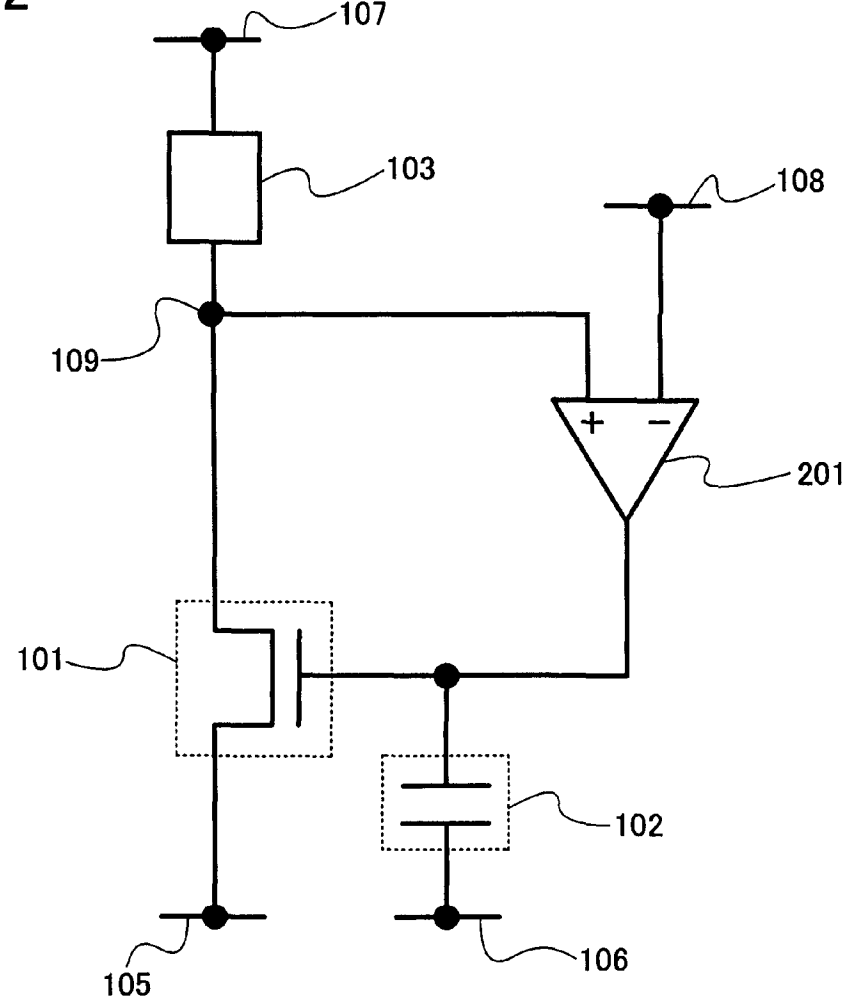
FIG. 2 is a diagram showing a semiconductor device of the invention.

First, description is made of a configuration which can be applied to an amplifier circuit of the semiconductor device described in Embodiment Mode 1. FIG. 2 shows a case of applying an operational amplifier to the amplifier circuit 104 of the semiconductor device in FIG. 1. That is, an operational amplifier 201 is used as the amplifier circuit 104 in FIG. 1. The operational amplifier 201 has a non-inverting input terminal, an inverting input terminal, and an output terminal. The non-inverting input terminal corresponds to the first input terminal of the amplifier circuit 104. The inverting input terminal corresponds to the second input terminal of the amplifier circuit 104. The output terminal corresponds to the output terminal of the amplifier circuit 104.

The operational amplifier 201 amplifies a potential difference between the non-inverting input terminal and the inverting input terminal to output a voltage from the output terminal. In other words, in the case where the potential of the node 109, that is a potential of the non-inverting input terminal of the operational amplifier 201 is higher than the potential supplied to the wire 108, that is a potential of the inverting input terminal of the operational amplifier 201, an output voltage of the operational amplifier 201 is a positive voltage. When the transistor 101 has a higher gate potential by an output from the operational amplifier 201 and the amount of a current flowing though the transistor 101 is increased, the node 109 has a lower potential. Further, the non-inverting input terminal of the operational amplifier 201 also has a lower potential. Accordingly, a potential difference between the non-inverting input terminal and the inverting input terminal of the operational amplifier 201 is reduced. Then, the operational amplifier 201 has a smaller absolute value of the output voltage.

In other words, in the case where the potential of the node 109, that is the potential of the non-inverting input terminal of the operational amplifier 201 is lower than the potential supplied to the wire 108, that is the potential of the inverting input terminal of the operational amplifier 201, the output voltage of the operational amplifier 201 is a negative voltage. When the transistor 101 has a lower gate potential by an output from the operational amplifier 201 and the amount of a current flowing though the transistor 101 is decreased, the node 109 has a higher potential. Further, the non-inverting input terminal of the operational amplifier 201 also has a higher potential. Accordingly, a potential difference between the non-inverting input terminal and the inverting input terminal of the operational amplifier 201 is reduced. Then, the operational amplifier 201 has a smaller absolute value of the output voltage.

Thus, the first input terminal and the second input terminal of the operational amplifier 201 have a certain potential difference, thereby the potential of the node 109 is stabilized. Note that the certain potential difference includes a case of 0 V, that is, a so-called hypothetically short-circuited state where potential difference between the non-inverting input terminal and the inverting input terminal of the operational amplifier 201 is approximately 0 V. In this configuration, the operational amplifier 201 is connected in a negative feedback arrangement.

Figure 13:
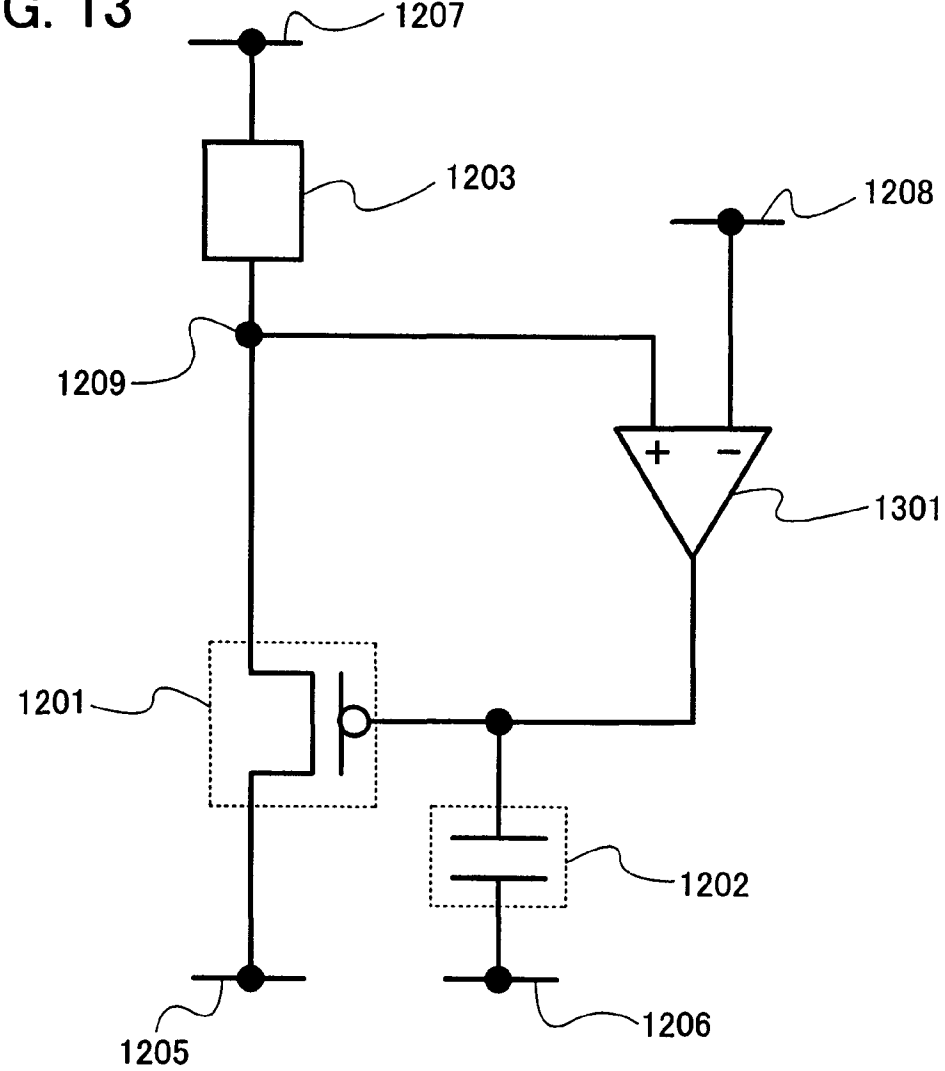
FIG. 13 is a diagram showing a semiconductor device of the invention.

Next, FIG. 13 shows a case of applying an operational amplifier to the amplifier circuit 1204 of the semiconductor device in FIG. 12. That is, an operational amplifier 1301 is used as the amplifier circuit 1204 in FIG. 12. The operational amplifier 1301 has a non-inverting input terminal, an inverting input terminal, and an output terminal. The non-inverting input terminal corresponds to the first input terminal of the amplifier circuit 1204. The inverting input terminal corresponds to the second input terminal of the amplifier circuit 1204. The output terminal corresponds to the output terminal of the amplifier circuit 1204.

The operational amplifier 1301 amplifies a potential difference between the non-inverting input terminal and the inverting input terminal to output a voltage from the output terminal. In other words, in the case where the potential of the node 1209, that is the potential of the non-inverting input terminal of the operational amplifier 1301 is higher than the potential supplied to the wire 1208, that is the potential of the inverting input terminal of the operational amplifier 1301, an output voltage of the operational amplifier 1301 is a positive voltage. When the transistor 1201 has a higher gate potential by an output from the operational amplifier 1301, and the amount of a current flowing though the transistor 1201 is decreased, the node 1209 has a lower potential. Further, the non-inverting input terminal of the operational amplifier 1301 also has a lower potential. Accordingly, a potential difference between the non-inverting input terminal and the inverting input terminal of the operational amplifier 1301 is reduced. Then, the operational amplifier 1301 has a lower level of the output voltage. Thus, the potential of the node 1209 is stabilized so that the first input terminal and the second input terminal of the operational amplifier 1301 have a certain potential difference. In this configuration, the operational amplifier 1301 is connected in a negative feedback arrangement.

Figure 11:
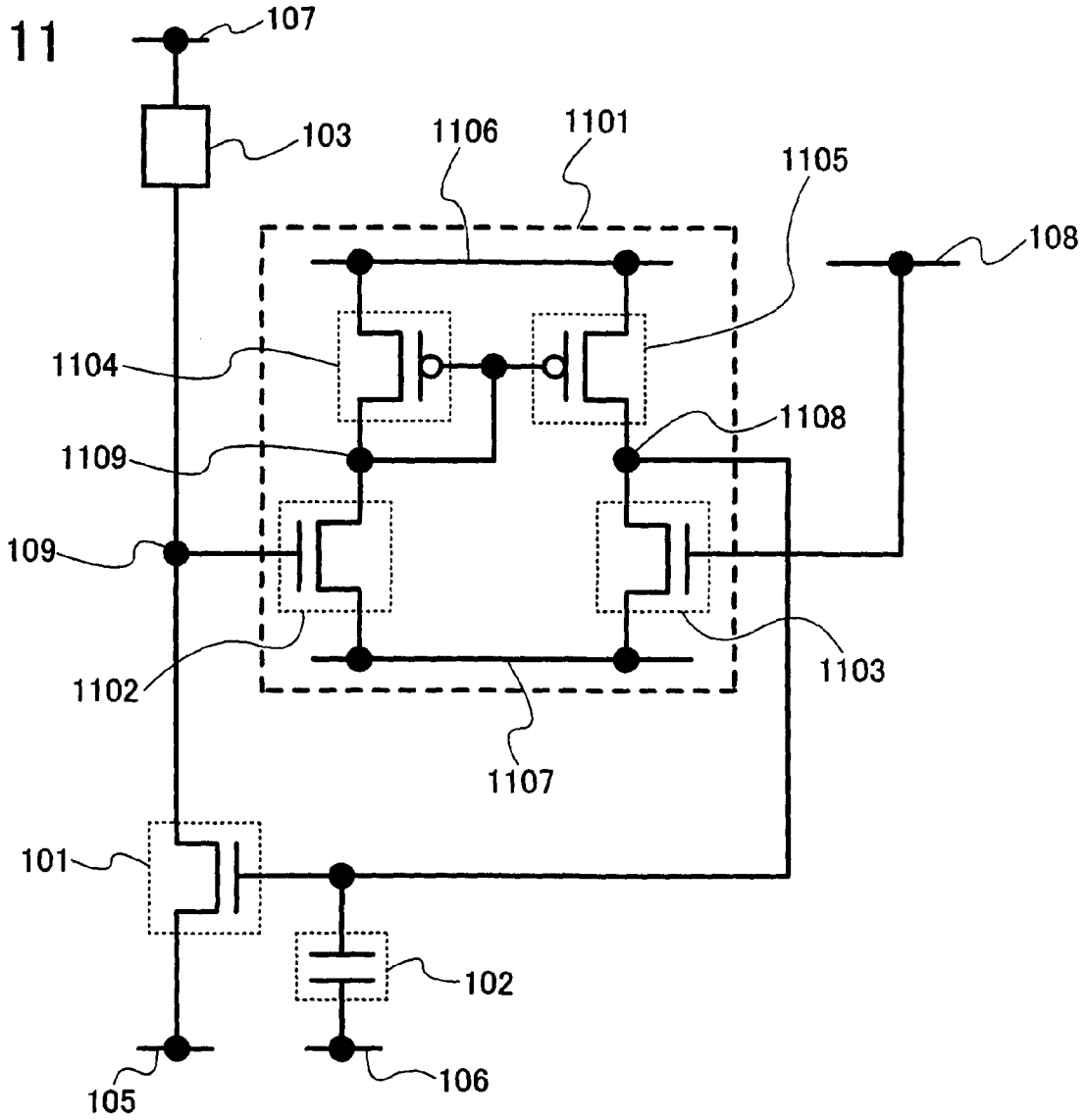
FIG. 11 is a diagram showing a semiconductor device of the invention.

Next, FIG. 11 shows a case of applying a differential amplifier circuit to the amplifier circuit 104 of the semiconductor device in FIG. 1. That is, an operational amplifier 1101 is used as the amplifier circuit 104 in FIG. 1. The differential amplifier circuit 1101 includes a first transistor 1102, a second transistor 1103, a third transistor 1104, and a fourth transistor 1105.

The first transistor 1102 has a first terminal (one of a source terminal and a drain terminal) connected to a wire 1107, a second terminal (the other of the source terminal and the drain terminal) connected to a second terminal (one of a source terminal and a drain terminal) of the third transistor 1104, and a gate terminal connected to the second terminal of the transistor 101 at the node 109.

The second transistor 1103 has a first terminal (one of a source terminal and a drain terminal) connected to the wire 1107, a second terminal (the other of the source terminal and the drain terminal) connected to a second terminal (one of a source terminal and a drain terminal) of the fourth transistor 1105, and a gate terminal connected to the wire 108.

The third transistor 1104 has a gate terminal connected to the second terminal of the third transistor 1104 and a gate terminal of the fourth transistor 1105, and a first terminal (the other of the source terminal and the drain terminal) connected to a wire 1106.

The fourth transistor 1105 has a first terminal (the other of the source terminal and the drain terminal) connected to the wire 1106. A node 1108 at which the second terminal of the second transistor 1103 and the second terminal of the fourth transistor 1105 are connected is connected to the gate terminal of the transistor 101.

A high power source potential Vdd is supplied to the wire 1106, whereas a low power source potential Vss is supplied to the wire 1107. The gate terminal of the first transistor 1102 corresponds to the first input terminal of the amplifier circuit 104. The gate terminal of the second transistor 1103 corresponds to the second input terminal of the amplifier circuit 104. The node 1108 corresponds to the output terminal of the amplifier circuit 104.

Here, an operation of the differential amplifier circuit 1101 is briefly described. The third transistor 1104 has the second terminal and the gate terminal which are connected to each other. That is, the second terminal of the third transistor 1104 is a drain terminal; therefore, the third transistor 1104 has the drain terminal and the gate terminal which are connected to each other, and operates in a saturation region. Further, a gate-source voltage of the first transistor 1102 is determined by the potential of the node 109, and the potential of the node 1109 is determined by the value of the gate-source voltage of the first transistor 1102. Then, the potential of the node 1109 is inputted to the gate terminal of the fourth transistor 1105 as well. Thus, a gate-source voltage of the fourth transistor 1105 is determined. Further, a gate-source voltage of the second transistor 1103 is determined by a potential supplied to the wire 108. The potential of the node 1108 is determined by the values of the gate-source voltage of the fourth transistor 1105 and the gate-source voltage of the second transistor 1103.

Here, description is made of a case where the first transistor 1102 and the second transistor 1103 have the same characteristics and the third transistor 1104 and the fourth transistor 1105 have the same characteristics. In this case, when the potential of the node 109 and the potential supplied to the wire 108 are equal to each other, the potential of the node 1109 and the potential of the node 1108 are equal to each other, whereas when the potential of the node 109 is higher than the potential supplied to the wire 108, the potential of the node 1109 is approximated to the potential of the wire 1107. Then, the fourth transistor 1105 has a higher level of the gate-source voltage, and the potential of the node 1108 is approximated to the potential of the wire 1106. Accordingly, a potential outputted from the output terminal of the differential amplifier circuit 1101 becomes high.

Then, the transistor 101 has a higher gate potential; thus, the transistor 101 has a higher level of the gate-source voltage. That is, the amount of the current flowing to the transistor 101 is increased. Accordingly, the amount of the current flowing to the current-voltage converting element 103 is increased; therefore, a voltage drop of the current-voltage converting element 103 is increased and the potential of the node 109 becomes low.

When the potential of the node 109 is lower than the potential supplied to the wire 108, the potential of the node 1109 is approximated to the potential of the wire 1106. Then, the fourth transistor 1105 has a lower level of the gate-source voltage, and the potential of the node 1108 is approximated to the potential of the wire 1107. Accordingly, a potential outputted from the output terminal of the differential amplifier circuit 1101 becomes low.

Then, the transistor 101 has a lower gate potential; thus, the transistor 101 has a lower level of the gate-source voltage. That is, the amount of the current flowing to the transistor 101 is decreased. Accordingly, the amount of the current flowing to the current-voltage converting element 103 is decreased; therefore, a voltage drop of the current-voltage converting element 103 is decreased and the potential of the node 109 becomes high.

Thus, a semiconductor device having this configuration operates so that the node 109 has a lower potential when the potential of the node 109 is higher than the potential supplied to the wire 108, and operates so that the node 109 has a higher potential when the potential of the node 109 is lower than the potential supplied to the wire 108. The differential amplifier circuit 1101 operates so that the potential of the node 109 and the potential of the wire 108 are equal to each other. Note that in the case where the first transistor 1102 and the second transistor 1103 have different characteristics, the differential amplifier circuit 1101 operates so that the node 109 and the wire 108 have a predetermined potential difference. That is to say, a semiconductor device described in this embodiment mode is in a negative feedback arrangement.

Subsequently, description is made of a case of applying an operational amplifier to an amplifier circuit of the semiconductor device described in Embodiment Mode 2.

Figure 21:
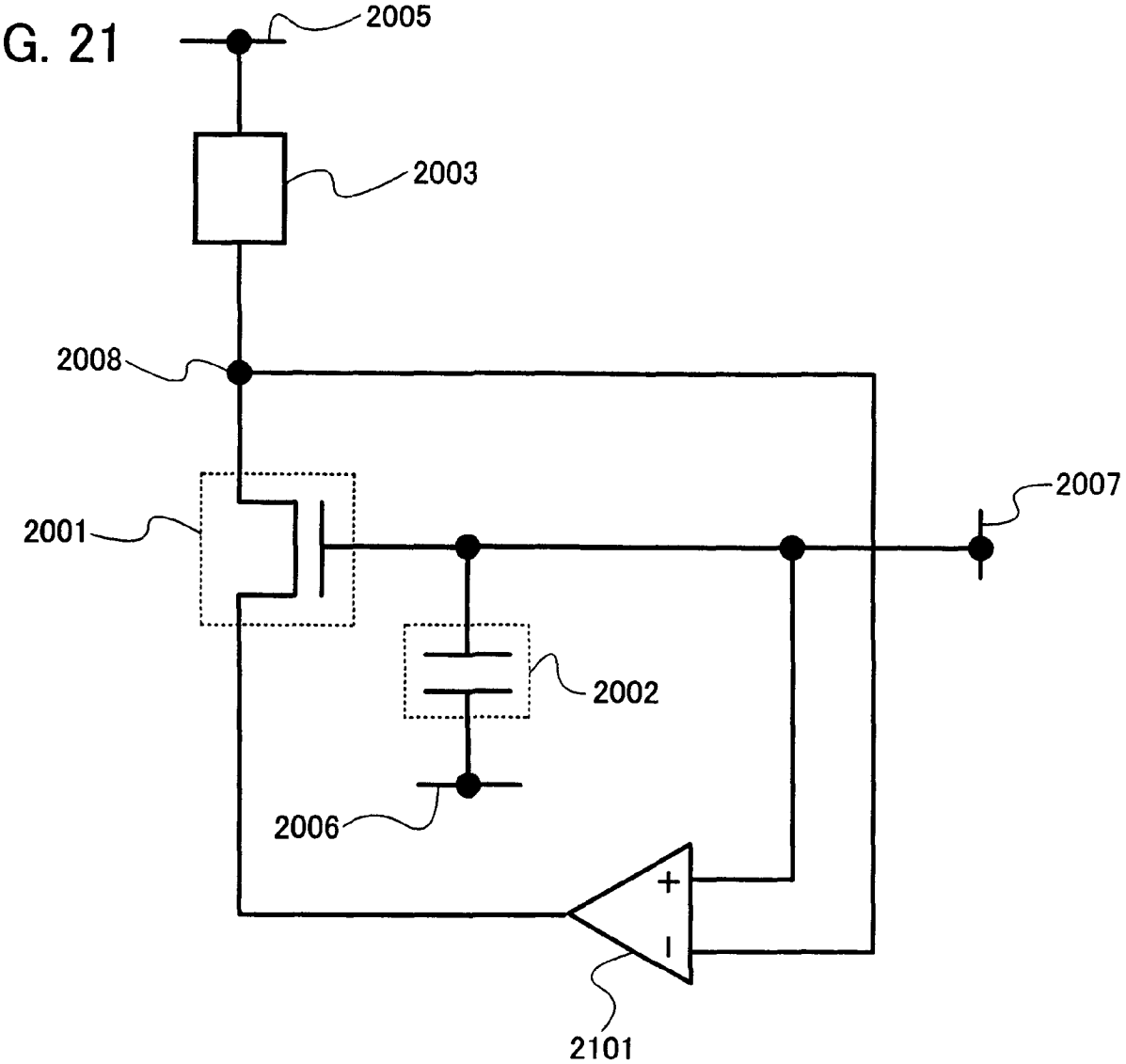
FIG. 21 is a diagram showing a semiconductor device of the invention.

FIG. 21 shows a case of applying an operational amplifier to the amplifier circuit 2004 of the semiconductor device in FIG. 20. That is, an operational amplifier 2101 is used as the amplifier circuit 2004 in FIG. 20. The operational amplifier 2101 has a non-inverting input terminal, an inverting input terminal, and an output terminal. The non-inverting input terminal corresponds to the second input terminal of the amplifier circuit 2004. The inverting input terminal corresponds to the first input terminal of the amplifier circuit 2004. The output terminal corresponds to the output terminal of the amplifier circuit 2004.

Note that a semiconductor device having this configuration operates so that the node 2008 has a lower potential when the potential of the node 2008 is higher than the potential supplied to the wire 2007, and operates so that the node 2008 has a higher potential when the potential of the node 2008 is lower than the potential supplied to the wire 2007. That is to say, a semiconductor device described in this embodiment mode is in a negative feedback arrangement.

Figure 25:
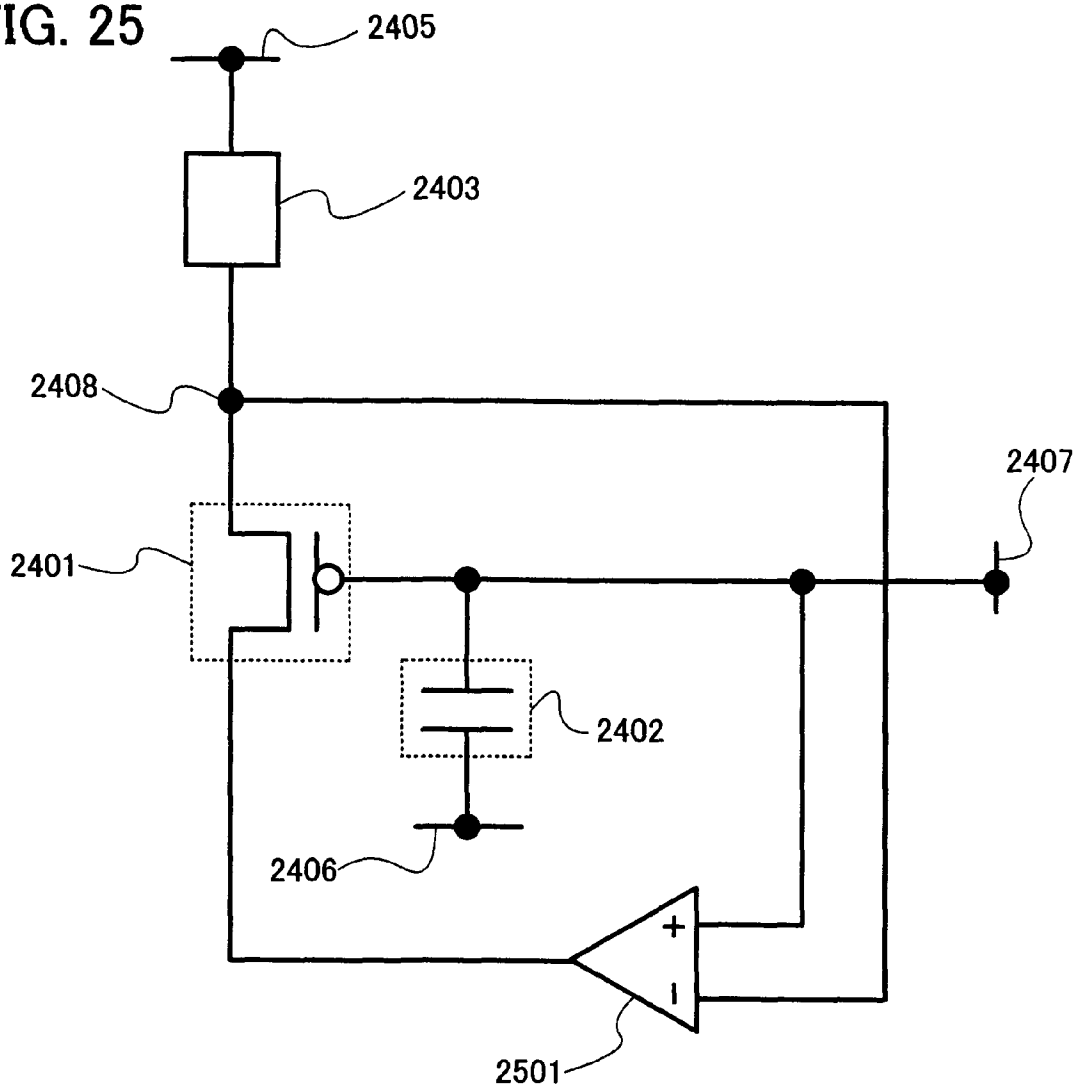
FIG. 25 is a diagram showing a semiconductor device of the invention.

Next, FIG. 25 shows a case of applying an operational amplifier to the amplifier circuit 2404 of the semiconductor device in FIG. 24. That is, an operational amplifier 2501 is used as the amplifier circuit 2404 in FIG. 24. The operational amplifier 2501 has a non-inverting input terminal, an inverting input terminal, and an output terminal. The non-inverting input terminal corresponds to the second input terminal of the amplifier circuit 2404. The inverting input terminal corresponds to the first input terminal of the amplifier circuit 2404. The output terminal corresponds to the output terminal of the amplifier circuit 2404.

Note that a semiconductor device having this configuration operates so that the node 2408 has a lower potential when the potential of the node 2408 is higher than the potential supplied to the wire 2407, and operates so that the node 2408 has a higher potential when the potential of the node 2408 is lower than the potential supplied to the wire 2407. That is to say, a semiconductor device described in this embodiment mode is in a negative feedback arrangement.

Embodiment Mode 4

In this embodiment mode, description is made of a configuration of the semiconductor device described in Embodiment Modes 1 to 3 in the case where a transistor of which a gate-source voltage is set is used as a current source to supply a current to a load.

Figure 5:
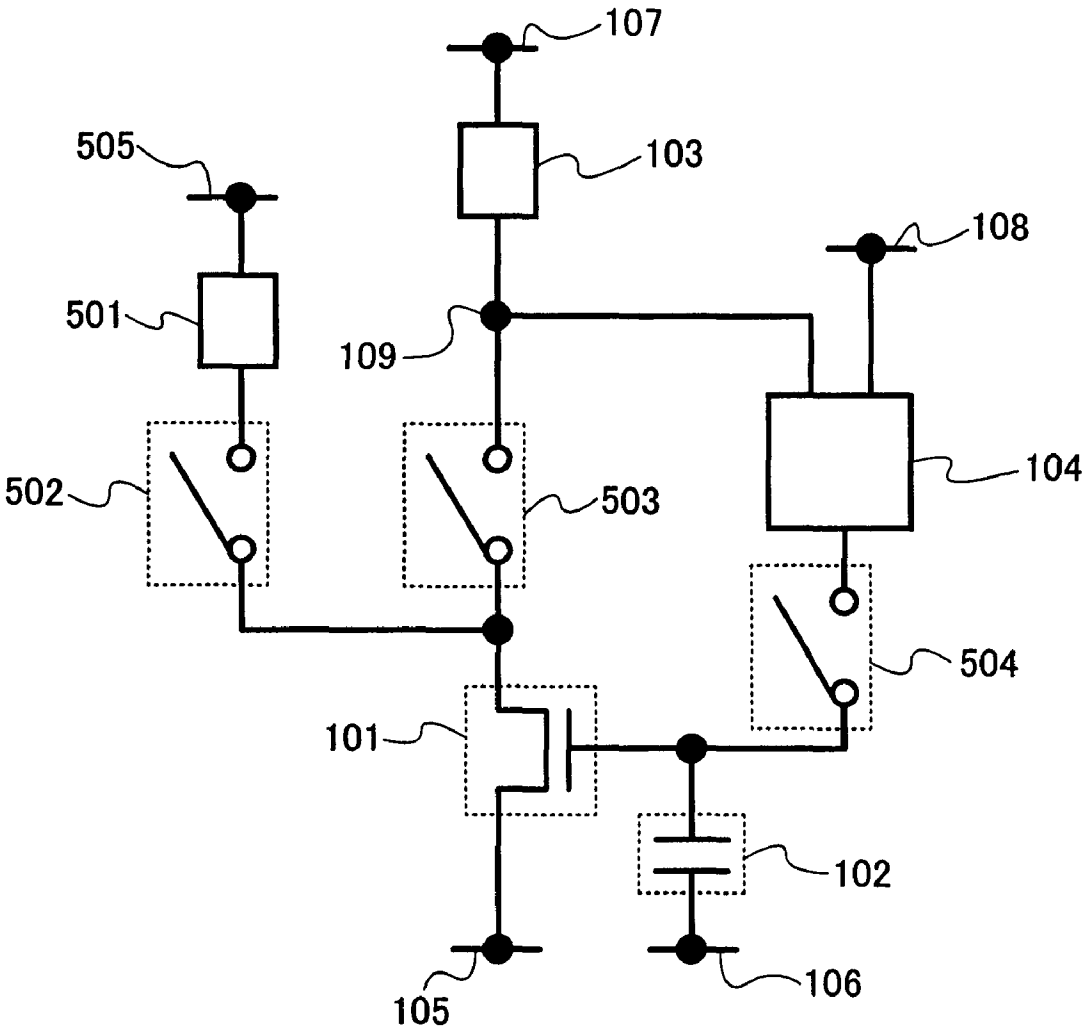
FIG. 5 is a diagram showing a semiconductor device of the invention.

First, FIG. 5 shows a configuration of the semiconductor device using as a current source a transistor of which a gate-source voltage is set to supply a current to a load in the case of using a basic principle of the semiconductor device shown in FIG. 1 of Embodiment Mode 1. Note that common portions to those in FIG. 1 are denoted by the same reference numerals in the configuration in FIG. 5.

The semiconductor device in FIG. 5 can supply a current to a load 501 by using the transistor 101 of which a gate-source voltage is set as a current source. The load 501 is connected between the second terminal of the transistor 101 and a wire 505. A switch 502 is connected between the load 501 and the second terminal of the transistor 101. A switch 503 is connected between the second terminal of the transistor 101 and the node 109. A switch 504 is connected between the output terminal of the amplifier circuit 104 and the gate terminal of the transistor 101. Note that a high power source potential Vdd2 is supplied to the wire 505. As for the high power source potential Vdd2, Vdd2<Vss is satisfied, and it may be equal to or different from the high power source potential Vdd supplied to the wire 107. Therefore, the wire 505 may be the same wire as the wire 107.

Subsequently, an operation of the semiconductor device having this configuration is described with reference to FIGS. 6A and 6B.

Figure 6B:
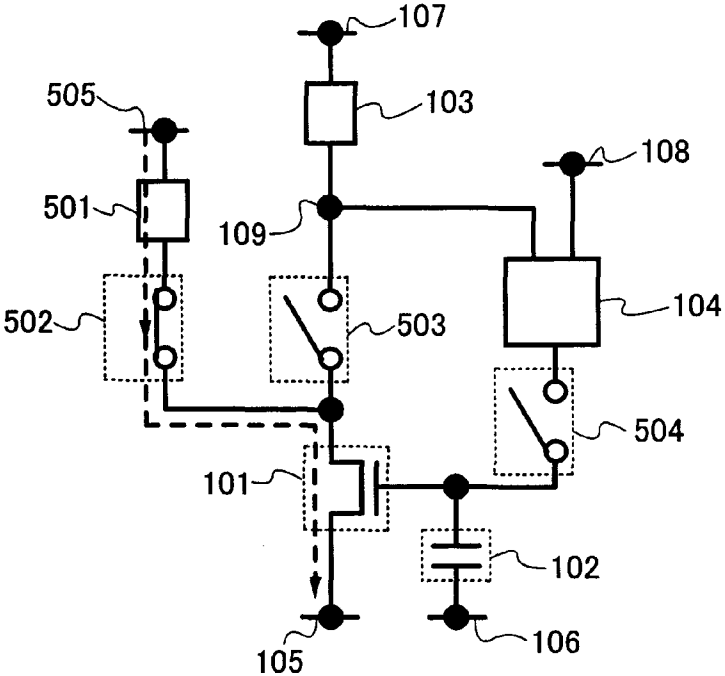
FIGS. 6A and 6B are diagrams each showing an operation of a semiconductor device of the invention.
Figure 6A:
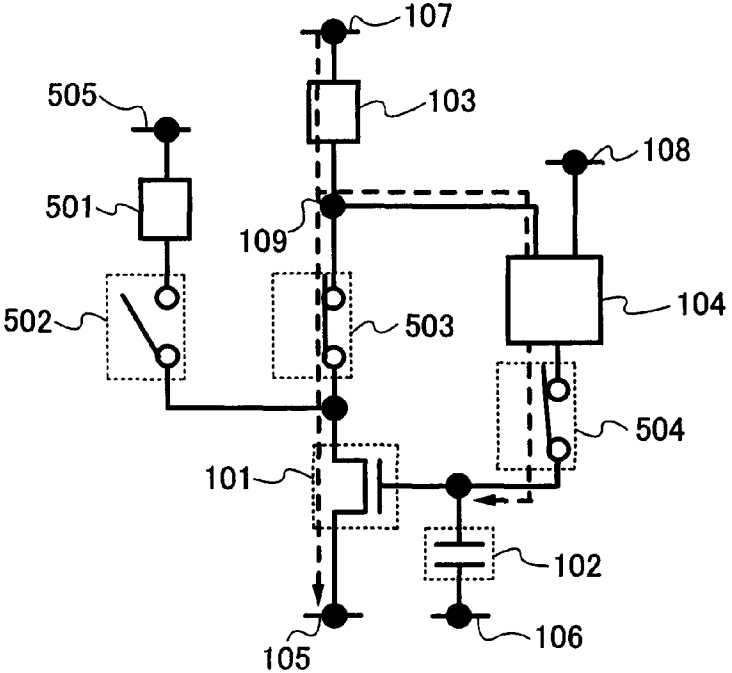

FIG. 6A shows a set operation of the semiconductor device having this configuration. The switches 503 and 504 are turned on and the switch 502 is turned off, thereby a current flows to the current-voltage converting element 103. Then, the potential of the node 109 is inputted to the first input terminal of the amplifier circuit 104, and the amplifier circuit 104 sets the potential of the gate terminal of the transistor 101 so that the first input terminal and the second input terminal have a predetermined potential difference. Thus, the gate-source voltage of the transistor 101 is determined. That is, writing of a signal current is completed. Next, the switches 504 and 503 are turned off. When the switch 504 is in an off state, the gate-source voltage of the transistor 101 can be held in the capacitor 102. Thus, the transistor 101 can be used as a current source.

Further, FIG. 6B shows an output operation of the semiconductor device having this configuration. The switches 503 and 504 are turned off and the switch 502 is turned on, thereby a current set by the transistor 101 can be applied to the load 501.

Figure 66:
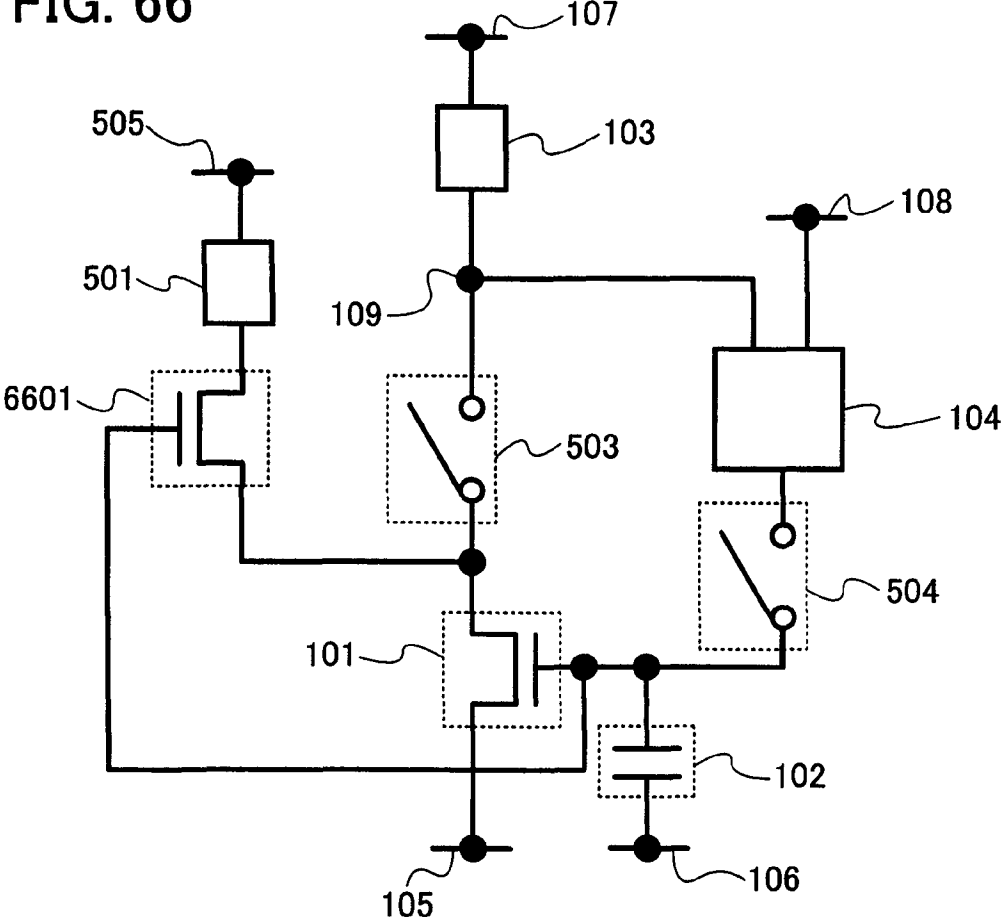
FIG. 66 is a diagram showing a semiconductor device of the invention.

Note that as shown in FIG. 66, a transistor 6601 may be applied to the switch 502 in FIG. 5 to connect a gate terminal of the transistor 6601 and the gate terminal of the transistor 101. Accordingly, the transistor 101 and the transistor 6601 function as multi-gate transistors in an output operation. Therefore, the amount of a current applied to the load 501 in the output operation can be made smaller than a current set in the set operation. That is to say, a gate-source voltage of a transistor can be set by a large amount of current in the set operation.

Figure 14:
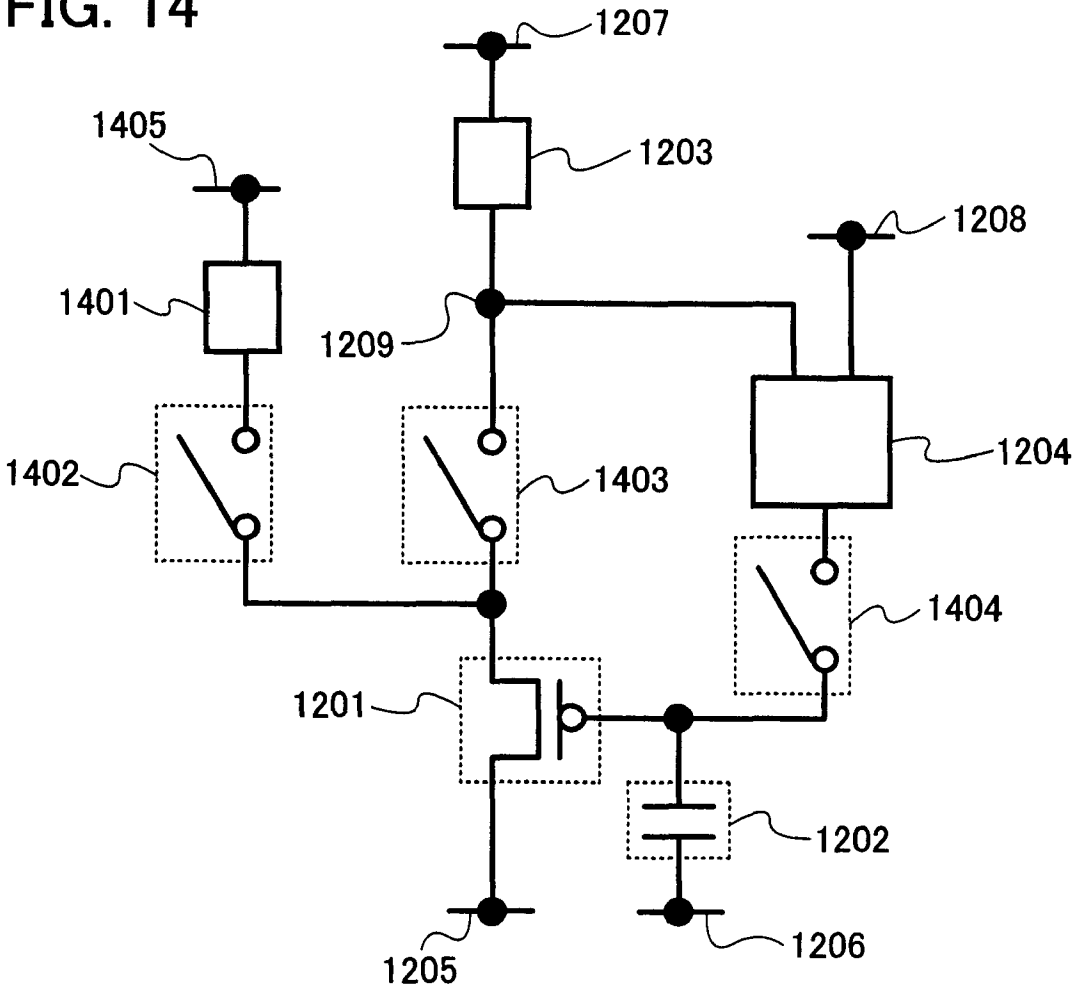
FIG. 14 is a diagram showing a semiconductor device of the invention.

Next, FIG. 14 shows a configuration of the semiconductor device shown in FIG. 12 of Embodiment Mode 1 in the case of using a transistor of which a gate-source voltage is set as a current source to supply a current to a load. Note that common portions to those in FIG. 12 are denoted by the same reference numerals in the configuration in FIG. 14.

The semiconductor device in FIG. 14 can supply a current to a load 1401 by using the transistor 1201 of which a gate-source voltage is set as a current source. The load 1401 is connected between the second terminal of the transistor 1201 and a wire 1405. A switch 1402 is connected between the load 1401 and the second terminal of the transistor 1201. A switch 1403 is connected between the second terminal of the transistor 1201 and the node 1209. A switch 1404 is connected between the output terminal of the amplifier circuit 1204 and the gate terminal of the transistor 1201. Note that a low power source potential Vss2 is supplied to the wire 1405. As for the low power source potential Vss2, Vss2<Vdd is satisfied, and it may be equal to or different from the low power source potential Vss supplied to the wire 1207. Therefore, the wire 1405 may be the same wire as the wire 1207.

Subsequently, an operation of the semiconductor device having this configuration is described with reference to FIGS. 15A and 15B.

Figure 15B:
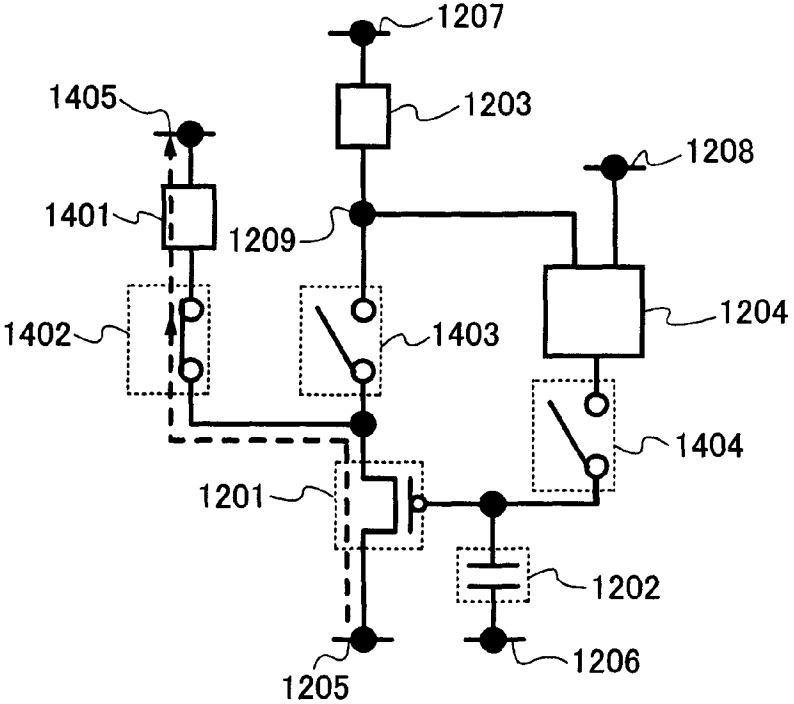
FIGS. 15A and 15B are diagrams each showing an operation of a semiconductor device of the invention.
Figure 15A:
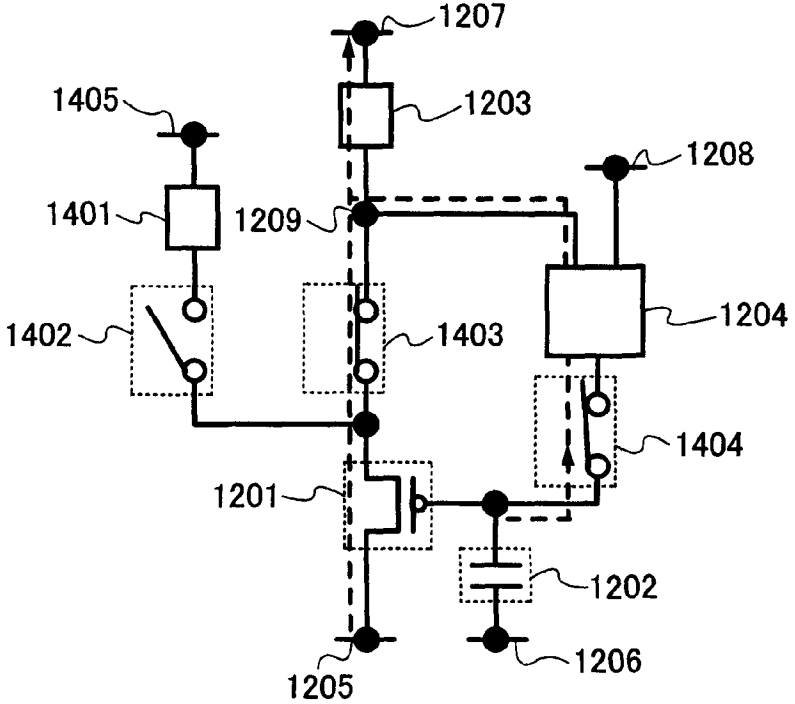

FIG. 15A shows a set operation of the semiconductor device having this configuration. The switches 1403 and 1404 are turned on and the switch 1402 is turned off, thereby a current flows to the current-voltage converting element 1203. Then, the potential of the node 1209 is inputted to the first terminal of the amplifier circuit 1204, and the amplifier circuit 1204 sets the potential of the gate terminal of the transistor 1201 so that the first input terminal and the second input terminal have a predetermined potential difference. Thus, the gate-source voltage of the transistor 1201 is determined. That is, writing of a signal current is completed. Next, the switches 1404 and 1403 are turned off. When the switch 1404 is in an off state, the gate-source voltage of the transistor 1201 can be held in the capacitor 1202. Thus, the transistor 1201 can be used as a current source.

Further, FIG. 15B shows an output operation of the semiconductor device having this configuration. The switches 1403 and 1404 are turned off and the switch 1402 is turned on, thereby a current set by the transistor 1201 can be applied to the load 1401.

Figure 22:
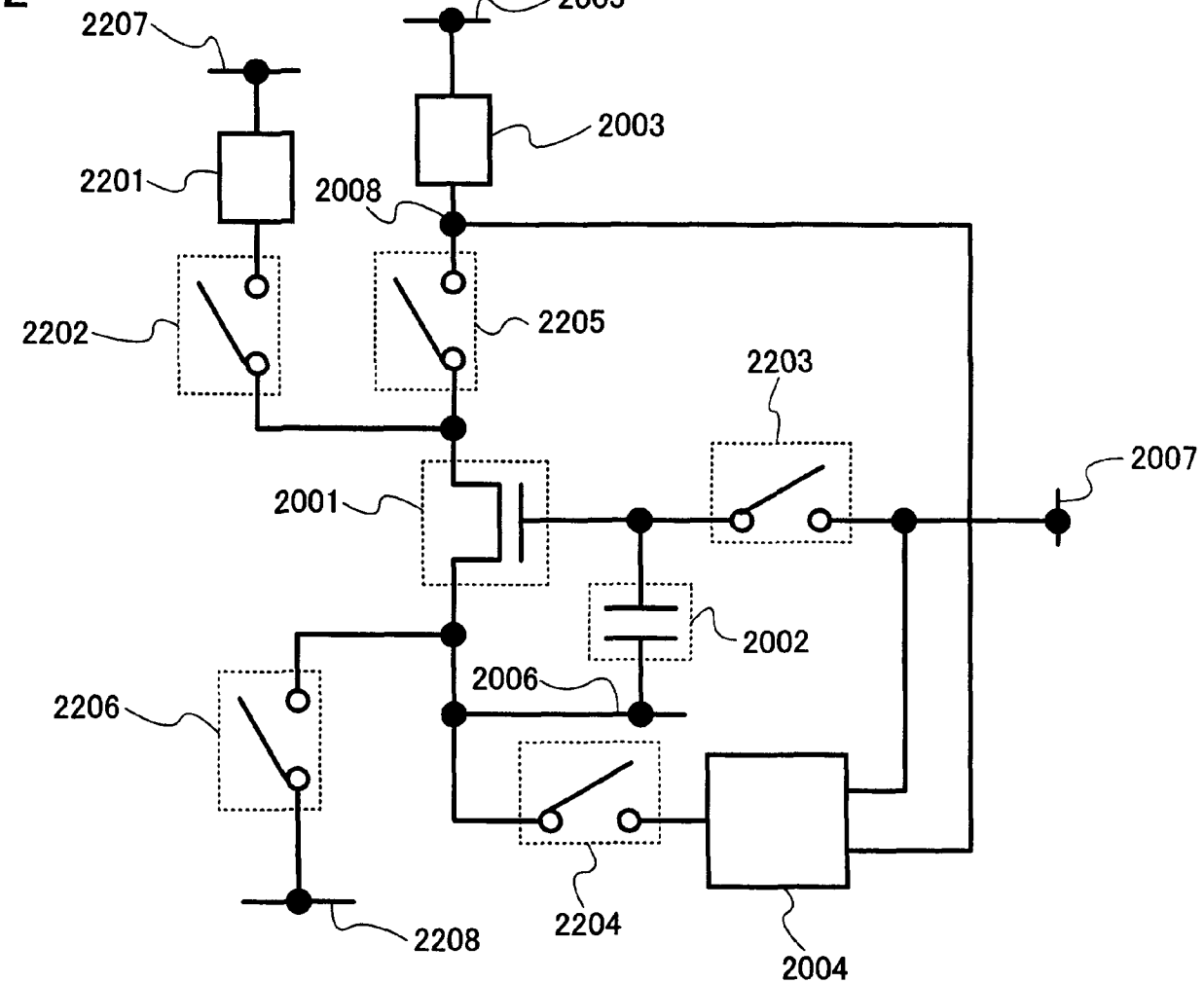
FIG. 22 is a diagram showing a semiconductor device of the invention.

Next, FIG. 22 shows a configuration of the semiconductor device shown in FIG. 20 of Embodiment Mode 2 in the case of using a transistor of which a gate-source voltage is set as a current source to supply a current to a load. Note that common portions to those in FIG. 20 are denoted by the same reference numerals in the configuration in FIG. 22.

The semiconductor device in FIG. 22 can supply a current to a load 2201 by using the transistor 2001 of which a gate-source voltage is set as a current source. The load 2201 is connected between the second terminal of the transistor 2001 and a wire 2207. A switch 2202 is connected between the load 2201 and the second terminal of the transistor 2001. A switch 2205 is connected between the second terminal of the transistor 2001 and the node 2008. A switch 2204 is connected between the output terminal of the amplifier circuit 2004 and the first terminal of the transistor 2001. A switch 2203 is connected between the second input terminal of the amplifier circuit 2004 and the gate terminal of the transistor 2001. The first terminal of the transistor 2001 is connected to a wire 2208 through the switch 2206. Note that a high power source potential Vdd2 is supplied to the wire 2207. As for the high power source potential Vdd2, Vdd2>Vss is satisfied, and it may be equal to or different from the high power source potential Vdd supplied to the wire 2005. Therefore, the wire 2207 may be the same wire as the wire 2005.

Subsequently, an operation of the semiconductor device having this configuration is described with reference to FIGS. 23A and 23B.

Figures 23A, 23B:
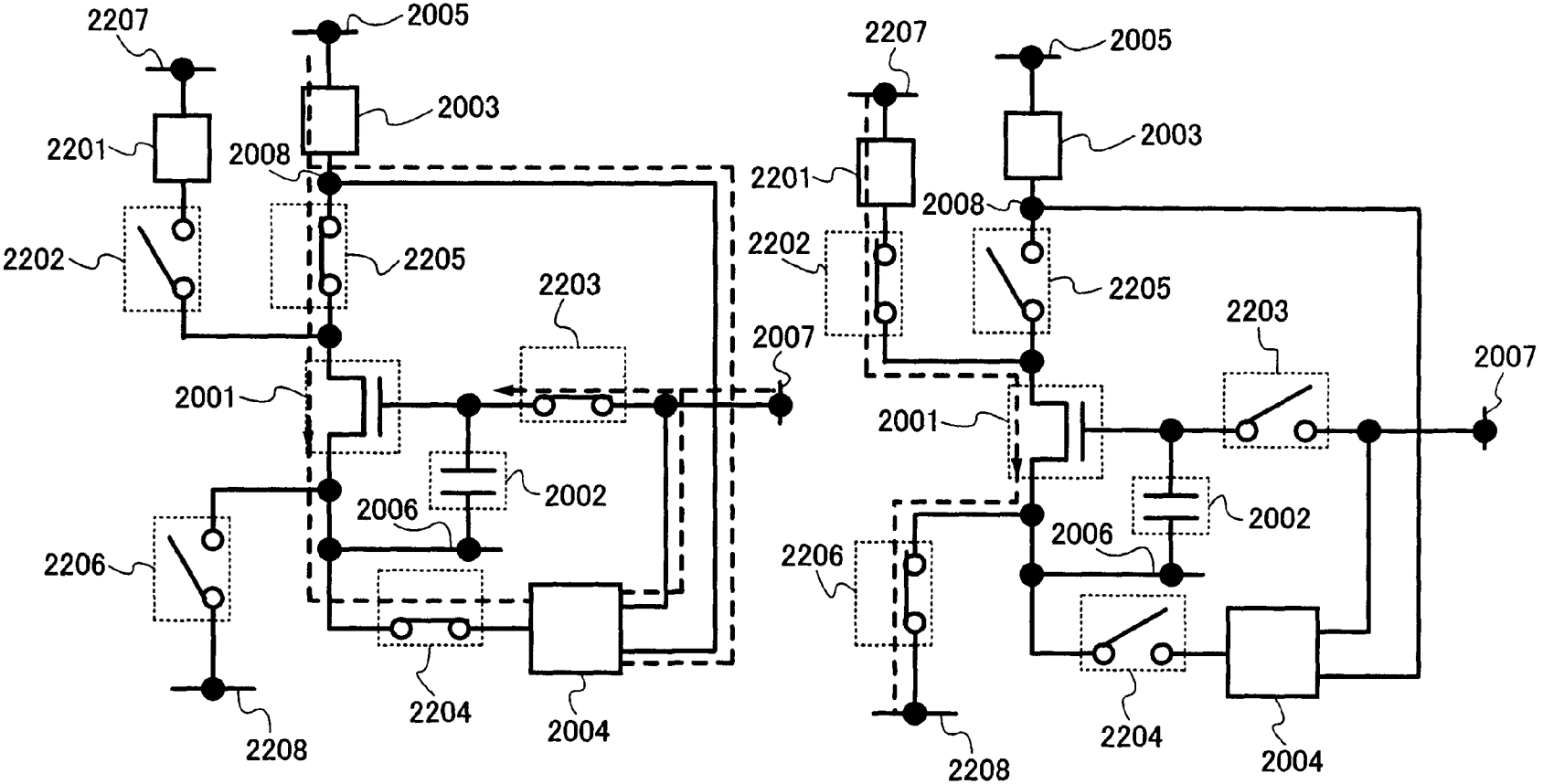
FIGS. 23A and 23B are diagrams each showing an operation of a semiconductor device of the invention.

FIG. 23A shows a set operation of the semiconductor device having this configuration. The switches 2203, 2204, and 2205 are turned on and the switches 2202 and 2206 are turned off, thereby a current flows to the current-voltage converting element 2003. Then, the potential of the node 2008 is inputted to the first input terminal of the amplifier circuit 2004, and the amplifier circuit 2004 sets the potential of the source terminal of the transistor 2001 so that the first input terminal and the second input terminal have a predetermined potential difference. Thus, the gate-source voltage of the transistor 2001 is set. That is, writing of a signal current is completed. Next, FIG. 23B shows an output operation of the semiconductor device having this configuration. The switches 2203, 2204, and 2205 are turned off. When the switch 2203 is in an off state, the gate potential of the transistor 2001 can be held in the capacitor 2002. Thus, the transistor 2001 can be used as a current source. The switches 2202 and 2206 are in an on state, a current set by the transistor 2001 can be applied to the load 2201.

Note that in the case where the wire 2006 is not connected to the source terminal of the transistor 2001, and a certain potential is supplied to the wire 2006, the source potential of the transistor 2001 changes between a set operation (FIG. 23A) and an output operation (FIG. 23B) in some cases. In that case, the gate-source voltage of the transistor 2001 may change as well. When the gate-source voltage of the transistor 2001 changes, a current value flowing though the transistor 2001 changes as well. Therefore, the gate-source voltage of the transistor 2001 is required to be the same between the set operation and the output operation. In order to realize that, for example, the wire 2006 may be connected to the source terminal of the transistor 2001, which results in the same gate-source voltage since a gate potential changes even when the source potential of the transistor 2001 changes.

Alternatively, a potential of the wire 2208 may be controlled so as to be the same as the output potential of the amplifier circuit 2004 in the set operation. For example, the wire 2208 may be connected to a voltage follower circuit or the like to control the potential of the wire 2208.

Figure 28:
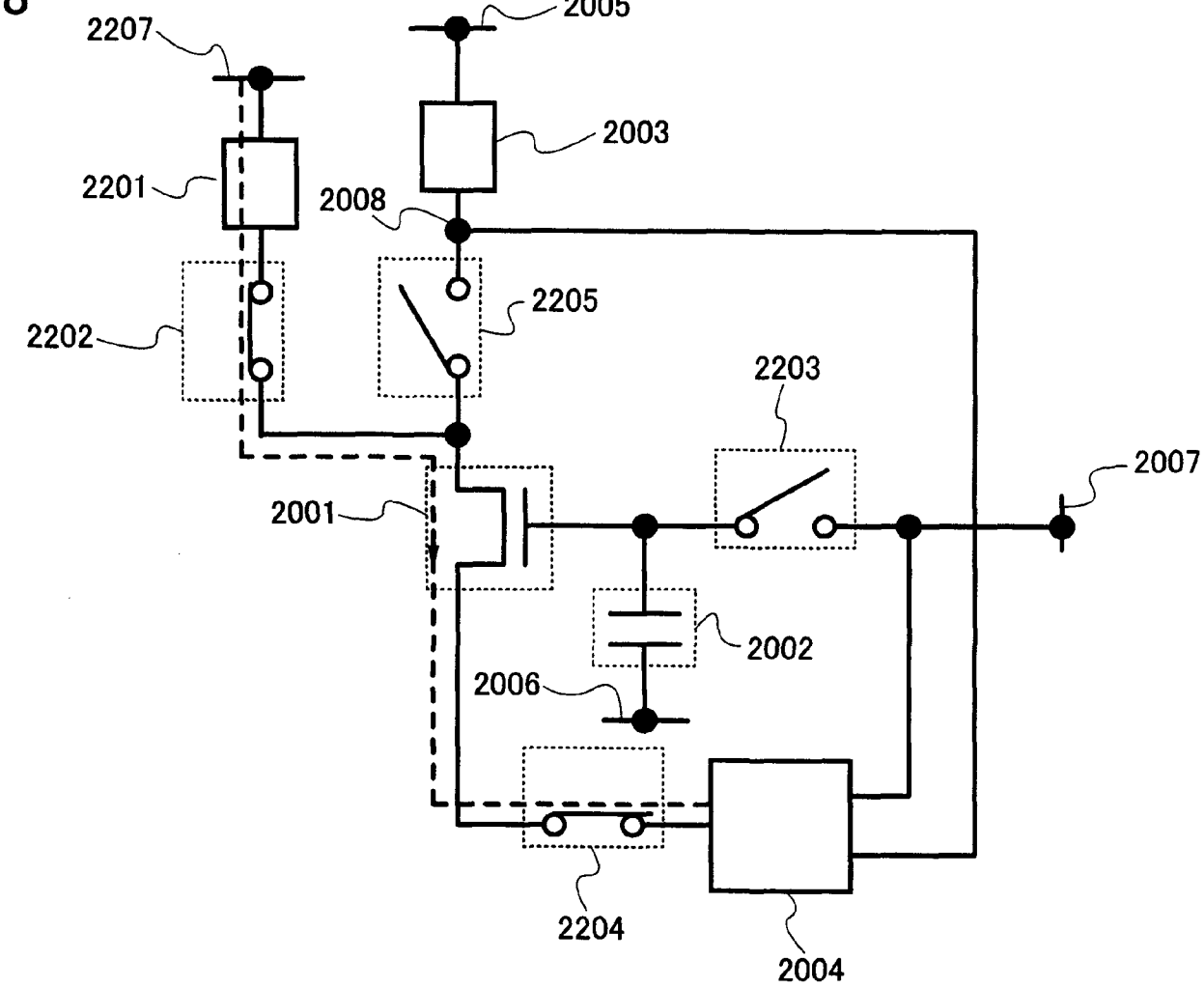
FIG. 28 is a diagram showing an operation of a semiconductor device of the invention.

Alternatively, a current may be supplied from the amplifier circuit 2004 in the output operation as well, as shown in FIG. 28.

Figure 67:
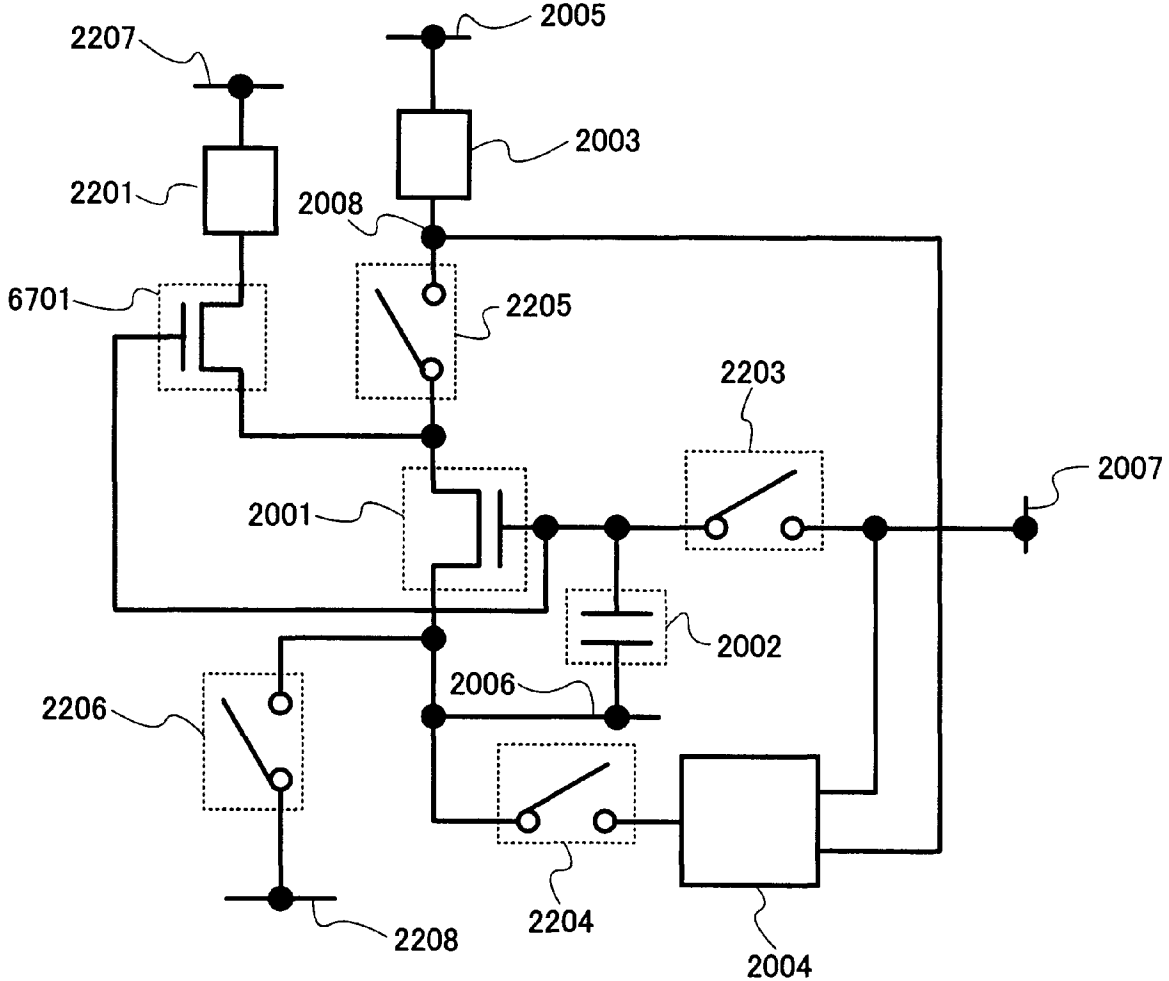
FIG. 67 is a diagram showing a semiconductor device of the invention.

Note that as shown in FIG. 67, a transistor 6701 may be applied to the switch 2202 in FIG. 22 to connect a gate terminal of the transistor 6701 and the gate terminal of the transistor 2001. Accordingly, the transistor 2001 and the transistor 6701 function as multi-gate transistors in an output operation. Therefore, the amount of current applied to the load 2201 in the output operation can be made smaller than that set in the set operation. That is to say, a gate-source voltage of a transistor can be set by a large amount of current in the set operation.

Figure 26:
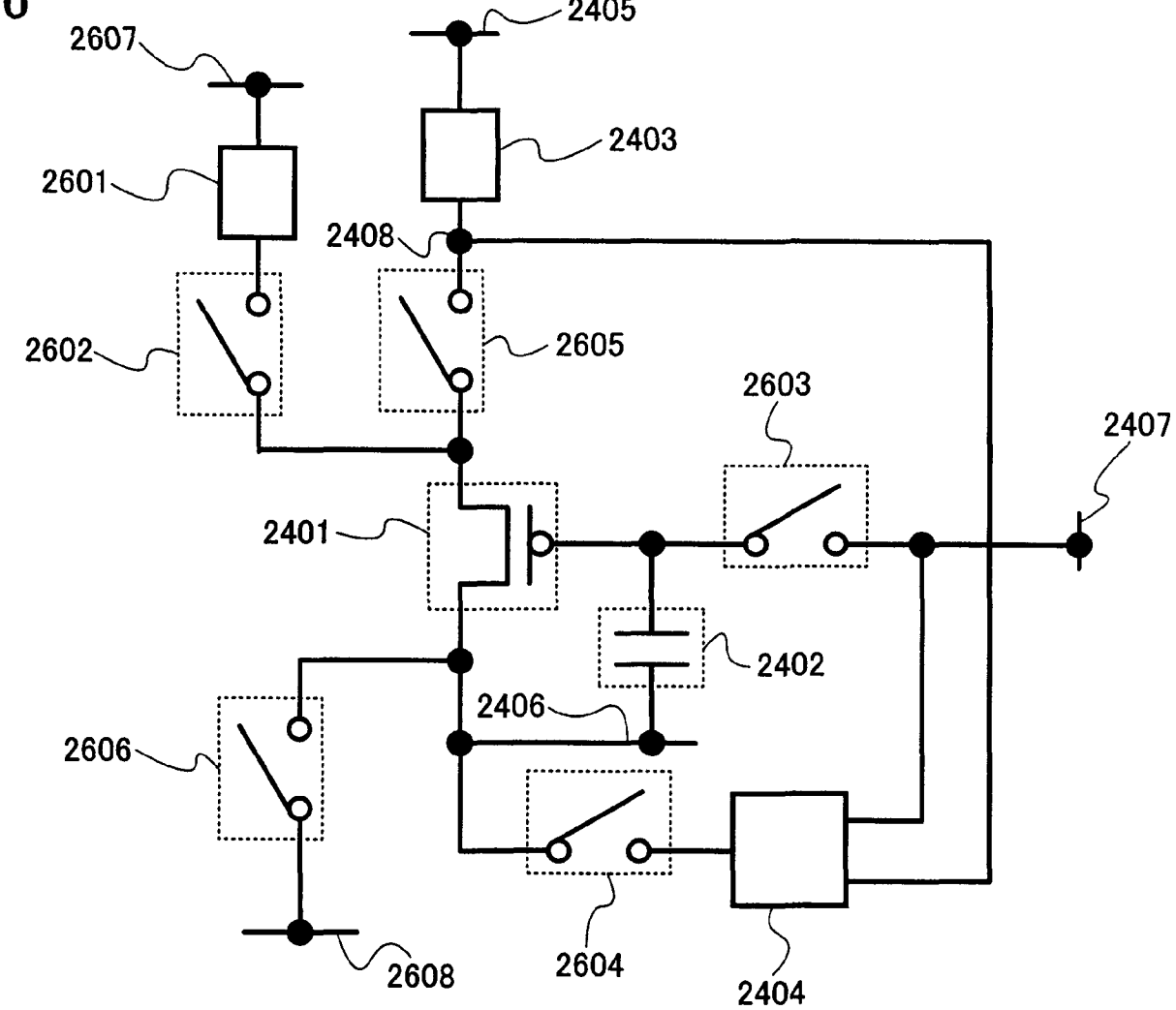
FIG. 26 is a diagram showing a semiconductor device of the invention.

Next, FIG. 26 shows a configuration of the semiconductor device shown in FIG. 24 of Embodiment Mode 2 in the case of using a transistor of which a gate-source voltage is set as a current source to supply a current to a load. Note that common portions to those in FIG. 24 are denoted by the same reference numerals in the configuration in FIG. 26.

The semiconductor device in FIG. 26 can supply a current to a load 2601 by using the transistor 2401 of which a gate-source voltage is set as a current source. The load 2601 is connected between the second terminal of the transistor 2401 and a wire 2607. A switch 2602 is connected between the load 2601 and the second terminal of the transistor 2401. A switch 2605 is connected between the second terminal of the transistor 2401 and the node 2408. A switch 2604 is connected between the output terminal of the amplifier circuit 2404 and the first terminal of the transistor 2401. A switch 2603 is connected between the first input terminal of the amplifier circuit 2404 and the gate terminal of the transistor 2401. The first terminal of the transistor 2401 is connected to the wire 2608 through the switch 2606. Note that a low power source potential Vss2 is supplied to the wire 2607. As for the low power source potential Vss2, Vss2<Vdd is satisfied, and it may be equal to or different from the low power source potential Vss supplied to the wire 2405. Therefore, the wire 2607 may be the same wire as the wire 2405. Note that in this embodiment mode, the wire 2406 is connected to the first terminal (source terminal here) of the transistor 2401.

Subsequently, an operation of the semiconductor device having this configuration is described with reference to FIGS. 27A and 27B.

Figure 27B:
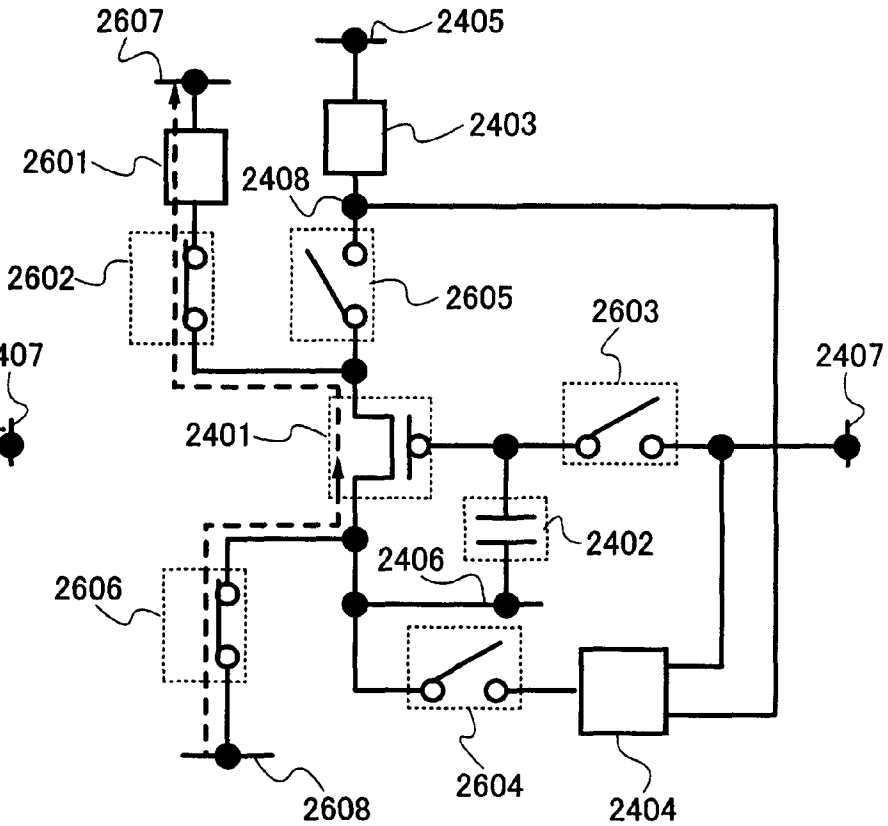
FIGS. 27A and 27B are diagrams each showing an operation of a semiconductor device of the invention.
Figure 27A:
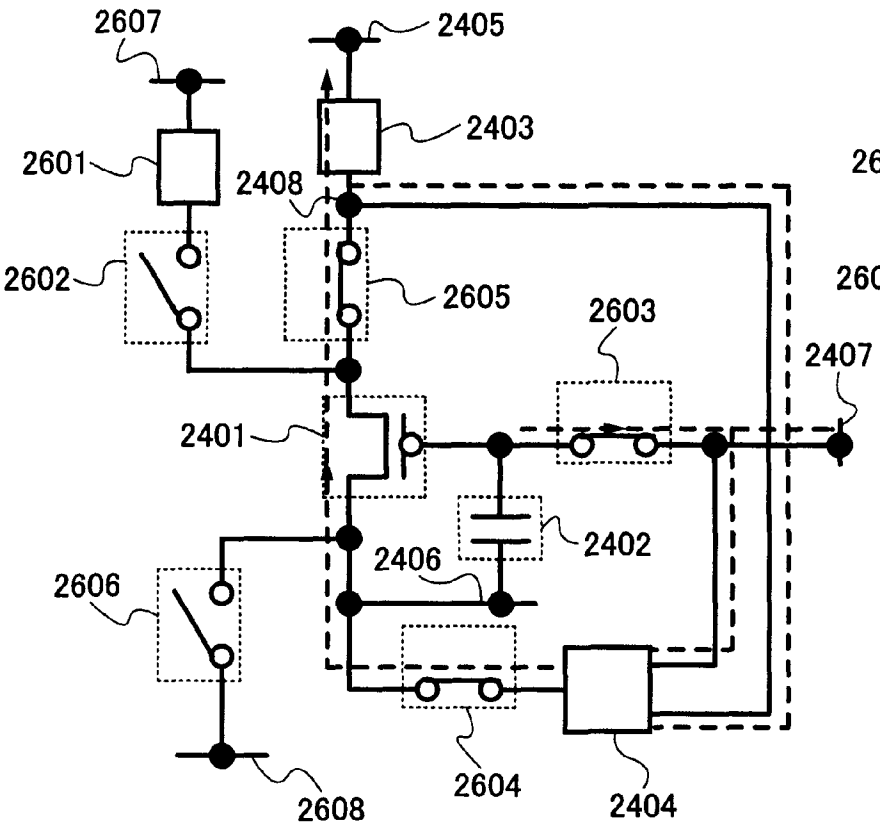

FIG. 27A shows a set operation of the semiconductor device having this configuration. The switches 2605, 2603, and 2604 are turned on and the switches 2602 and 2606 are turned off, thereby a current flows to the current-voltage converting element 2403. Then, the potential of the node 2408 is inputted to the first input terminal of the amplifier circuit 2404, and the amplifier circuit 2404 sets the potential of the source terminal of the transistor 2401 so that the first input terminal and the second input terminal have a predetermined potential difference. Thus, the gate-source voltage of the transistor 2401 is set. That is, writing of a signal current is completed. Next, the switches 2603, 2604, and 2605 are turned off. When the switches 2603 and 2604 are in an off state, the gate-source voltage of the transistor 2401 can be held in the capacitor 2402. Thus, the transistor 2401 can be used as a current source.

Further, FIG. 27B shows an output operation of the semiconductor device having this configuration. The switches 2605, 2604, and 2603 are turned off and the switches 2602 and 2606 are turned on, thereby a current set by the transistor 2401 can be applied to the load 2601.

Embodiment Mode 5

In this embodiment mode, description is made of a semiconductor device which can amplify or damp a current set in a set operation to output in an output operation. That is, a current mirror circuit is used for a semiconductor device of the invention, or a gate length of a transistor which is a current source is changed between a set operation and an output operation.

Figure 59:
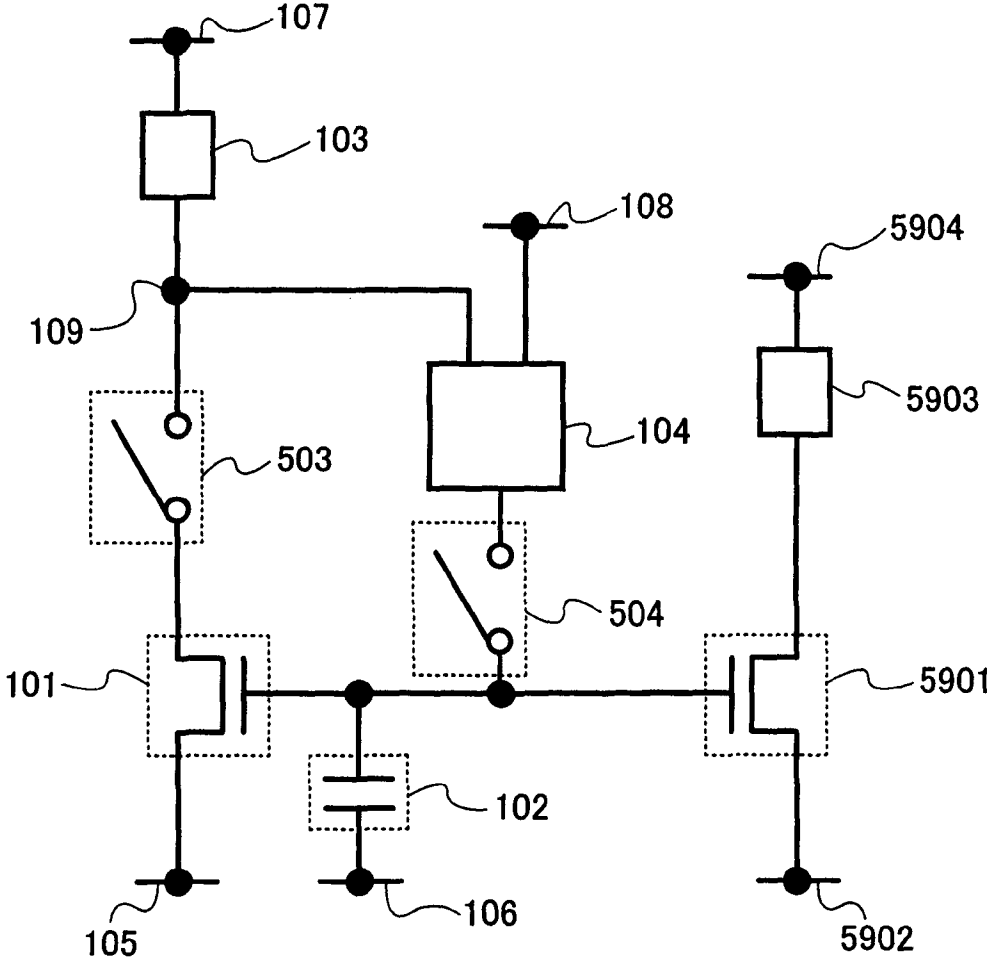
FIG. 59 is a diagram showing a semiconductor device of the invention.

First, FIG. 59 shows a configuration of the semiconductor device using a current mirror circuit in the case of using a basic principle of the semiconductor device shown in FIG. 5 of Embodiment Mode 4. Note that common portions to those in FIG. 5 are denoted by the same reference numerals, and description thereof is omitted.

In FIG. 59, a semiconductor device includes a transistor 5901 connected to the gate terminal of the transistor 101. The transistor 5901 has a first terminal (one of a source terminal and a drain terminal) connected to a wire 5902, a second terminal (the other of the source terminal and the drain terminal) connected to a wire 5904 through a load 5903. Note that the wire 5902 preferably has an approximately equal potential to the wire 105. Accordingly, the transistor 101 and the transistor 5901 have an approximately equal gate-source voltage; therefore, a current flowing through the transistor 5901 can be set easily.

Subsequently, an operation of the semiconductor device in FIG. 59 is described.

The switches 503 and 504 are turned on in a set operation. Then, the amplifier circuit 104 sets the gate potential of the transistor 101 so that the node 109 and the wire 108 have a predetermined potential difference. Thus, the current Idata flowing through the transistor 101 can be set.

In that case, a gate terminal of the transistor 5901 has an approximately equal potential to the gate terminal of the transistor 101. Therefore, when the wire 105 and the wire 5902 have an approximately equal potential, the transistor 101 and the transistor 5901 have an approximately equal gate-source voltage. Thus, when a channel length and a channel width of the transistor 101 are denoted by L1 and W1 respectively, and those of the transistor 5901 are denoted by L2 and W2 respectively, the transistors 101 and 5901 are designed so that (W1/L1)=(W2/L2) is satisfied. Accordingly, the current Idata flows to the transistor 5901 as well.

The switches 503 and 504 are turned off in an output operation. Then, gate potentials of the transistor 101 and the transistor 5901 are held in the capacitor 102. That is, gate-source voltages of the transistor 101 and the transistor 5901 are held in the capacitor 102. Thus, a current set by the transistor 5901 can be applied to the load 5903.

Further, when the transistors 101 and 5901 are designed so that (W1/L1)>(W2/L2) is satisfied, a current flowing through the transistor 101 in the set operation can be smaller than that flowing through the transistor 5901 in the output operation. That is, a current of the transistor 5901 can be set by a larger amount of current than that of a current desired to be applied to the load in the output operation. Therefore, the set operation can be completed rapidly.

Meanwhile, the transistors 101 and 5901 may be designed so that (W1/L1)<(W2/L2) is satisfied. In that case, a larger amount of current than a current flowing through the transistor 101 in the set operation can be applied to the load 5903 in the output operation.

Figure 60:
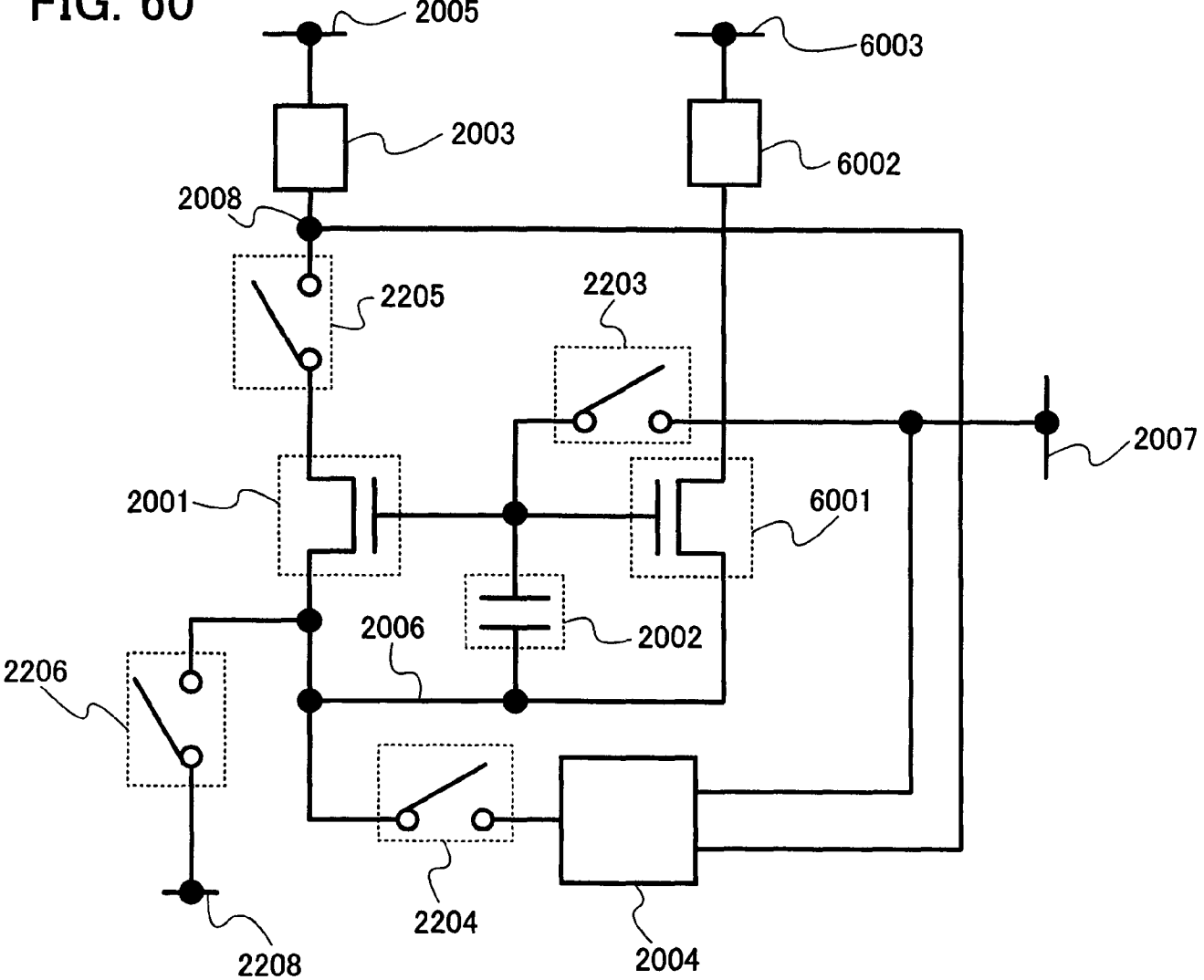
FIG. 60 is a diagram showing a semiconductor device of the invention.

Subsequently, FIG. 60 shows a configuration of the semiconductor device using a current mirror circuit in the case of using a basic principle of the semiconductor device shown in FIG. 22 of Embodiment Mode 4. Note that common portions to those in FIG. 22 are denoted by the same reference numerals, and description thereof is omitted. In FIG. 60, the semiconductor device includes a transistor 6001 connected to the gate terminal of the transistor 2001. The transistor 6001 has a first terminal (one of a source terminal and a drain terminal) connected to the wire 2006 and a second terminal (the other of the source terminal and the drain terminal) connected to a wire 6003 through a load 6002.

Subsequently, an operation of the semiconductor device in FIG. 60 is described.

The switches 2203, 2204, and 2205 are turned on and the switch 2206 is turned off in a set operation, thereby a current flows to the current-voltage converting element 2003. Then, the amplifier circuit 2004 controls the source potential of the transistor 2001 so that the node 2008 and the wire 2007 have a predetermined potential difference. Thus, the current Idata flowing through the transistor 2001 can be set.

In that case, the transistor 2001 and the transistor 6001 have an approximately equal voltage. Thus, when a channel length and a channel width of the transistor 2001 are denoted by L1 and W1 respectively, and those of the transistor 6001 are denoted by L2 and W2 respectively, the transistors 2001 and 6001 are designed so that (W1/L1)=(W2/L2) is satisfied. Accordingly, the current Idata flows to the transistor 6001 as well.

The switches 2203, 2204, and 2205 are turned off and the switch 2206 is turned on in an output operation. Then, gate-source voltages of the transistor 2001 and the transistor 6001 are held in the capacitor 2002. Thus, a current set by the transistor 6001 can be applied to the load 6002.

Further, when the transistors 2001 and 6001 are designed so that (W1/L1)>(W2/L2) is satisfied, a current flowing through the transistor 2001 in the set operation can be smaller than that flowing through the transistor 6001 in the output operation. That is, a current of the transistor 6001 can be set by a larger amount of current than a current desired to be applied to a load in the output operation. Therefore, the set operation can be completed rapidly.

Meanwhile, the transistors 2001 and 6001 may be designed so that (W1/L1)<(W2/L2) is satisfied. In that case, a larger amount of current than a current flowing through the transistor 2001 in the set operation can be applied to the load 6002 in the output operation.

Subsequently, description is made of a configuration where a gate length of a transistor which is a current source is changed between a set operation and an output operation.

Figure 64:
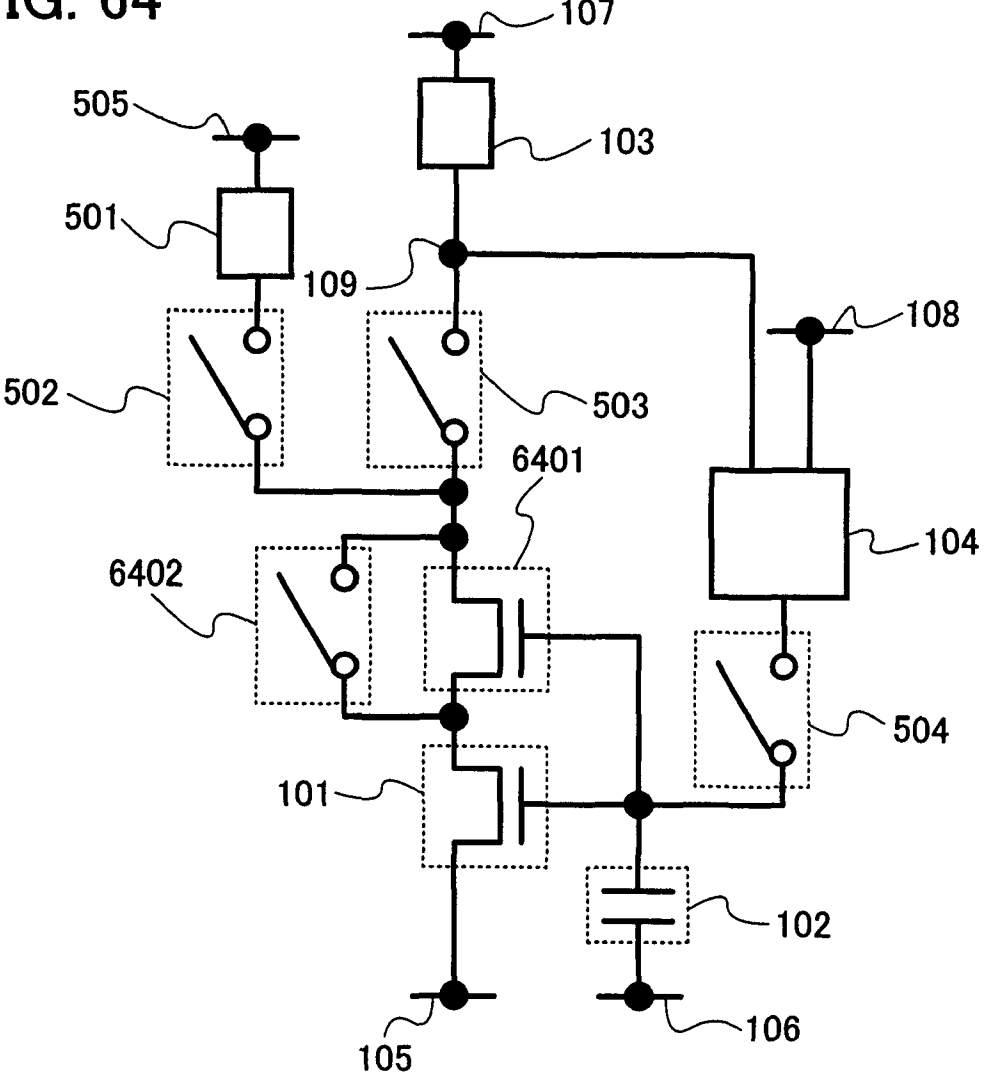
FIG. 64 is a diagram showing a semiconductor device of the invention.

First, FIG. 64 shows a configuration where a transistor which sets a gate-source voltage for applying a desired current in a set operation and a transistor which serves as a current source in an output operation with a gate-source voltage set in the set operation can have different gate lengths, in the case of using a basic principle of the semiconductor device shown in FIG. 5 of Embodiment Mode 4. Note that common portions to those in FIG. 5 are denoted by the same reference numerals, and description thereof is omitted.

A semiconductor device in FIG. 64 includes a transistor 6401 connected to the transistor 101 in series. That is, the transistor 6401 has a first terminal (one of a source terminal and a drain terminal) connected to the second terminal of the transistor 101, a second terminal (the other of the source terminal and the drain terminal) connected to the current-voltage converting element 103 through the switch 503, and a gate terminal connected to the gate terminal of the transistor 101. Further, the first terminal and the second terminal of the transistor 6401 are connected through a switch 6402. That is, when the switch 6402 is turned on, the first terminal and the second terminal of the transistor 6401, that is a source terminal and a drain terminal are short-circuited.

Next, an operation is described. The switches 503, 504, and 6402 are turned on and the switch 502 is turned off in a set operation, thereby a current flows to the current-voltage converting element 103. Then, a current flows to the transistor 101 as well. Note that the source terminal and the drain terminal of the transistor 6401 are short-circuited through the switch 6402, thus, no current flows to the transistor 6401.

The amplifier circuit 2004 controls the gate potential of the transistor 101 so that the node 109 and the wire 108 have a predetermined potential difference. Thus, the current Idata flowing to the transistor 101 can be set.

The switches 503, 504, and 6402 are turned off and the switch 502 is turned on in an output operation, thereby the transistors 101 and 6401 function as multi-gate transistors. Then, a current set by the transistors 101 and 6401 flows to the load 501.

Here, when a channel length of the transistor 101 and a channel length of the transistor 6401 are denoted by L1 and L2 respectively, a channel length of a transistor of which a gate-source voltage is set in a set operation is L1, and a channel length of which serves as a current source in an output operation with a gate-source voltage set in the set operation is L1+L2. A smaller amount of current than a current set in the set operation flows to the load 501 in the output operation. That is, the set operation can be performed by a larger amount of current than that of a current desired to be applied to the load 501 in the output operation.

Note that when the switch 6402 is turned off in the set operation, and on in the output operation, a larger amount of current than that in the set operation can be applied to the load 501.

Figure 65:
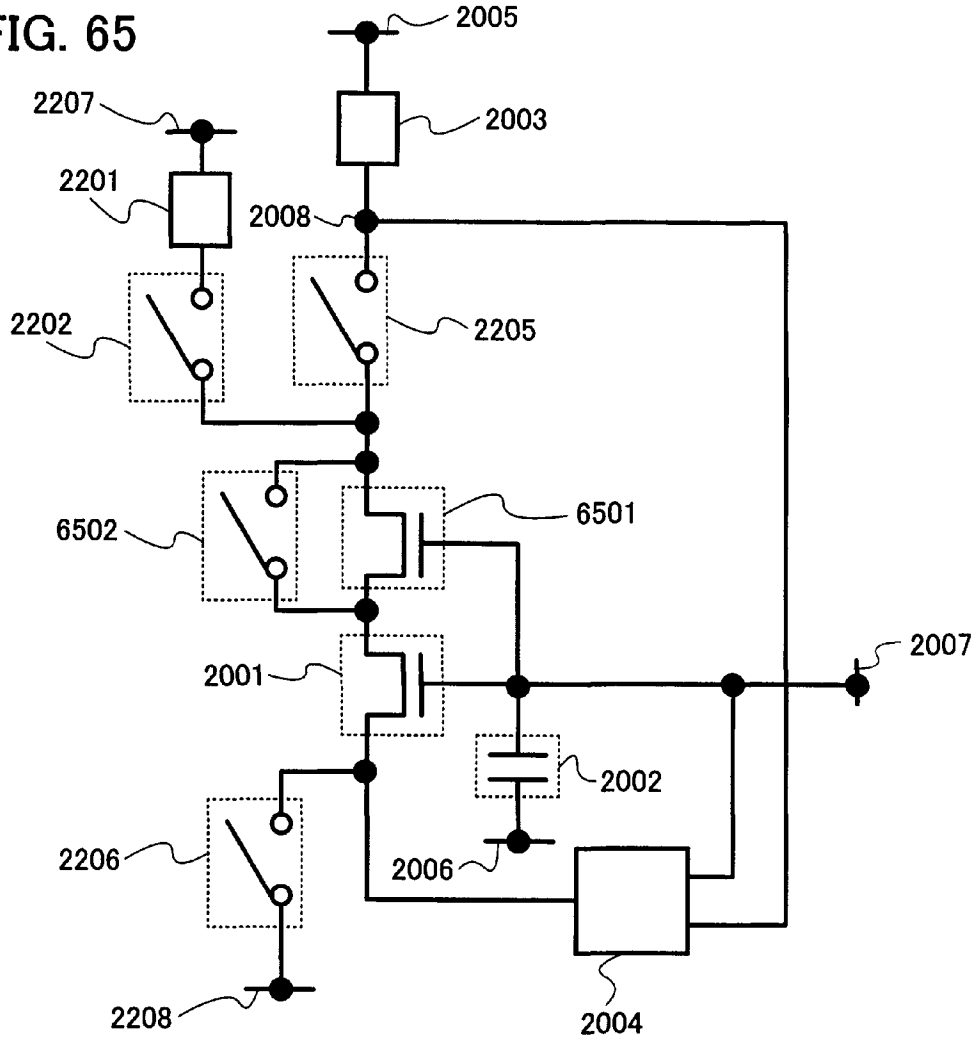
FIG. 65 is a diagram showing a semiconductor device of the invention.

Next, FIG. 65 shows a configuration where a transistor which sets a gate-source voltage for applying a desired current in a set operation and a transistor which serves as a current source in an output operation with a gate-source voltage set in the set operation can have different gate lengths, in the case of using a basic principle of the semiconductor device shown in FIG. 22 of Embodiment Mode 4. Note that common portions to those in FIG. 22 are denoted by the same reference numerals, and description thereof is omitted.

A semiconductor device in FIG. 65 includes a transistor 6501 connected to the transistor 2001 in series. That is, the transistor 6501 has a first terminal (one of a source terminal and a drain terminal) connected to the second terminal of the transistor 2001, a second terminal (the other of the source terminal and the drain terminal) connected to the current-voltage converting element 2003 through the switch 2205, and a gate terminal connected to the gate terminal of the transistor 2001. Further, the first terminal and the second terminal of the transistor 6501 are connected through a switch 6502. That is, when the switch 6502 is turned on, the first terminal and the second terminal of the transistor 6501, that is a source terminal and a drain terminal are short-circuited.

Note that the switch 6502 is turned on in the set operation, and off in the output operation, a smaller amount of current than that of a current set in the set operation flows to the load 2201 in the output operation. That is, the set operation can be performed by a larger amount of current than that of a current desired to be applied to the load 2201 in the output operation. Further, the switch 6502 is turned off in the set operation, and on in the output operation, a larger amount of current than that in the set operation can be applied to the load 2201.

Embodiment Mode 6

In this embodiment mode, description is made of a configuration of the semiconductor device described in Embodiment Mode 3, which includes a circuit for setting a potential to be inputted to one of input terminals of an operational amplifier.

Figure 7:
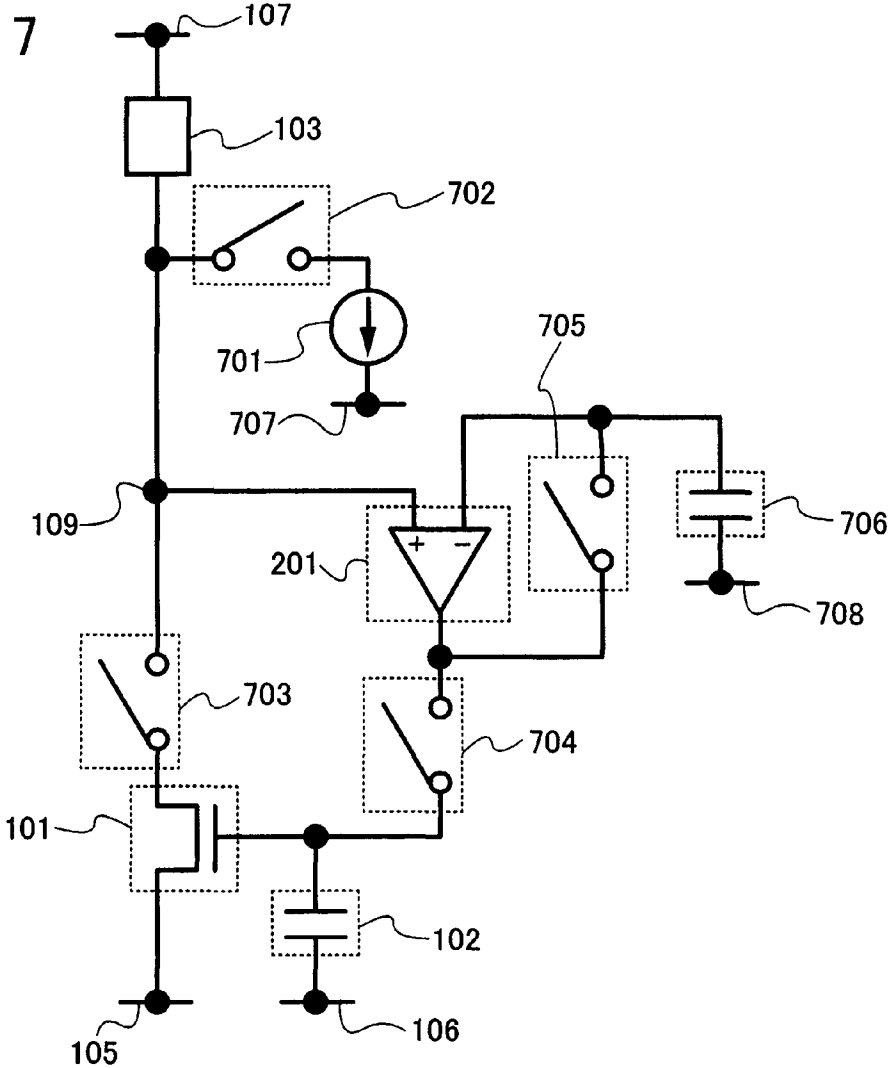
FIG. 7 is a diagram showing a semiconductor device of the invention.

First, FIG. 7 shows a semiconductor device including a circuit for setting a potential to be inputted to an inverting input terminal of the operational amplifier 201 of the semiconductor device shown in FIG. 2 of Embodiment Mode 1. Note that common portions to those in FIG. 2 are denoted by the same reference numerals, and description thereof is omitted.

In the semiconductor device in FIG. 7, a switch 702 and a current source 701 are connected between a wire 707 and a wire connecting the second terminal of the transistor 101 and the current-voltage converting element 103. A switch 703 is connected between the node 109 and the second terminal of the transistor 101. A switch 704 is connected between the output terminal of the operational amplifier 201 and the gate terminal of the transistor 101. A switch 705 is connected between the output terminal and the inverting input terminal of the operational amplifier 201. Further, the inverting input terminal of the operational amplifier 201 is connected to a wire 708 through a capacitor 706.

Figure 8:
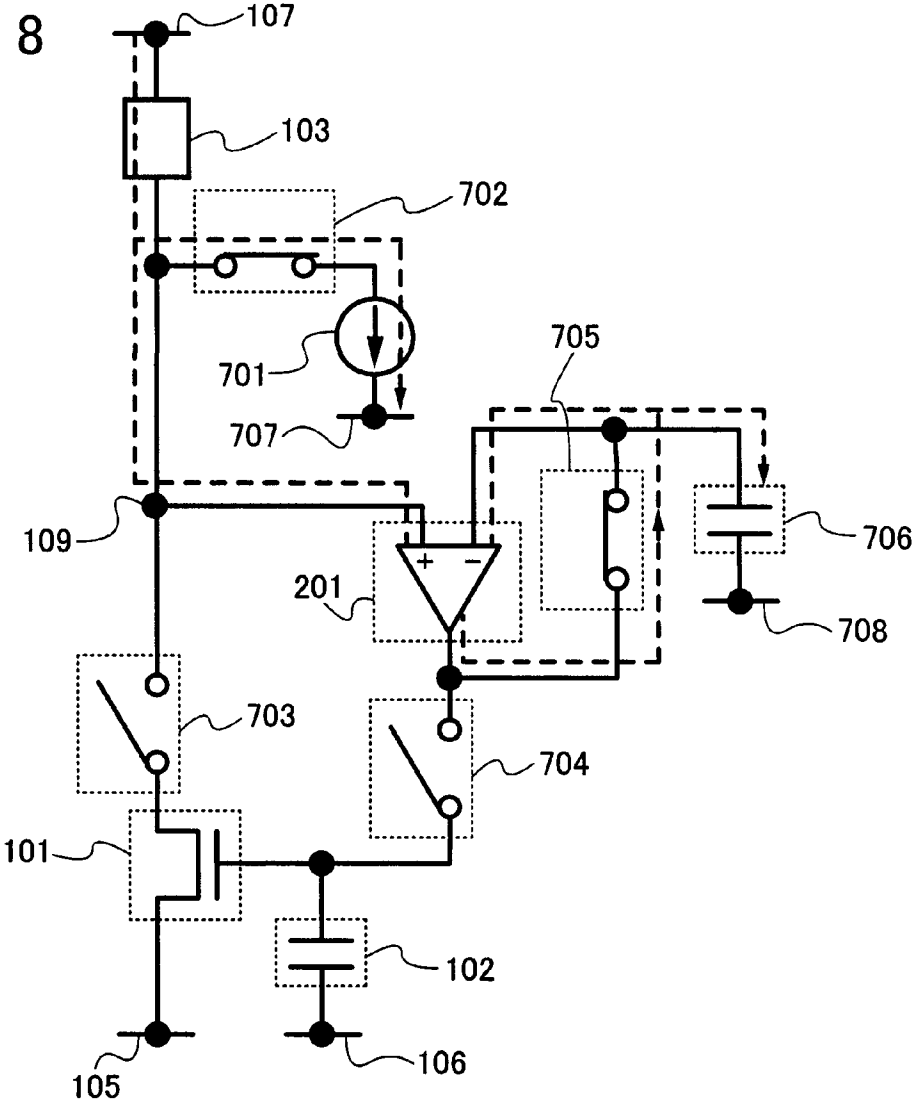
FIG. 8 is a diagram showing an operation of a semiconductor device of the invention.

First, description is made of an operation for setting a potential to be inputted to the inverting input terminal of the operational amplifier. As shown in FIG. 8, the switches 702 and 705 are turned on and the switches 703 and 704 are turned off, thereby the current Idata flowing to a current source 701 flows to the current-voltage converting element 103. Then, the potential of the node 109 at that time is inputted to the non-inverting input terminal of the operational amplifier 201. Note that when the switch 705 is turned on, the non-inverting input terminal and the output terminal of the operational amplifier 201 are connected and the operational amplifier 201 functions as a voltage follower. That is, the operational amplifier 201 outputs an approximately equal potential to that inputted to the non-inverting input terminal. Then, a charge for the potential is stored in the capacitor 706.

Figure 9:
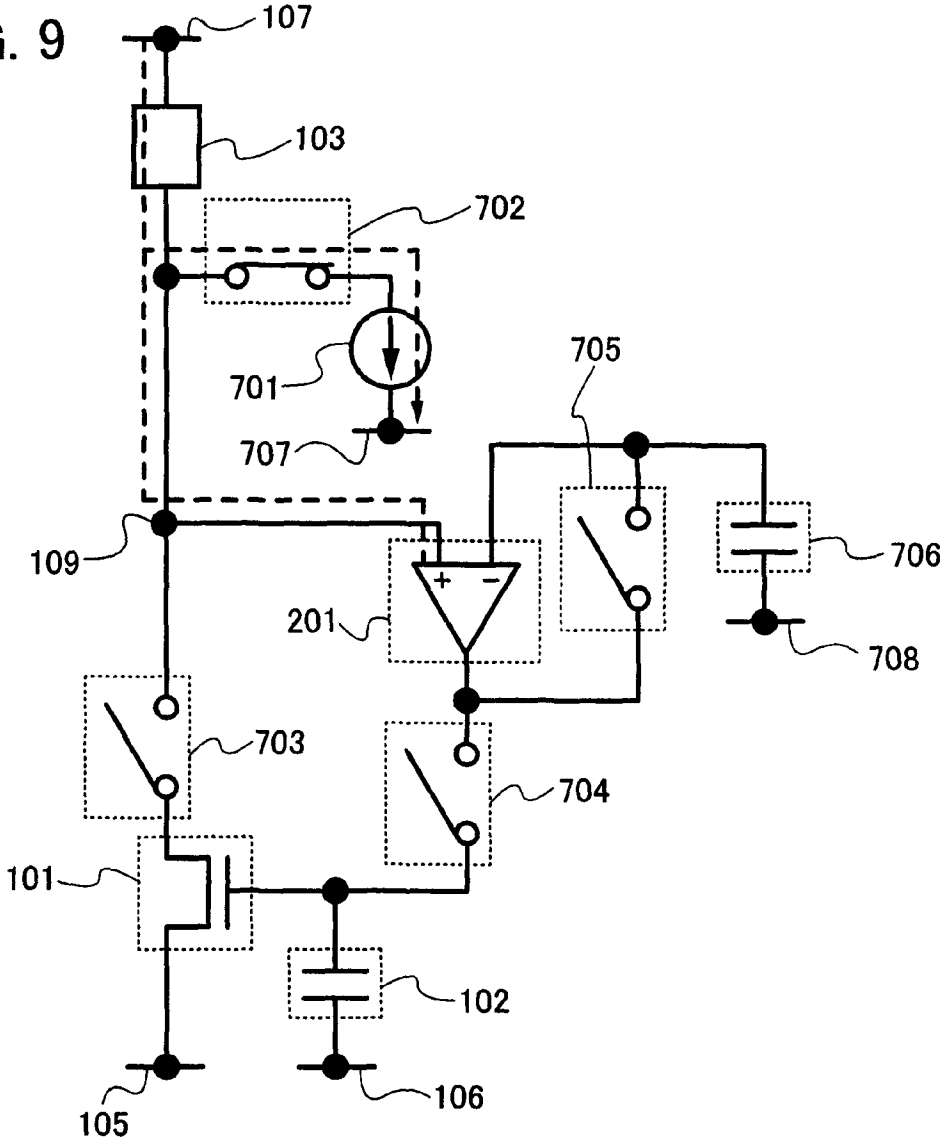
FIG. 9 is a diagram showing an operation of a semiconductor device of the invention.

As shown in FIG. 9, the switch 705 is turned off while the switch 702 is in an on state and the switches 703 and 704 are in an off state, thereby the capacitor 706 holds an approximately equal potential to that of the node 109. That is, a potential of the node 109 can keep to be inputted to the inverting input terminal of the operational amplifier 201.

Figure 10:
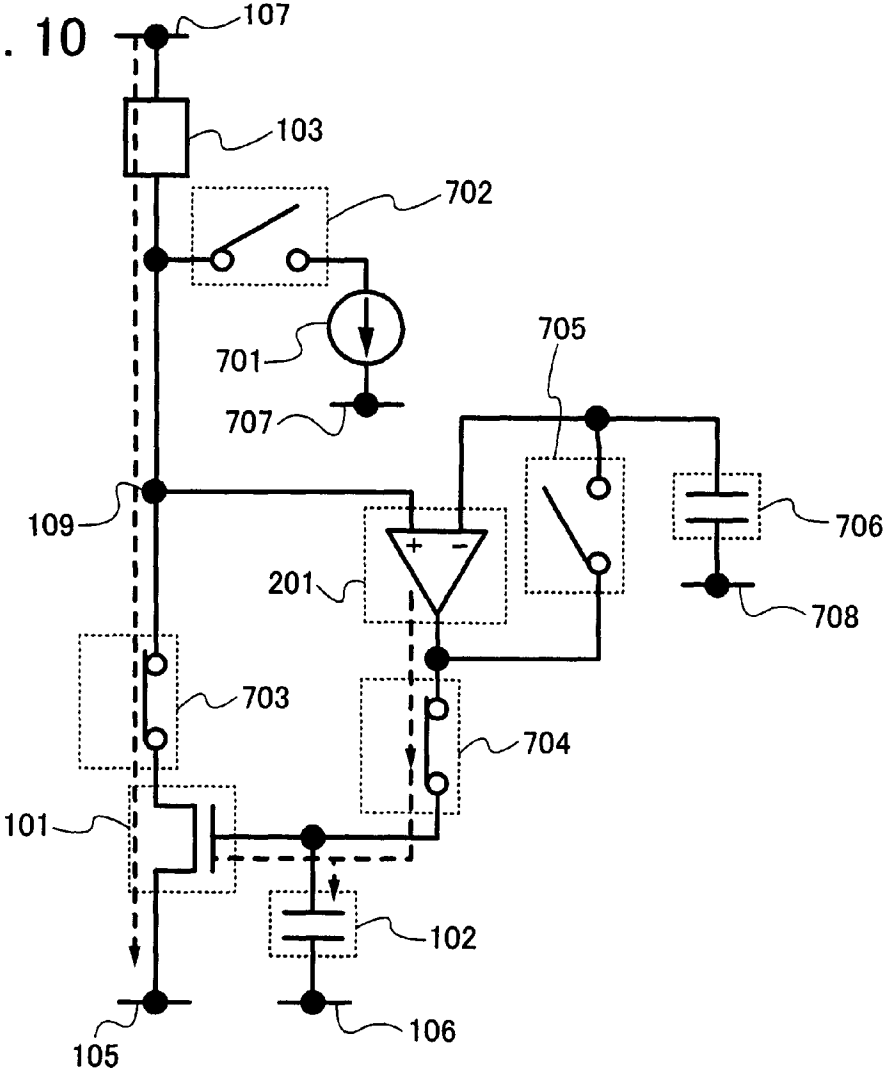
FIG. 10 is a diagram showing an operation of a semiconductor device of the invention.

Next, description is made of a set operation for setting a gate-source voltage of the transistor 101. As shown in FIG. 10, the switches 702 and 705 are turned off and the switches 703 and 704 are turned on, thereby a voltage is outputted from the operational amplifier 201 so that a potential of the node 109 and a potential to be inputted to the inverting input terminal have a predetermined difference. Accordingly, an approximately equal current to the current Idata flowing to the current source 701 flows to the transistor 101. That is, the transistor 101 has a gate-source voltage enough to apply the current Idata. Thus, when the switch 704 is turned off, a gate-source voltage of the transistor 101 can be held, and the set operation is completed.

Figure 16:
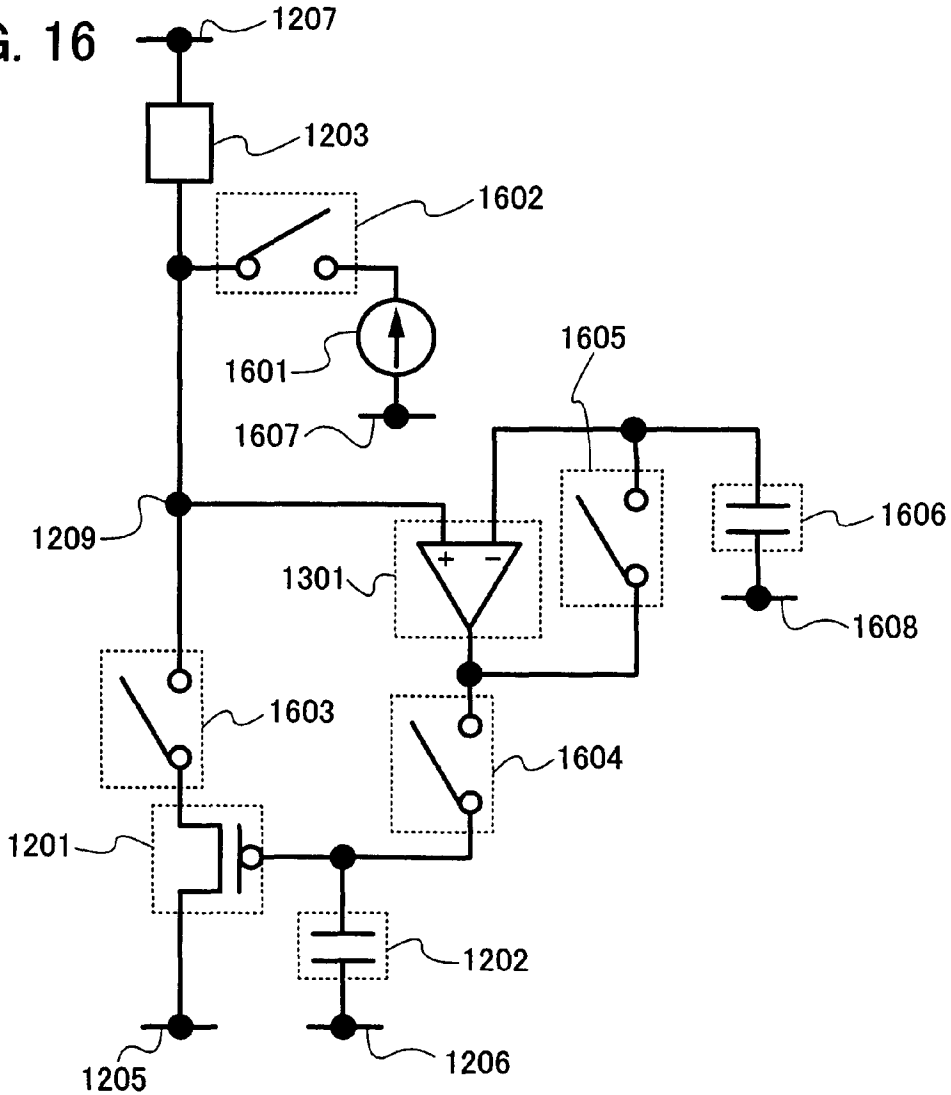
FIG. 16 is a diagram showing a semiconductor device of the invention.

Next, FIG. 16 shows a configuration of the semiconductor device shown in FIG. 12 in Embodiment Mode 1, which includes a circuit for setting a potential to be inputted to one of input terminals of an operational amplifier. Note that common portions to those in FIG. 12 are denoted by the same reference numerals in the configuration in FIG. 16.

In the semiconductor device in FIG. 16, a switch 1602 and a current source 1601 are connected between a wire 1607 and a wire connecting the second terminal of the transistor 1201 and the current-voltage converting element 1203. A switch 1603 is connected between the node 1209 and the second terminal of the transistor 1201. A switch 1604 is connected between the output terminal of the operational amplifier 1301 and the gate terminal of the transistor 1201. A switch 1605 is connected between the output terminal and the inverting input terminal of the operational amplifier 1301. Further, the inverting input terminal of the operational amplifier 1301 is connected to a wire 1608 through a capacitor 1606.

Figure 17:
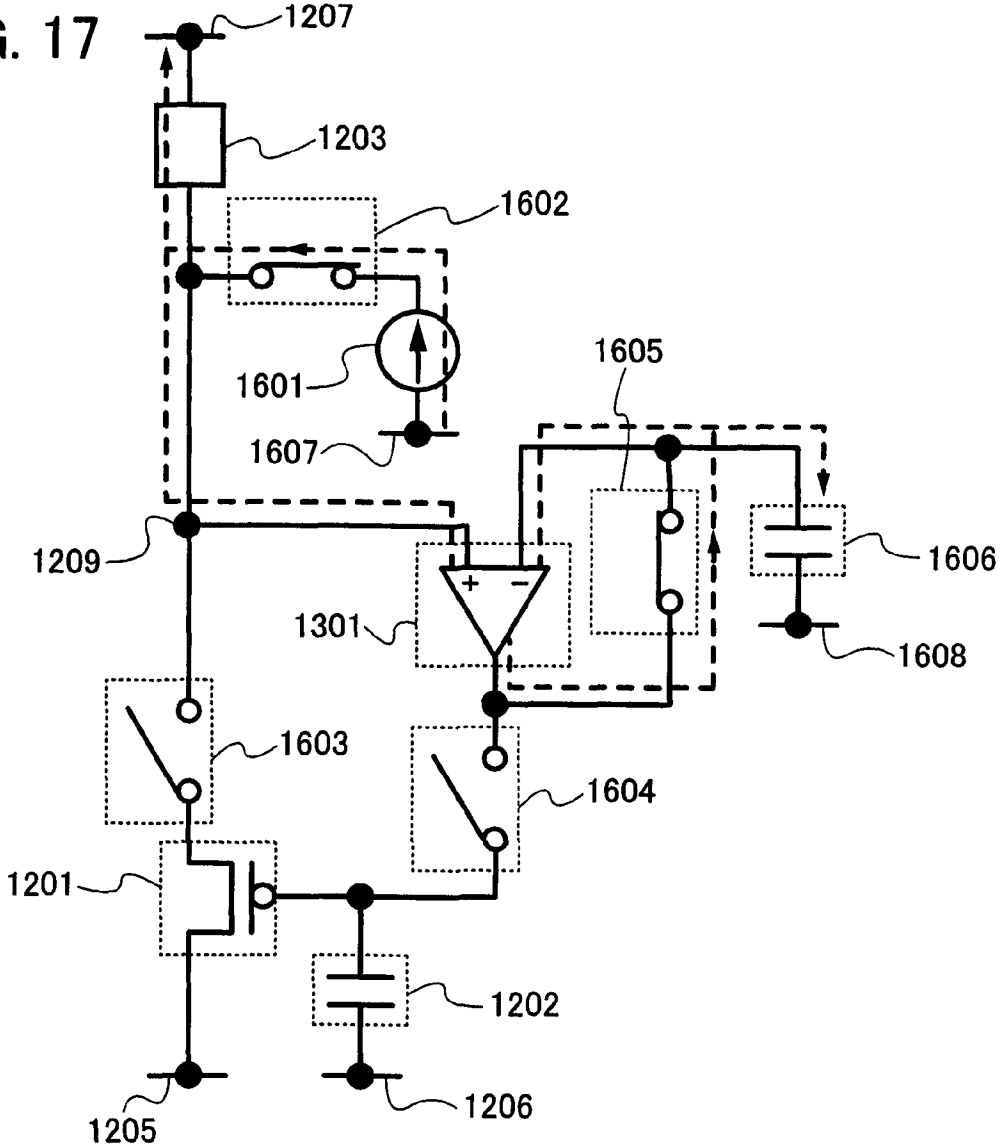
FIG. 17 is a diagram showing an operation of a semiconductor device of the invention.

First, description is made of an operation for setting a potential to be inputted to the inverting input terminal of the operational amplifier. As shown in FIG. 17, the switches 1602 and 1605 are turned on and the switches 1603 and 1604 are turned off, thereby the current Idata flowing to the current source 1601 flows to the current-voltage converting element 1203. Then, the potential of the node 1209 at that time is inputted to the non-inverting input terminal of the operational amplifier 1301. Note that when the switch 1605 is turned on, the non-inverting input terminal and the output terminal of the operational amplifier 1301 are connected and the operational amplifier 1301 functions as a voltage follower. That is, the operational amplifier 1301 outputs an approximately equal potential to that inputted to the non-inverting input terminal. Then, a charge for the potential is stored in the capacitor 1606.

Figure 18:
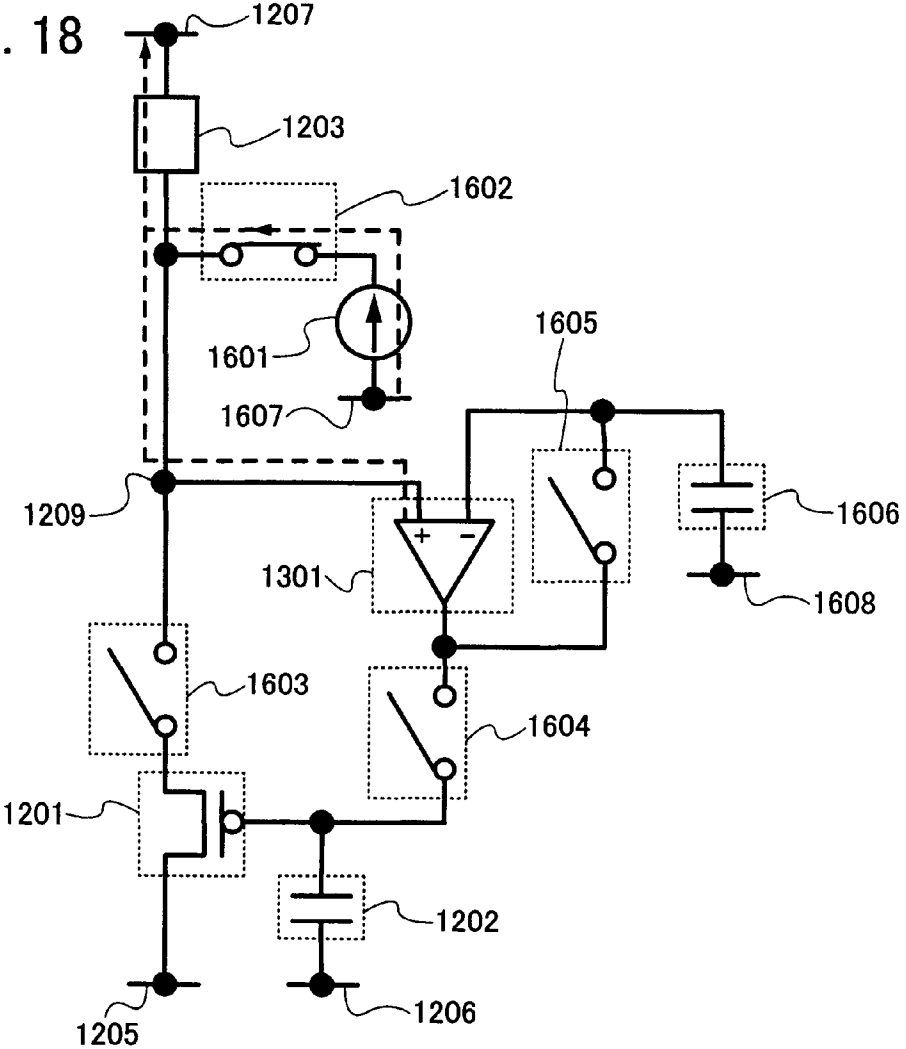
FIG. 18 is a diagram showing an operation of a semiconductor device of the invention.

As shown in FIG. 18, the switch 1605 is turned off while the switch 1602 is in an on state and the switches 1603 and 1604 are in an off state, thereby the capacitor 1606 holds an approximately equal potential to that of the node 1209. That is, a potential of the node 1209 can keep to be inputted to the inverting input terminal of the operational amplifier 1301.

Figure 19:
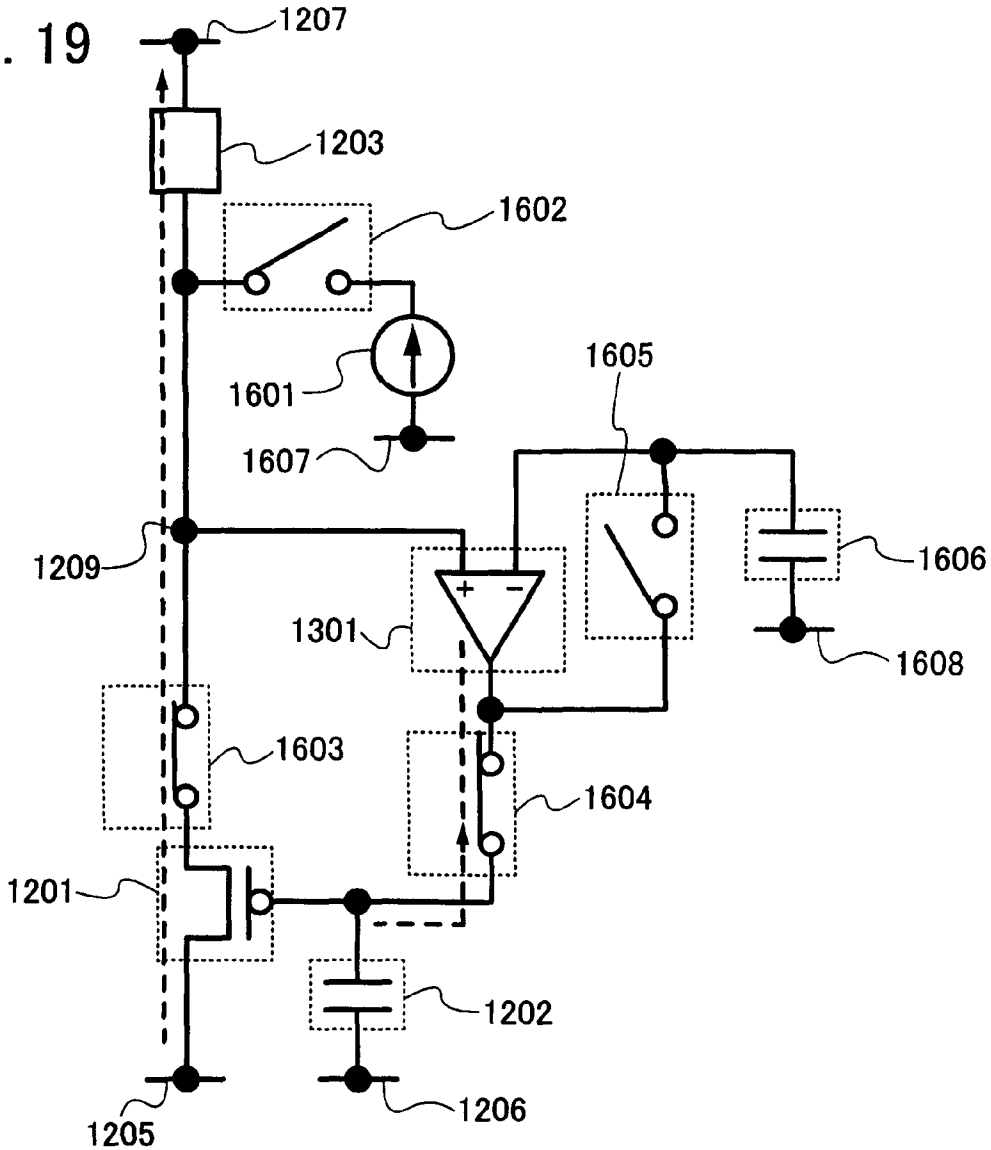
FIG. 19 is a diagram showing an operation of a semiconductor device of the invention.

Next, description is made of a set operation for setting a gate-source voltage of the transistor 1201. As shown in FIG. 19, the switches 1602 and 1605 are turned off and the switches 1603 and 1604 are turned on, thereby a voltage is outputted from the operational amplifier 1301 so that a potential of the node 109 and a potential to be inputted to the inverting input terminal have a predetermined difference. Accordingly, an approximately equal current to the current Idata flowing to the current source 1601 flows to the transistor 1201. That is, the transistor 1201 has a gate-source voltage enough to apply the current Idata. Thus, when the switch 1604 is turned off, a gate-source voltage of the transistor 1201 can be held, and the set operation is completed.

Embodiment Mode 7

The invention can be applied to a display device of which a pixel is formed of a light emitting element capable of controlling light emission luminance by a flowing-current value. Typically, the invention can be applied to an EL element.

Therefore, in this embodiment mode, description is made of a case of applying a configuration of the semiconductor device described in Embodiment Mode 3 to a pixel of a display device.

Figure 29:
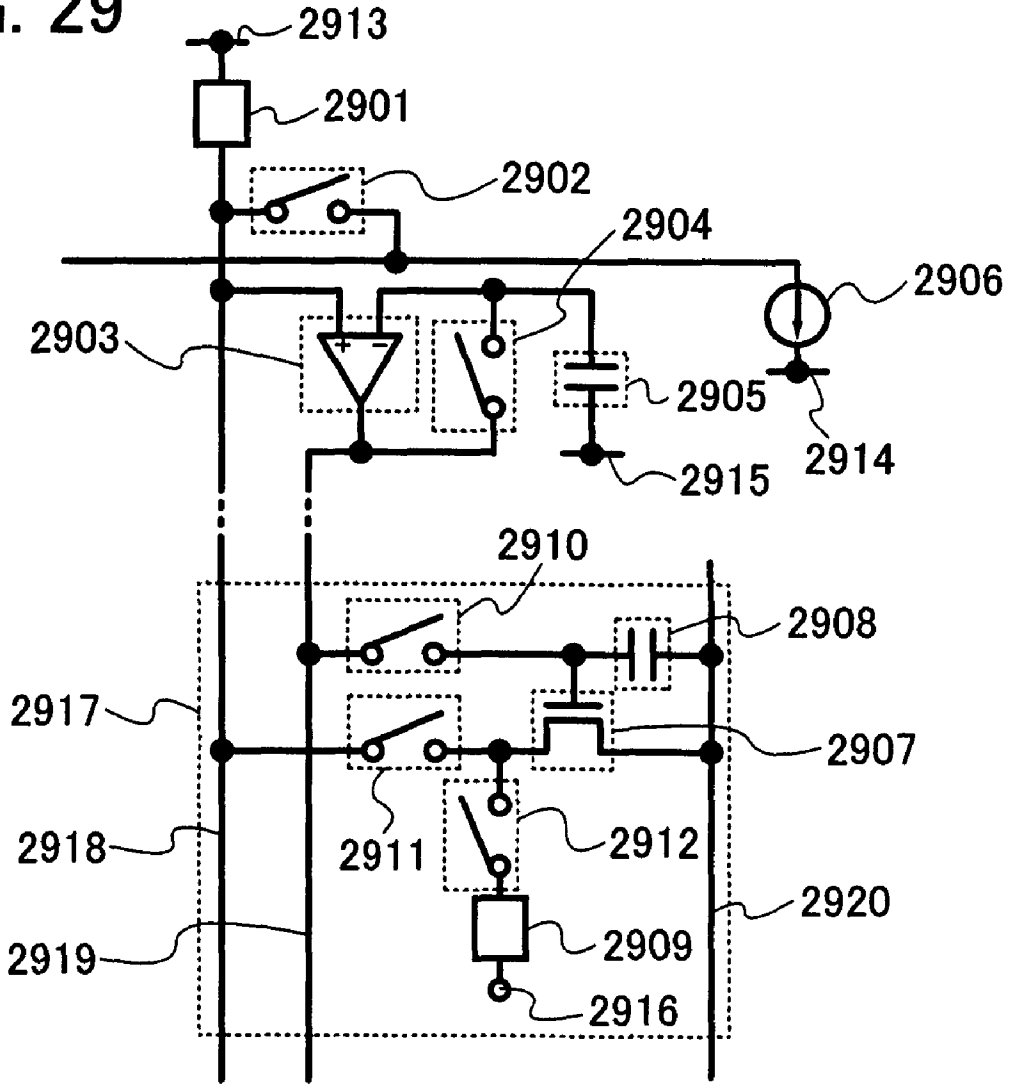
FIG. 29 is a diagram showing a configuration in a case where a semiconductor device of the invention is applied to a part of a pixel and a signal line driver circuit.

First, FIG. 29 shows a case of applying a configuration of the semiconductor device shown in FIG. 2 of Embodiment Mode 3 to a pixel. A pixel 2917 includes a transistor 2907, a capacitor 2908, a light emitting element 2909, switches 2910, 2911, and 2912, a first signal line 2918, a second signal line 2919, and a power source line 2920. Note that a predetermined potential is supplied to a counter electrode 2916 of the light emitting element 2909.

The transistor 2907 has a gate terminal connected to the power source line 2920 through the capacitor 2908, a first terminal (one of a source terminal and a drain terminal) connected to the power source line 2920, and a second terminal (the other of the source terminal and the drain terminal) connected to a pixel electrode of the light emitting element 2909 through the switch 2912. The second terminal of the transistor 2907 is also connected to the first signal line 2918 through the switch 2911. The gate terminal of the transistor 2907 is also connected to the second signal line 2919 through the switch 2910.

Further, the first signal line 2918 is connected to the wire 2913 through the current-voltage converting element 2901, to the wire 2914 through the switch 2902 and the current source 2906, and to a non-inverting input terminal of the operational amplifier 2903. An inverting input terminal of the operational amplifier 2903 is connected to the wire 2915 through the capacitor 2905. An output terminal of the operational amplifier 2903 is connected to the second signal line 2919. The inverting input terminal of the operational amplifier 2903 is connected to the output terminal through the switch 2904.

Next, an operation is described with reference to FIGS. 30A to 30D. Note that description is made using the reference numerals in FIG. 29 having the same configuration as FIGS. 30A to 30D, although reference numerals are not shown in FIGS. 30A to 30D.

Figure 30A:
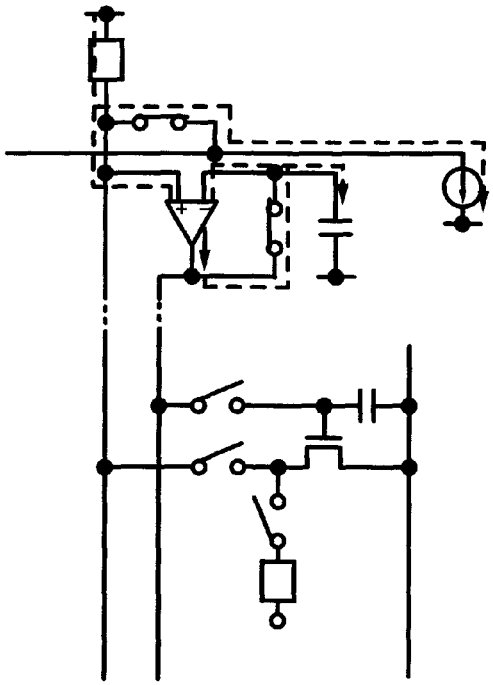
FIGS. 30A to 30D are diagrams each showing an operation of a pixel in a case where a semiconductor device of the invention is applied to a part of the pixel and a signal line driver circuit.
Figure 30B:
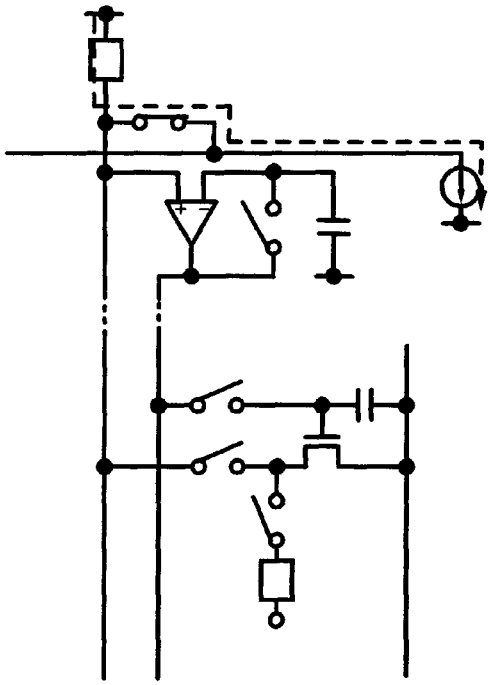

First, as shown in FIG. 30A, the switches 2902 and 2904 are turned on, thereby a current set by the current source 2906 flows to the current-voltage converting element 2901. At that time, a voltage is generated in the current-voltage converting element 2901. Then, a potential inputted to the non-inverting input terminal of the operational amplifier 2903 is lowered due to a voltage-drop by the current-voltage converting element 2901. That is, the potential inputted to the non-inverting input terminal of the operational amplifier 2903 is lower than a potential of the wire 2913 by the potential generated in the current-voltage converting element 2901. At that time, the inverting input terminal and the output terminal of the operational amplifier 2903 are electrically connected; therefore, the operational amplifier 2903 functions as a voltage follower. That is, a current is supplied from the output terminal of the operational amplifier 2903 until a potential of one electrode of the capacitor 2905 becomes approximately equal to a potential of the non-inverting input terminal. When a current stops being supplied from the output terminal of the operational amplifier 2903, the switch 2904 is turned off, as shown in FIG. 30B. Then, a potential of the inverting input terminal of the operational amplifier 2903 is held in the capacitor 2905.

Figure 30C:
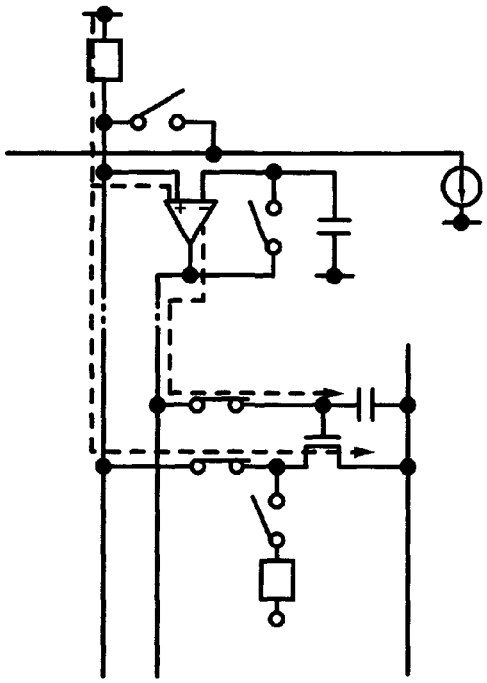

As shown in FIG. 30C, the switch 2902 is turned off, and the switches 2910 and 2911 are turned on, thereby a potential is supplied to the gate terminal of the transistor 2907 from the output terminal of the operational amplifier 2903 so that the non-inverting input terminal and the inverting input terminal have the same potential. That is, when a potential of the non-inverting input terminal of the operational amplifier 2903 is higher than that of the inverting input terminal thereof, a potential is supplied from the output terminal of the operational amplifier 2903 so that the gate potential of the transistor 2907 is high. Therefore, the amount of current flowing to the transistor 2907 is increased. Accordingly, the amount of current flowing to the current-voltage converting element 2901 is increased, which increases a voltage drop. Therefore, a potential inputted to the non-inverting input terminal of the operational amplifier 2903 becomes low. Meanwhile, when a potential of the non-inverting input terminal of the operational amplifier 2903 is lower than that of the inverting input terminal thereof, a potential is supplied from the output terminal of the operational amplifier 2903 so that the gate potential of the transistor 2907 becomes low. Therefore, the amount of current flowing to the transistor 2907 is decreased. Accordingly, the amount of current flowing to the current-voltage converting element 2901 is decreased, which decreases a voltage drop. Therefore, a potential inputted to the non-inverting input terminal of the operational amplifier 2903 becomes high. When the non-inverting input terminal and the inverting input terminal of the operational amplifier 2903 have an approximately equal potential, the signal current Idata flows to the current-voltage converting element 2901 and the transistor 2907. Thus, signal writing to the pixel is completed.

Figure 30D:
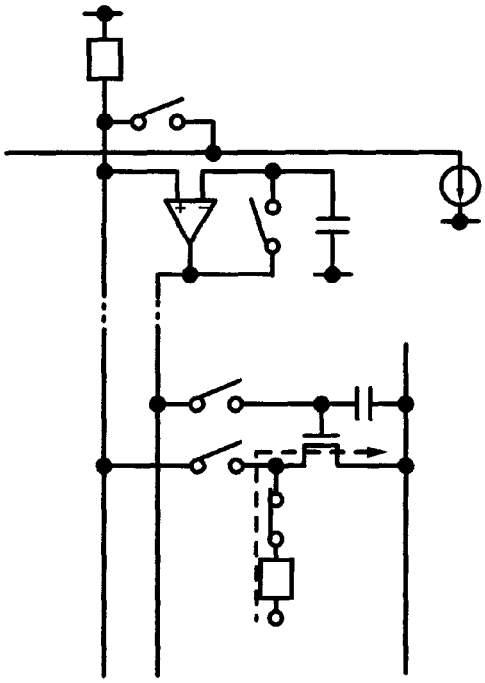

In a light emitting period, the switches 2910 and 2911 are turned off and the switch 2912 is turned on as shown in FIG. 30D, thereby a current set for the transistor 2907 flows to the light emitting element 2909 and the transistor 2910 from the counter electrode 2916.

Figure 31:
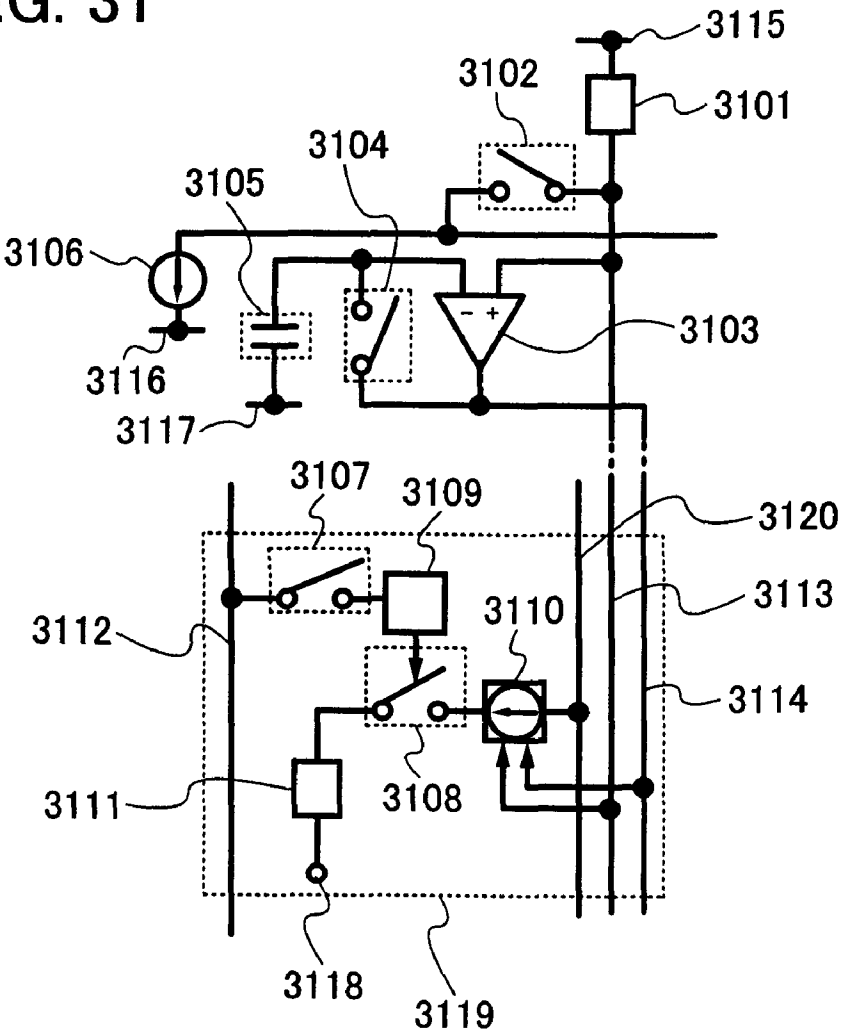
FIG. 31 is a diagram showing a configuration in a case where a semiconductor device of the invention is applied to a part of a pixel and a signal line driver circuit.

Next, FIG. 31 shows a case of applying a configuration of the semiconductor device shown in FIG. 2 of Embodiment Mode 3 to a pixel. A pixel 3119 includes switches 3107 and 3108, a signal storing unit 3109, a current source circuit 3110, a light emitting element 3111, a signal line 3112, wires 3113 and 3114, and a power source line 3120. Note that a predetermined potential is supplied to a counter electrode 3118 of the light emitting element 3111.

The power source line 3120 is connected to a pixel electrode of the light emitting element 3111 through the current source circuit 3110 and the switch 3108. The signal storing unit 3109 is connected to the signal line 3112 through the switch 3107. A current is set for the current source circuit 3110 by the wires 3113 and 3114. When the switch 3107 is in an on state, and a signal is inputted to the signal storing unit 3109 from the signal line 3112, the signal is stored in the signal storing unit 3109. The switch 3108 is controlled to be turned on/off by the signal stored in the signal storing unit 3109. In the case where the switch 3108 is turned on, while the signal is stored in the signal storing unit 3109, a current set for the current source circuit 3110 flows to the light emitting element 3111.

Further, the wire 3113 is connected to the wire 3115 through the current-voltage converting element 3101, to the wire 3116 through the switch 3102 and the current source 3106, and to a non-inverting input terminal of the operational amplifier 3103. An inverting input terminal of the operational amplifier 3103 is connected to the wire 3117 through the capacitor 3105. An output terminal of the operational amplifier 3103 is connected to the inverting input terminal through the switch 3104, and to the wire 3114 as well.

Figure 32:
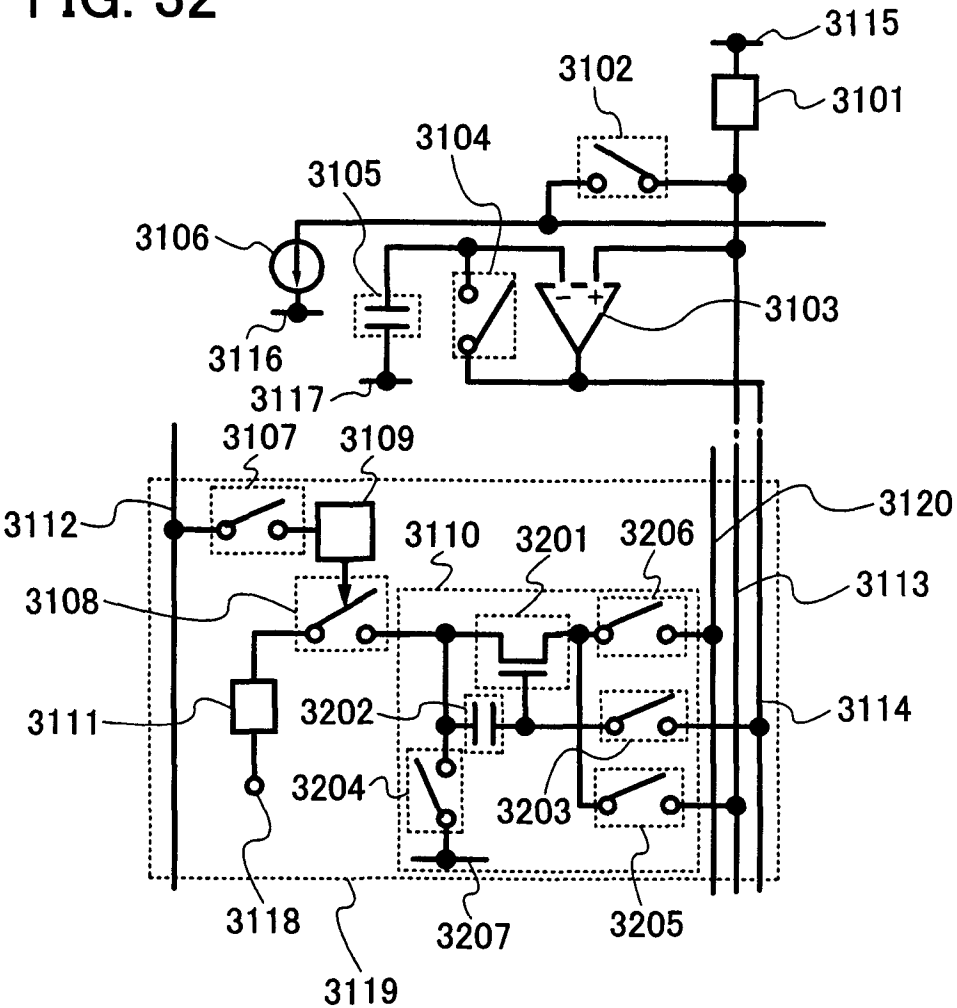
FIG. 32 is a diagram showing a configuration in a case where a semiconductor device of the invention is applied to a part of a pixel and a signal line driver circuit.

Note that FIG. 32 shows one configuration example of the current source circuit 3110, and description is made of an operation thereof with reference to FIG. 33. The configuration in FIG. 32 is a detailed diagram of the configuration of the current source circuit 3110 in FIG. 31; therefore, common portions are denoted by the same reference numerals and description thereof is omitted.

First, description is made of a configuration of FIG. 32. The current source circuit 3110 includes a transistor 3201, a capacitor 3202, and switches 3203, 3204, 3205, and 3206. A first terminal (one of a source terminal and a drain terminal) of the transistor 3201 is connected to a pixel electrode of the light emitting element 3111 through the switch 3108, and to a wire 3207 through the switch 3204. A gate terminal of the transistor 3201 is connected to the first terminal through the capacitor 3202, and to the wire 3114 through the switch 3203. A second terminal (the other of the source terminal and the drain terminal) of the transistor 3201 is connected to the power source line 3120 through the switch 3206, and to the wire 3113 through the switch 3205.

Figure 33A:
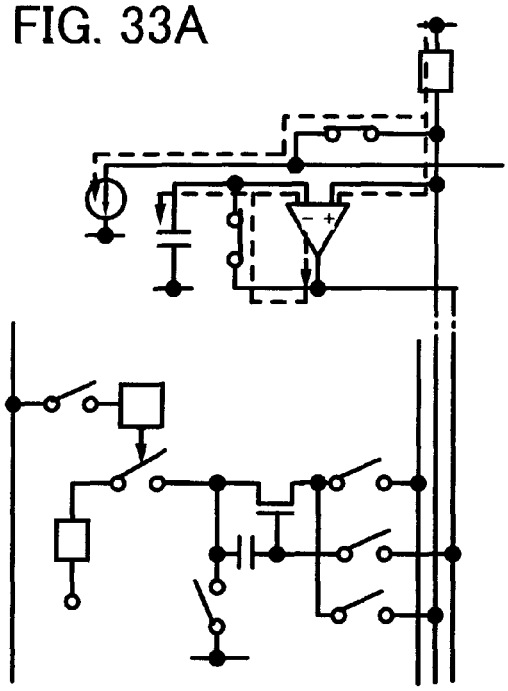
FIGS. 33A to 33D are diagrams each showing an operation of a pixel in a case where a semiconductor device of the invention is applied to a part of the pixel and a signal line driver circuit.
Figure 33B:
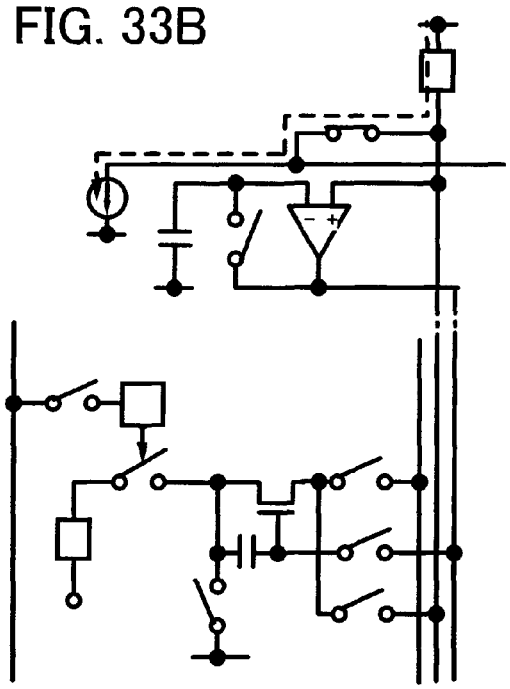

First, as shown in FIG. 33A, the switches 3102 and 3104 are turned on, thereby a current set by the current source 3106 flows to the current-voltage converting element 3101. At that time, a voltage is generated in the current-voltage converting element 3101. Then, a potential inputted to the non-inverting input terminal of the operational amplifier 3103 is lowered due to a voltage drop by the current-voltage converting element 3101. That is, the potential inputted to the non-inverting input terminal of the operational amplifier 3103 is lower than a potential of the wire 3115 by the potential generated in the current-voltage converting element 3101. At that time, the non-inverting input terminal and the inverting input terminal of the operational amplifier 3103 are electrically connected; therefore, the operational amplifier 3103 functions as a voltage follower. That is, a current is supplied from the output terminal of the operational amplifier 3103 until a potential of one electrode of the capacitor 3105 becomes approximately equal to a potential of the non-inverting input terminal. When a current stops being supplied from the output terminal of the operational amplifier 3103, the switch 3104 is turned off, as shown in FIG. 33B. Then, a potential of the inverting input terminal of the operational amplifier 3103 is held in the capacitor 3105.

Figure 33C:
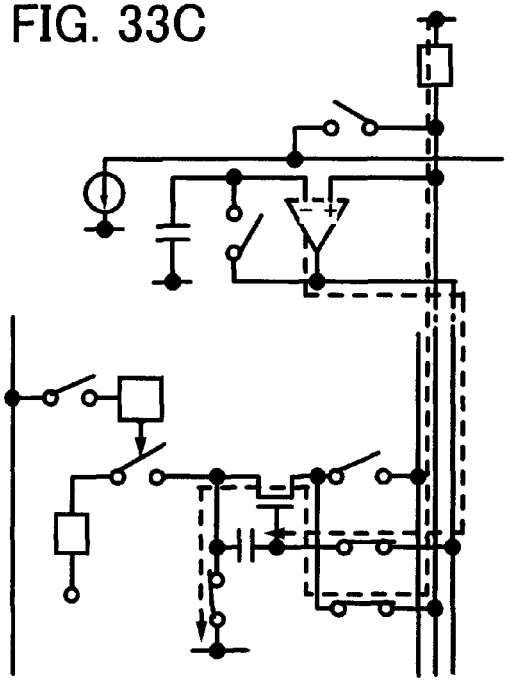
Figure 33D:
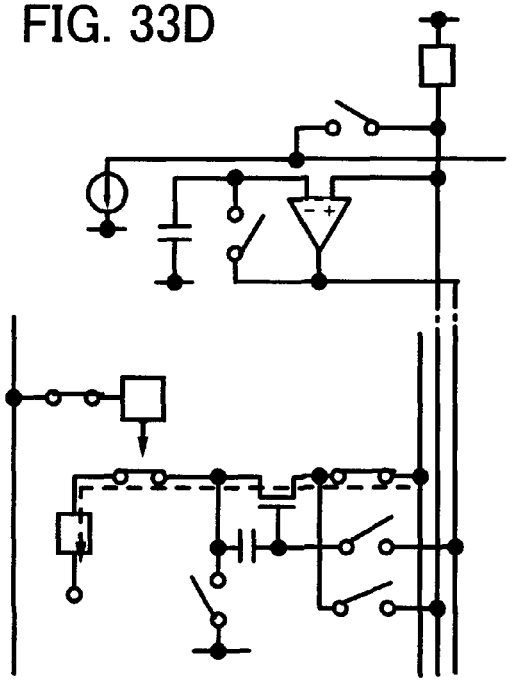

As shown in FIG. 33C, the switch 3102 is turned off, and the switches 3203, 3204, and 3205 are turned on, thereby a potential is supplied to the gate terminal of the transistor 3201 from the output terminal of the operational amplifier 3103 so that the non-inverting input terminal and the inverting input terminal have the same potential. That is, when a potential of the non-inverting input terminal of the operational amplifier 3103 is higher than that of the inverting input terminal thereof, a potential is supplied from the output terminal of the operational amplifier 3103 so that the gate potential of the transistor 3201 becomes high. Therefore, the amount of current flowing to the transistor 3201 is increased. Accordingly, the amount of current flowing to the current-voltage converting element 3101 is increased, which increases a voltage drop. Therefore, a potential inputted to the non-inverting input terminal of the operational amplifier 3103 becomes low. Meanwhile, when a potential of the non-inverting input terminal of the operational amplifier 3103 is lower than that of the inverting input terminal thereof, a potential is supplied from the output terminal of the operational amplifier 3103 so that the gate potential of the transistor 3201 becomes low. Therefore, the amount of current flowing to the transistor 3201 is decreased. Accordingly, the amount of current flowing to the current-voltage converting element 3101 is decreased, which decreases a voltage drop. Therefore, a potential inputted to the non-inverting input terminal of the operational amplifier 3103 becomes high. When the non-inverting input terminal and the inverting input terminal of the operational amplifier 3103 have an approximately equal potential, the signal current Idata flows to the current-voltage converting element 3101 and the transistor 3201. Thus, programming to the current source circuit 3110 of the pixel is completed.

In the period of signal writing to the pixel, the switches 3203, 3204, and 3205 are turned off and the switch 3206 is turned on. Further, the switch 3107 is turned on, thereby a signal is inputted to the signal storing unit 3109 from the signal line 3112. The signal storing unit 3109 stores the inputted signal. The switch 3108 is controlled to be turned on/off by the signal stored in the signal storing unit 3109. When the switch 3108 is turned on, a current set by the transistor 3201 flows to the light emitting element 3111.

Figure 34:
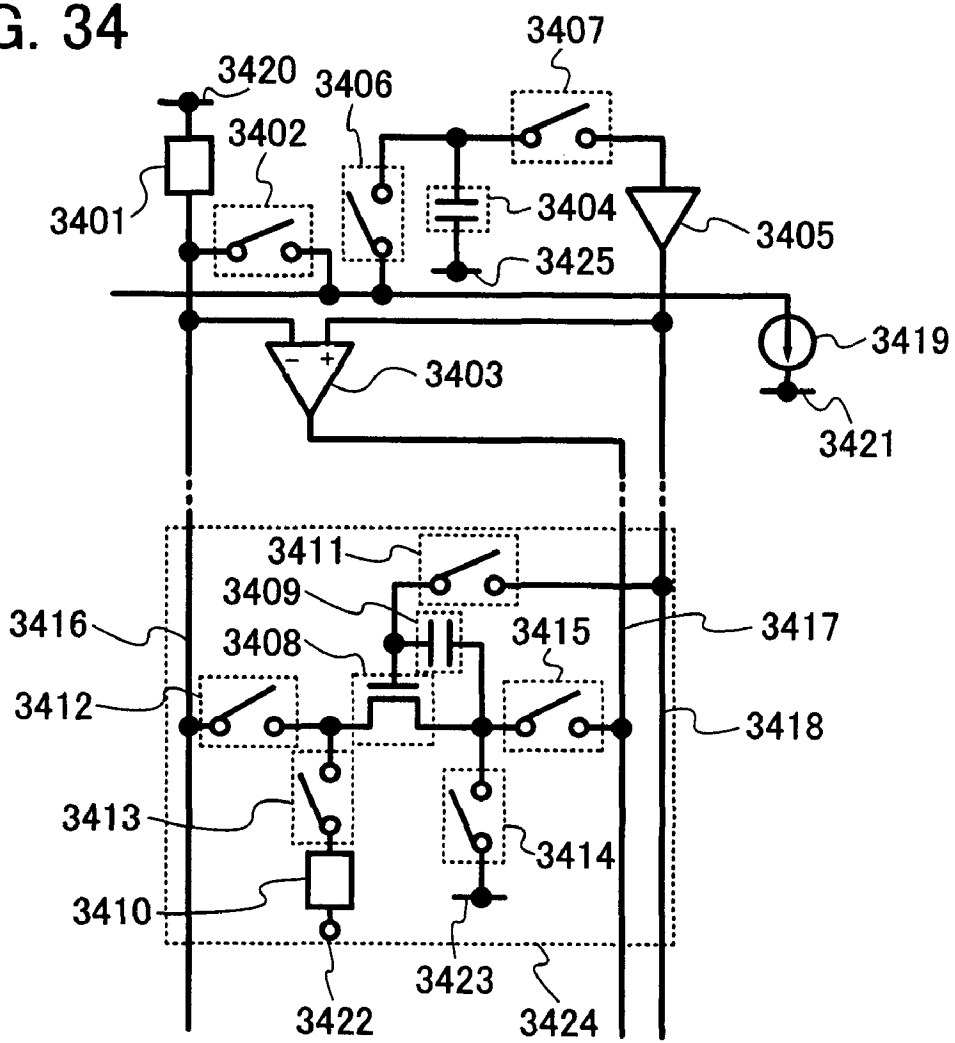
FIG. 34 is a diagram showing a configuration in a case where a semiconductor device of the invention is applied to a part of a pixel and a signal line driver circuit.

Next, FIG. 34 shows a case of applying a configuration of the semiconductor device shown in FIG. 21 of Embodiment Mode 3 to a pixel. A pixel 3424 includes a transistor 3408, a capacitor 3409, a light emitting element 3410, switches 3411, 3412, 3413, 3414, and 3415, a signal line 3416, and wires 3417 and 3418. Note that a predetermined potential is supplied to a counter electrode 3422 of the light emitting element 3410.

The transistor 3408 has a gate terminal connected to the wire 3418 through the switch 3411, a first terminal (one of a source terminal and a drain terminal) connected to the wire 3417 through the switch 3415, and a second terminal (the other of the source terminal and the drain terminal) connected to the signal line 3416 through the switch 3412. The first terminal of the transistor 3408 is also connected to the wire 3423 through the switch 3414. The second terminal of the transistor 3408 is also connected to a pixel electrode of the light emitting element 3410 through the switch 3413. The gate terminal and the first terminal of the transistor 3408 are connected through the capacitor 3409.

Further, the signal line 3416 is connected to the wire 3420 through the current-voltage converting element 3401, to the wire 3421 through the switch 3402 and the current source 3419, and to an inverting input terminal of the operational amplifier 3403. The operational amplifier 3403 has a non-inverting input terminal connected to the wire 3418, and an output terminal connected to the wire 3417. Further, the signal line 3416 is also connected to the wire 3418 through the switches 3402, 3406, and 3407, and a buffer 3405, and to the wire 3425 through the switches 3402 and 3406, and the capacitor 3404.

Next, an operation is described with reference to FIGS. 35A to 35D. Note that description is made using the reference numerals in FIG. 34 having the same configuration as FIGS. 35A to 35D, although reference numerals are not shown in FIGS. 35A to 35D.

Figure 35A:
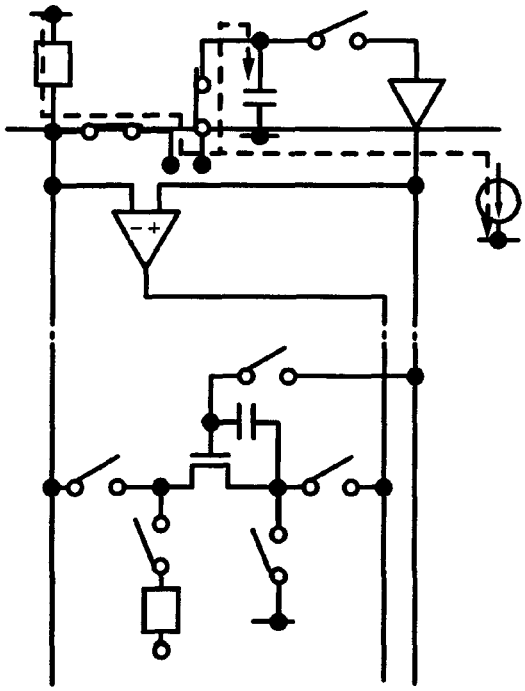
FIGS. 35A to 35D are diagrams each showing an operation of a pixel in a case where a semiconductor device of the invention is applied to a part of the pixel and a signal line driver circuit.
Figure 35B:
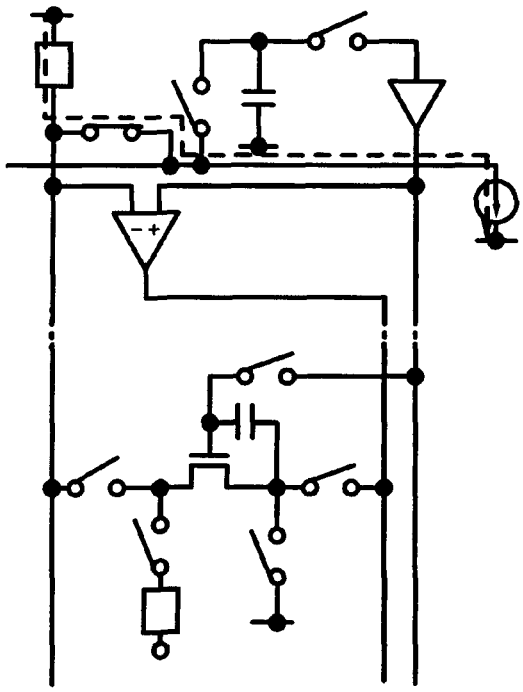

First, as shown in FIG. 35A, the switches 3402 and 3406 are turned on, thereby a current set by the current source 3419 flows to the current-voltage converting element 3401. At that time, a voltage is generated in the current-voltage converting element 3401. Then, a potential inputted to the one electrode of the capacitor 3404 is lowered due to a voltage-drop by the current-voltage converting element 3401. That is, the potential inputted to the one electrode of the capacitor 3404 is lower than a potential of the wire 3420 by the potential generated in the current-voltage converting element 3401. Meanwhile, as shown in FIG. 35B, the switch 3406 is turned off, thereby the potential inputted to the one electrode of the capacitor 3404 is held by the capacitor 3404 since the other electrode of the capacitor 3404 is connected to the wire 3425 to which a predetermined potential is supplied.

Figure 35C:
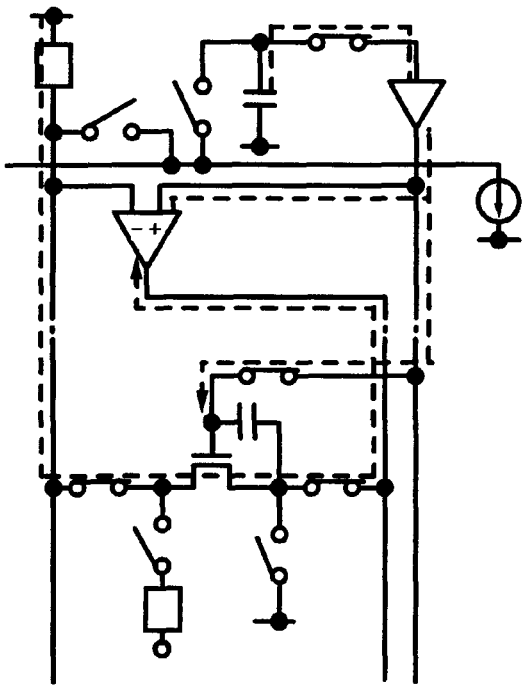

As shown in FIG. 35C, the switch 3402 is turned off, and the switches 3407, 3411, and 3412 are turned on, thereby a potential approximately equal to a potential held in the capacitor 3404 is outputted from the buffer 3405. Then, the potential outputted from the buffer 3405 is supplied to the wire 3418, and is inputted to the non-inverting input terminal of the operational amplifier 3403 and the gate terminal of the transistor 3408. Further, a current flows to the output terminal of the operational amplifier 3403 from the wire 3420 through the current-voltage converting element 3401 and the transistor 3408.

A potential inputted to the inverting input terminal of the operational amplifier 3403 is lower than a potential of the wire 3420 by a potential generated in the current-voltage converting element 3401. Then, the operational amplifier 3403 outputs a potential from the output terminal so that the non-inverting input terminal and the inverting input terminal have a predetermined potential difference.

Thus, a charge for a gate-source voltage of the transistor 3408 is accumulated in the capacitor 3409.

Figure 35D:
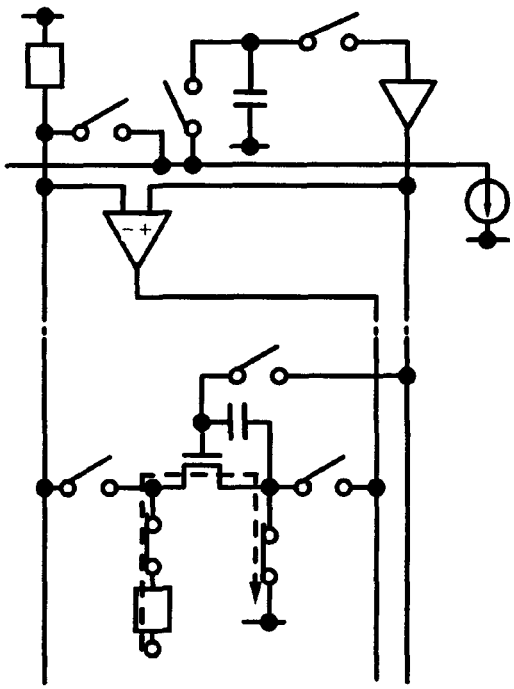

In a light emitting period, the switches 3407, 3411, 3412, and 3415 are turned off and the switches 3413 and 3414 are turned on as shown in FIG. 35D, thereby a current set for the transistor 3408 flows to the wire 3423 through the light emitting element 3410 and the transistor 3408 from the counter electrode 3422.

Embodiment Mode 8

In this embodiment mode, configurations and operations of a display device, a signal line driver circuit, and the like are described. A semiconductor device of the invention can be applied to a part of the signal line driver circuit and a pixel.

Figure 36:
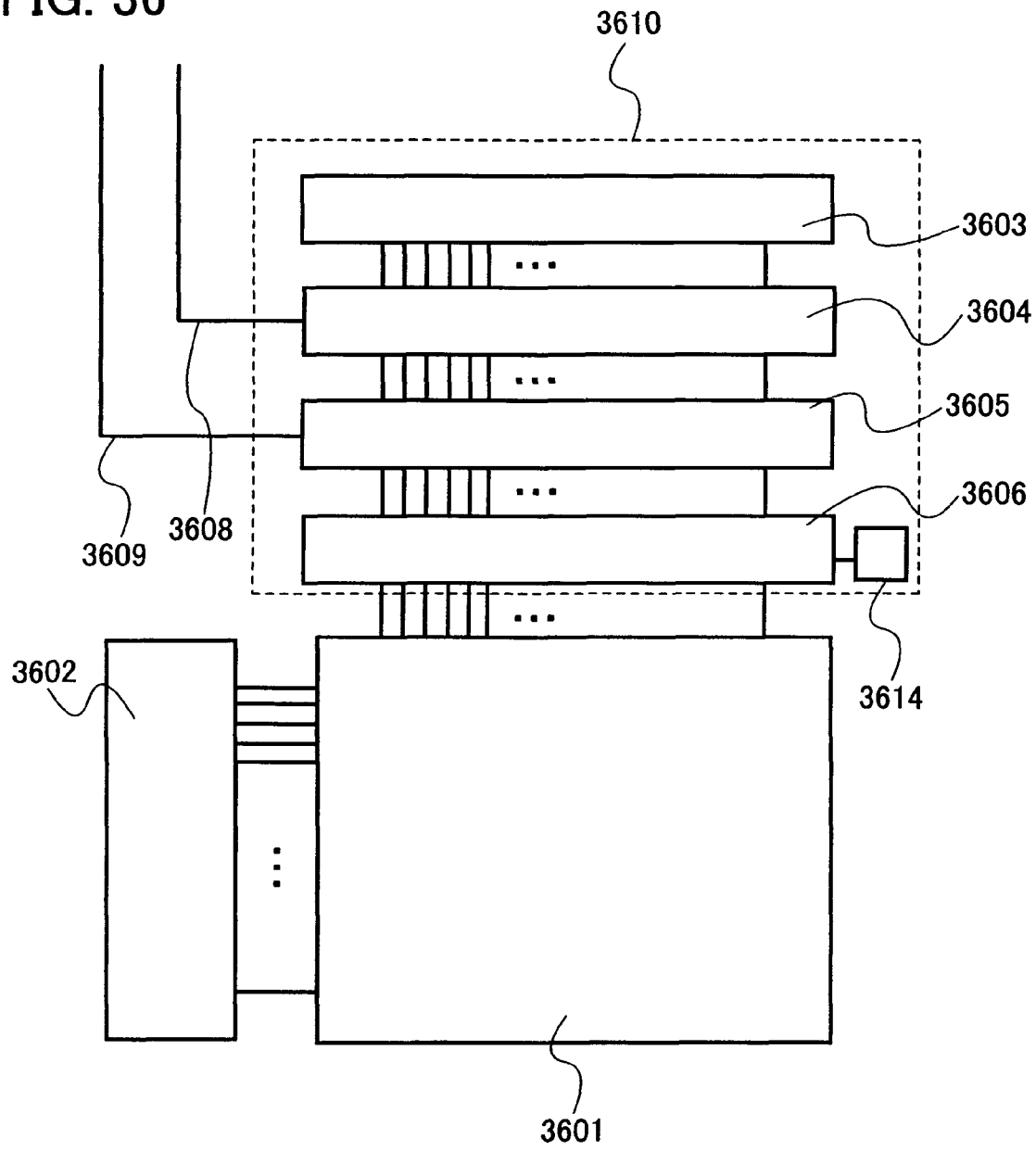
FIG. 36 is a view showing a display device.

A display device includes a pixel portion 3601, a scan line driver circuit 3602, and a signal line driver circuit 3610 as shown in FIG. 36. The scan line driver circuit 3602 sequentially outputs a selection signal to the pixel portion 3601. The signal line driver circuit 3610 sequentially outputs a video signal to the pixel portion 3601. The pixel portion 3601 displays an image by controlling the state of light in accordance with the video signal. The video signal inputted to the pixel portion 3601 from the signal line driver circuit 3610 is often a current. That is, a display element and an element for controlling the display element disposed in each pixel change their states in accordance with the video signal (current) inputted from the signal line driver circuit 3610. An EL element, an element used in an FED (Field Emission Display), and the like are examples of the display element disposed in a pixel.

Note that a plurality of the scan line driver circuits 3602 and the signal line driver circuits 3610 may be provided.

The signal line driver circuit 3610 can be divided into a plurality of portions in its configuration. For example, it can be divided into a shift register 3603, a first latch circuit 3604, a second latch circuit 3605, and a digital-analog converter circuit 3606. The digital-analog converter circuit 3606 has a function to convert a voltage into a current, and may have a function to perform a gamma correction as well. That is, the digital-analog converter circuit 3606 has a circuit which outputs a current (video signal) to a pixel, namely a current source circuit to which the invention can be applied.

As shown in FIG. 31, a digital voltage signal for a video signal and a current for controlling a current source circuit in a pixel are inputted to the pixel in some cases depending on a configuration of the pixel. In that case, the digital-analog converter circuit 3606 does not have a digital-analog converting function, but has a function to convert a voltage into a current and a circuit to output a current to the pixel as a current for control, namely a current source circuit to which the invention can be applied.

Further, the pixel has a display element such as an EL element. The pixel has a circuit which outputs a current (video signal) to the display element, namely a current source circuit to which the invention can also be applied.

Brief description is made of an operation of the signal line driver circuit 3610. The shift register 3603 is formed by using a plurality of columns of flip-flop circuits (FFs) and the like, and a clock signal (S-CLK), a start pulse (SP), and an inverted clock signal (S-CLKb) are inputted to the shift register 3603. Sampling pulses are sequentially outputted in accordance with these signals.

The sampling pulse outputted from the shift register 3603 is inputted to the first latch circuit 3604. A video signal is inputted to the first latch circuit 3604 from a video signal line 3608, and a video signal is held in each column in accordance with a timing at which the sampling pulse is inputted. Note that a video signal has a digital value in the case where the digital-analog converter circuit 3606 is disposed. Further, a video signal in this stage is often a voltage. In the case where the first latch circuit 3604 and the second latch circuit 3605 can store analog values, however, the digital-analog converter circuit 3606 can be omitted in many cases. In that case, a video signal is a current in many cases. Moreover, in the case where data outputted to the pixel portion 3601 have a binary value, namely a digital value, the digital-analog converter circuit 3606 can be omitted in many cases.

When video signals are held up to the last column in the first latch circuit 3604, a latch pulse is inputted from a latch control line 3609 in a horizontal retrace period and the video signals held in the first latch circuit 3604 are transferred to the second latch circuit 3605 all at once. After that, one column of the video signals held in the second latch circuit 3605 is inputted to the digital-analog converter circuit 3606 at a time. Then, the signal outputted from the digital-analog converter circuit 3606 is inputted to the pixel portion 3601.

While the video signal held in the second latch circuit 3605 is inputted to the digital-analog converter circuit 3606 and the pixel portion 3601, a sampling pulse is outputted again from the shift register 3603. That is, two operations are performed at the same time. Thus, a line sequential drive can be performed. Subsequently, this operation is repeated.

Figure 62:
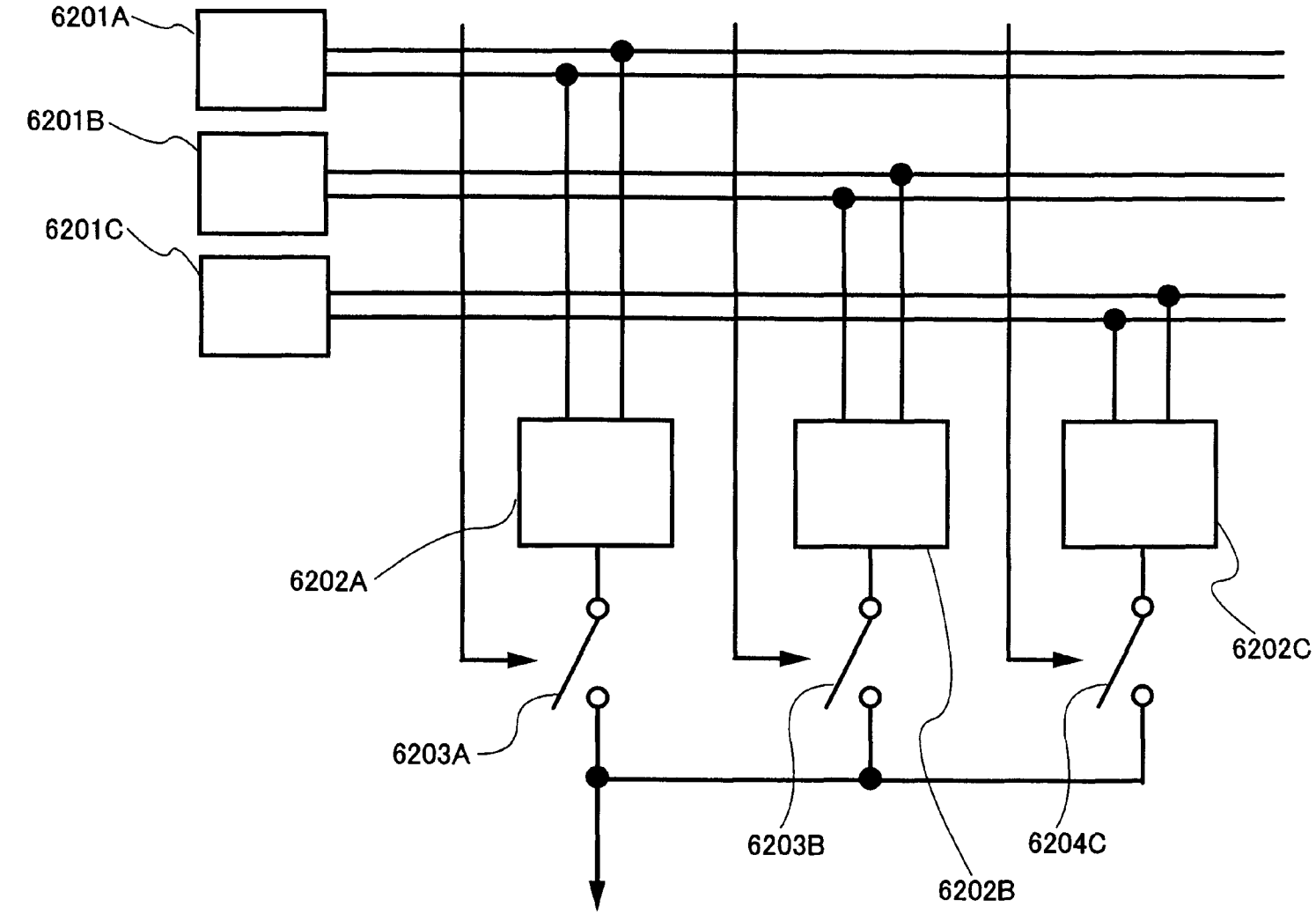
FIG. 62 is a diagram showing a configuration in the case where a semiconductor device of the invention is applied to a part of a signal line driver circuit.

That is, a circuit having a configuration shown in FIG. 62 is included in the digital-analog converter circuit 3606. Note that description is made of a case of 3 bit for simplification in FIG. 62. There are basic current source circuits 6201A, 6201B, and 6201C, and the amount of current in the set operation is Ic, 2×Ic, and 4×Ic, respectively. The basic current source circuits 6201A, 6201B, and 6201C are connected to the current source circuits 6202A, 6202B, and 6202C, respectively. Therefore, in the output operation, the amount of current Ic, 2×Ic, and 4×Ic are outputted to the current source circuits 6202A, 6202B, and 6202C, respectively. The current source circuits 6202A, 6202B, and 6202C are connected to switches 6203A, 6203B, and 6203C in series. The switch is controlled by the video signals outputted from the second latch circuit 3605 shown in FIG. 36. Then, total current outputted from each current source circuit and switch are outputted to a load, that is a signal line. Operations are thus performed, thereby an analog current is outputted to a pixel as a video signal.

In the case where the current source circuit of the digital-analog converter circuit 3606 is a circuit which performs the set operation and the output operation, that is a circuit to which a current is inputted from a different current source circuit and can output a current which is not affected by a variation in characteristics of transistors, a circuit for applying a current to the current source circuit is required. In that case, a reference current source circuit 3614 is disposed.

Note that in the case where the set operation is performed to the current source circuit, a timing thereof is required to be controlled. In that case, a dedicated driver circuit (such as a shift register) may be disposed for controlling the set operation. Alternatively, the set operation to the current source circuit may be controlled by using a signal outputted from the shift register for controlling the first latch circuit. That is, both of the first latch circuit and the current source circuit may be controlled by one shift register. In that case, a signal outputted from the shift register for controlling the first latch circuit may be inputted to the current source circuit directly. Alternatively, in order to separate a control of the first latch circuit and a control of the current source circuit, the current source circuit may be controlled through a circuit for controlling the separation. Alternatively, the set operation to the current source circuit may be controlled by using a signal outputted from the second latch circuit. The signal outputted from the second latch circuit is normally a video signal. Therefore, in order to separate the case of using it as a video signal and the case of controlling the current source circuit, the current source circuit may be controlled through a circuit which controls the separation.

Note that the signal line driver circuit and a part of it (a current source circuit, an amplifier circuit and the like) is not on the same substrate as the pixel portion 3601 and are formed by using, for example, an external IC chip in some cases.

Note that a configuration of a signal line driver circuit and the like are not limited to FIG. 36.

Figure 37:
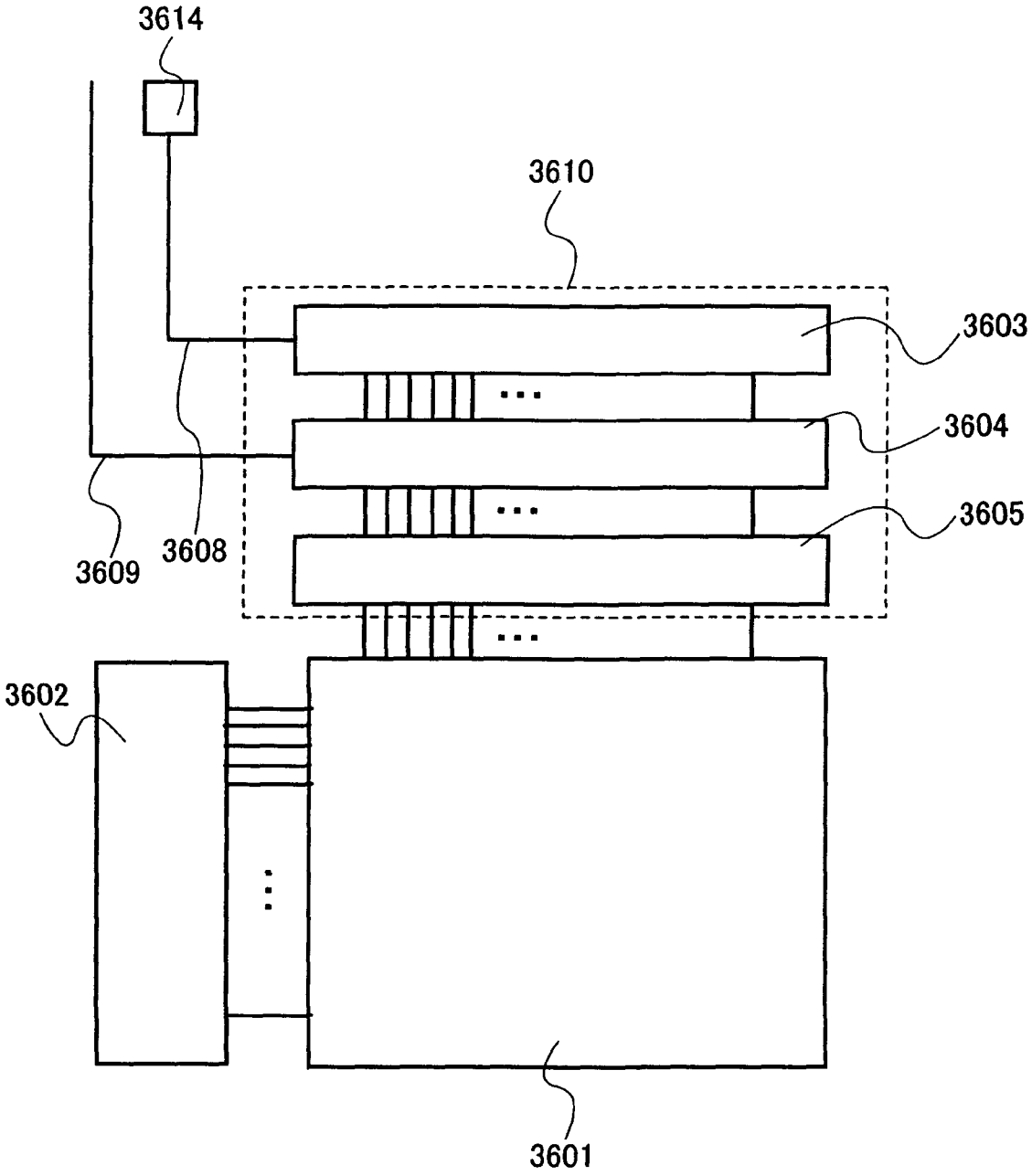
FIG. 37 is a view showing a display device.

For example, in the case where the first latch circuit 3604 and the second latch circuit 3605 can store analog values, a video signal (analog current) may be inputted from the reference current source circuit 3614 to the first latch circuit 3604 as shown in FIG. 37. Further, the second latch circuit 3605 is not included in FIG. 37 in some cases. In that case, a larger number of current source circuits are often disposed in the first latch circuit 3604.

In such a case, the invention can be applied to a current source circuit in the digital-analog converter circuit 3606 in FIG. 36. There are a plurality of unit circuits in the digital-analog converter circuit 3606, and a current source circuit and an amplifier circuit are disposed in the reference current source circuit 3614.

Figure 61:
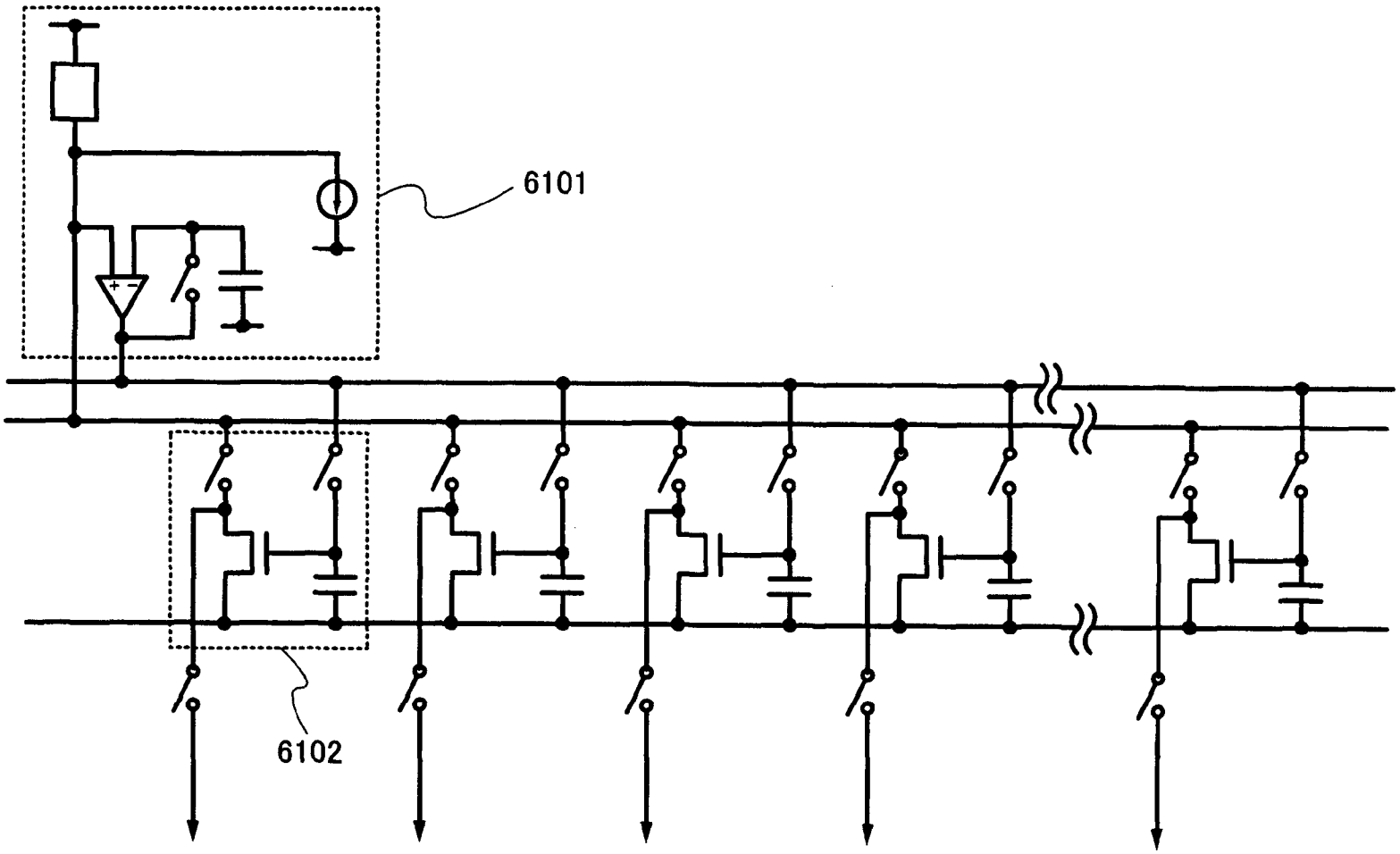
FIG. 61 is a diagram showing a configuration in the case where a semiconductor device of the invention is applied to a part of a signal line driver circuit.

Alternatively, the invention can be applied to a current source circuit in the first latch circuit 3604, in FIG. 37. There are a plurality of unit circuits in the first latch circuit 3604 and a basic current source and an additional current source are disposed in the reference current source circuit 3614. For example, a basic current source circuit 6101 and a current source circuit 6102 corresponding to pixels of each column are provided as shown in FIG. 61.

Alternatively, the invention can be applied to a pixel (a current source circuit therein) in the pixel portion 3601 in FIGS. 36 and 37. There are a plurality of unit circuits in the pixel portion 3601, and a current source circuit and an amplifier circuit are disposed in the signal line driver circuit 3610.

That is, a circuit which supplies a current is in various portions of a circuit. Such a current source circuit is required to output an accurate current. Therefore, such a current source circuit is set by using a different current source circuit so that a transistor can output an accurate current. The different current source circuit is required to output an accurate current as well. Therefore, there is a current source circuit as a reference from which current source transistors are set sequentially. Accordingly, the current source circuit can output an accurate current. Therefore, the invention can be applied to such a portion.

Embodiment Mode 9

Figure 38A:
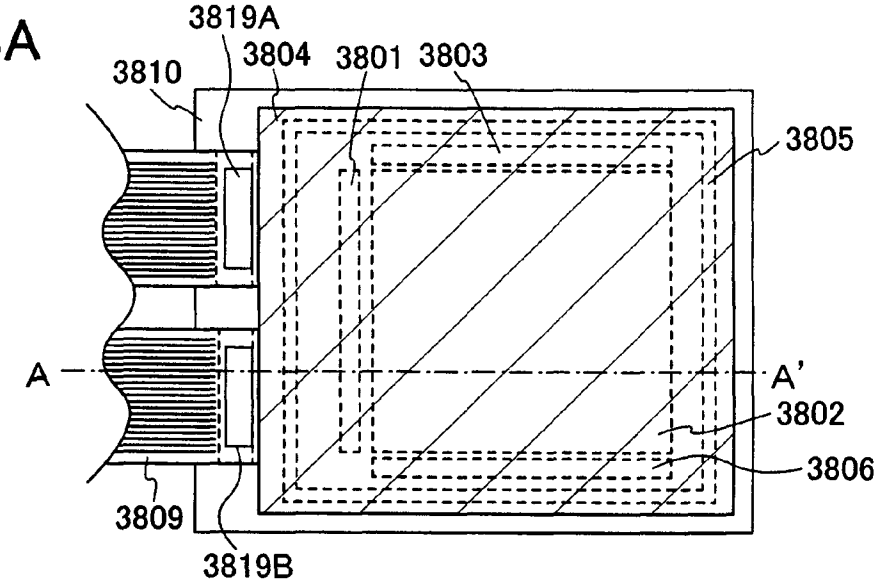
FIGS. 38A and 38B are views showing a display panel.
Figure 38B:
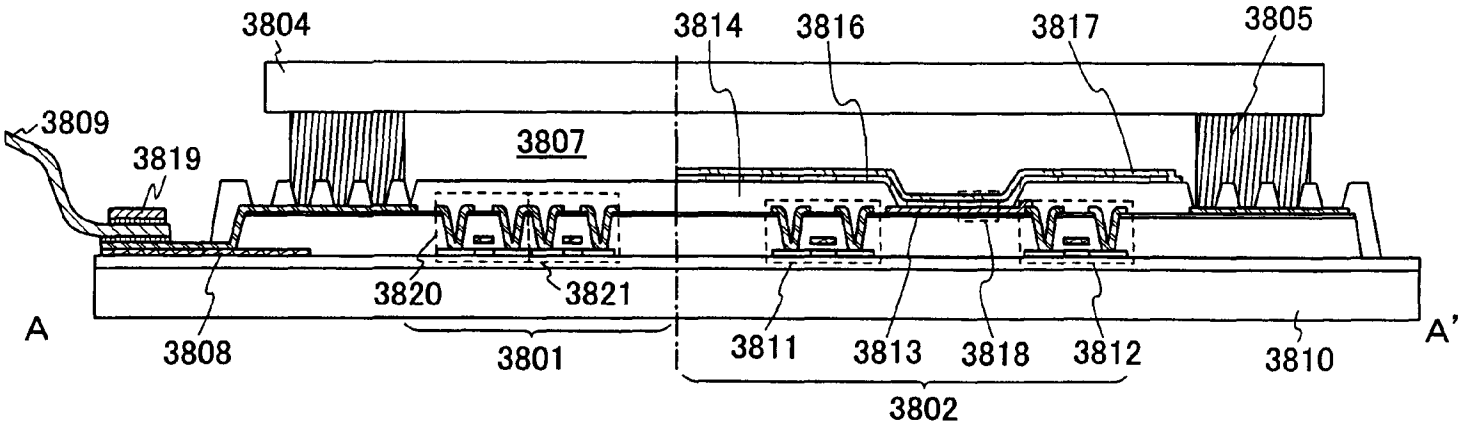

In this embodiment mode, description is made of the configurations of a display panel described in Embodiment Mode 1 with reference to FIGS. 38A and 38B.

It is to be noted that FIG. 38A is a top plan view of the display panel and FIG. 38B is a cross sectional diagram along a line A-A' of FIG. 38A. The display panel includes a signal line driver circuit 3801, a pixel portion 3802, a first scan line driver circuit 3803, and a second scan line driver circuit 3806, which are shown by dotted lines. Further, a sealing substrate 3804 and a sealing material 3805 are provided. A portion surrounded by the sealing material 3805 is a space 3807.

It is to be noted that a wire 3808 is a wire for transmitting a signal inputted to the first scan line driver circuit 3803, the second scan line driver circuit 3806, and the signal line driver circuit 3801 and receives a video signal, a clock signal, a start pulse signal, and the like from an FPC (Flexible Printed Circuit) 3809 functioning as an external input terminal. IC chips (semiconductor chip each including a memory circuit, a buffer circuit, and the like) 3819A and 3819B are mounted over a connecting portion of the FPC 3809 and the display panel by COG (Chip On Glass) or the like. It is to be noted that only the FPC 3809 is shown here; however, a printed wiring board (PWB) may be attached to the FPC 3809. The display device in this specification includes not only a main body of the display panel but one with an FPC or a PWB attached thereto.

Next, description is made of a cross-sectional structure with reference to FIG. 38B. The pixel portion 3802 and peripheral driver circuits (the first scan line driver circuit 3803, the second scan line driver circuit 3806, and the signal line driver circuit 3801) are formed over a substrate 3810. Here, the signal line driver circuit 3801 and the pixel portion 3802 are shown.

It is to be noted that the signal line driver circuit 3801 includes TFTs 3820 and 3821. Further, in this embodiment mode, a display panel in which the peripheral driver circuits are formed over one substrate is shown; however, the invention is not limited to this. All or some of the peripheral driver circuits may be formed into an IC chip or the like and mounted by COG or the like.

Further, the pixel portion 3802 includes TFTs 3811 and 3812. It is to be noted that a source electrode of the TFT 3812 is connected to a first electrode (pixel electrode) 3813. An insulating film 3814 is formed so as to cover end portions of the first electrode 3813. Here, a positive photosensitive acrylic resin film is used for the insulating film 3814.

In order to obtain favorable coverage, the insulating film 3814 is formed so that a curved surface having a curvature is formed at a top end portion or a bottom end portion of the insulating film 3814. For example, in the case of using a positive photosensitive acrylic as a material for the insulating film 3814, it is preferable that only the top end portion of the insulating film 3814 have a curved surface having a curvature radius (0.2 to 3 μm). Moreover, either a negative photosensitive acrylic which becomes insoluble in etchant by light or a positive photosensitive acrylic which becomes soluble in etchant by light can be used as the insulating film 3814.

A layer 3816 containing an organic compound and a second electrode (counter electrode) 3817 are formed over the first electrode 3813. Here, it is preferable to use a material having a high work function as a material used for the first electrode 3813 which functions as an anode. For example, a single layer of an indium tin oxide (ITO) film, an indium zinc oxide (IZO) film, a titanium nitride film, a chromium film, a tungsten film, a Zn film, a Pt film, or the like, a stacked layer of a titanium nitride film and a film containing aluminum as a main component, a three-layer structure of a titanium nitride film, a film containing aluminum as a main component, and a titanium nitride film, or the like can be used. It is to be noted that with a stacked layer structure, resistance as a wire is low, favorable ohmic contact can be obtained, and a function as an anode can be obtained.

The layer 3816 containing an organic compound is formed by vapor deposition using a deposition mask, or inkjet. A metal complex belonging to group 4 of the periodic table of elements is used for a part of the layer 3816 containing an organic compound. Besides, a low molecular material or a high molecular material may be used in combination as well. Further, as a material used for the layer 3816 containing an organic compound, a single layer or a stacked layer of an organic compound is often used; however, in this embodiment mode, an inorganic compound may be used in a part of a film formed of an organic compound. Moreover, a known triplet material can also be used.

Further, as a material used for the second electrode 3817 formed over the layer 3816 containing an organic compound, a material having a low work function (Al, Ag, Li, Ca, or an alloy thereof such as MgAg, MgIn, AlLi, $CaF_2$, or calcium nitride) may be used. In the case where light generated from the layer 3816 containing an organic compound is transmitted through the second electrode 3817, a stacked layer of a thinned metal thin film and a light-transmissive conductive film (ITO (indium tin oxide) film), indium oxide zinc oxide alloy ($In_2O_3$—ZnO), zinc oxide (ZnO), or the like) is preferably used.

Further, by attaching the sealing substrate 3804 to the substrate 3810 with the sealing material 3805, a light emitting element 3818 is provided in the space 3807 surrounded by the substrate 3810, the sealing substrate 3804, and the sealing material 3805. It is to be noted that the space 3807 may be filled with the sealing material 3805 as well as an inert gas (nitrogen, argon, or the like).

It is to be noted that an epoxy-based resin is preferably used for the sealing material 3805. Further, it is preferable that these materials should not transmit moisture or oxygen as much as possible. As a material for the sealing substrate 3804, a glass substrate, a quartz substrate, a plastic substrate formed of FRP (Fiberglass-Reinforced Plastics), PVF (polyvinylfluoride), myler, polyester, acrylic, or the like can be used.

As described above, a display panel can be obtained. Note that the configuration described above is one example, and a configuration of a display panel of the invention is not limited to this. Note that a semiconductor device of the invention can be applied to a signal line driver circuit or a pixel of the display panel described in this embodiment mode.

As shown in FIGS. 38A and 38B, the cost of the display device can be reduced by forming the signal line driver circuit 3801, the pixel portion 3802, the first scan line driver circuit 3803, and the second scan line driver circuit 3806 over one substrate.

Figure 44B:
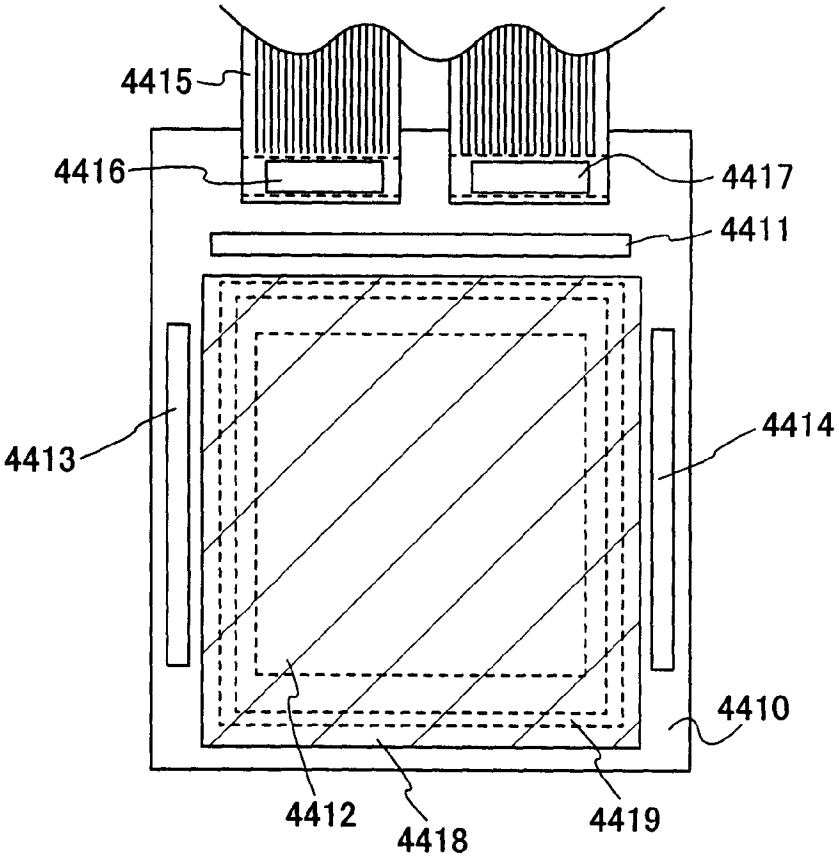
FIGS. 44A and 44B are views each showing a display panel.
Figure 44A:
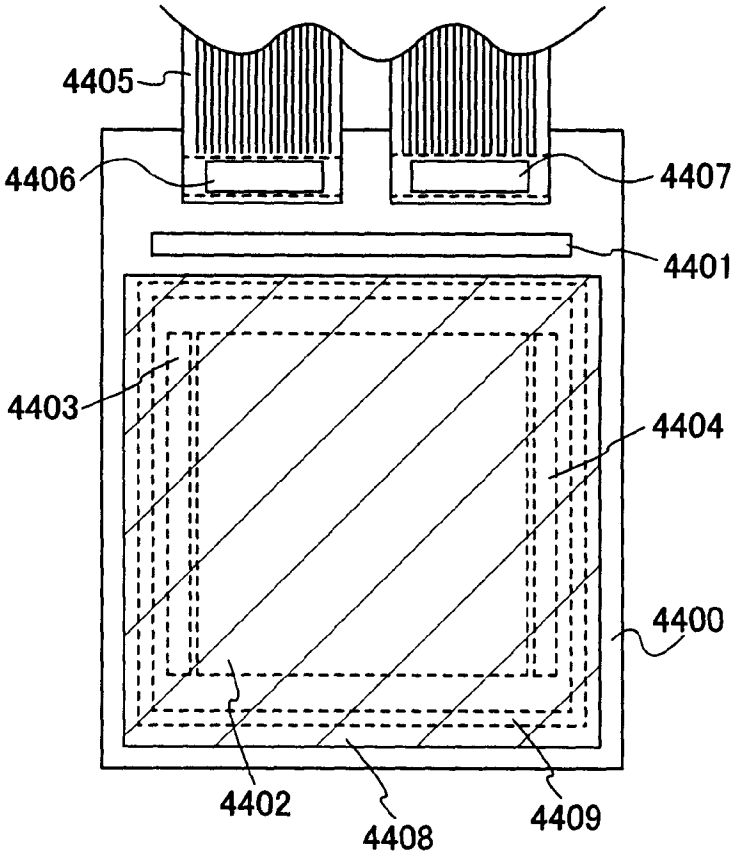

It is to be noted that the configuration of the display panel is not limited to the configuration shown in FIG. 38A where the signal line driver circuit 3801, the pixel portion 3802, the first scan line driver circuit 3803, and the second scan line driver circuit 3806 are formed over the same substrate, and a signal line driver circuit 4401 shown in FIG. 44A corresponding to the signal line driver circuit 3801 may be formed into an IC chip and mounted on the display panel by COG, or the like. It is to be noted that a substrate 4400, a pixel portion 4402, a first scan line driver circuit 4403, a second scan line driver circuit 4404, an FPC 4405, IC chips 4406 and 4407, a sealing substrate 4408, and a sealing material 4409 in FIG. 44A correspond to the substrate 3810, the pixel portion 3802, the first scan line driver circuit 3803, the second scan line driver circuit 3806, the FPC 3809, the IC chips 3819A and 3819B, the sealing substrate 3804, and the sealing material 3805 in FIG. 38A, respectively.

That is, only the signal line driver circuit which is required to operate at high speed is formed into an IC chip using a CMOS or the like, thereby lower power consumption is achieved. Further, by forming the IC chip into a semiconductor chip formed of a silicon wafer or the like, higher-speed operation and lower power consumption can be realized.

By forming the second scan line driver circuit 4403 and the first scan line driver circuit 4404 over the same substrate as the pixel portion 4402, cost reduction can be achieved.

In this manner, cost reduction of a high definition display device can be realized. Further, by mounting an IC chip including a functional circuit (memory or buffer) at a connecting portion of the FPC 4405 and the substrate 4400, a substrate area can be efficiently utilized.

Moreover, a signal line driver circuit 4411, a first scan line driver circuit 4414, and a second scan line driver circuit 4413 shown in FIG. 44B corresponding to the signal line driver circuit 3801, the first scan line driver circuit 3803, and the second scan line driver circuit 3806 shown in FIG. 38A may be formed into an IC chip and mounted on a display panel by COG or the like. In this case, lower power consumption of a high definition display device can be realized. Therefore, in order to obtain a display device with less power consumption, it is preferable to use polysilicon for a semiconductor layer of a transistor used in the pixel portion. It is to be noted that a substrate 4410, a pixel portion 4412, an FPC 4415, IC chips 4416 and 4417, a sealing substrate 4418, and a sealing material 4419 in FIG. 44B correspond to the substrate 3810, the pixel portion 3802, the FPC 3809, the IC chips 3819A and 3819B, the sealing substrate 3804, and the sealing material 3805 in FIG. 38A, respectively Further, by using amorphous silicon for a semiconductor layer of a transistor of the pixel portion 4412, further cost reduction can be achieved. Moreover, a large display panel can be manufactured.

Further, the second scan line driver circuit, the first scan line driver circuit, and the signal line driver circuit are not necessarily provided in a row direction and a column direction of the pixels. For example, as shown in FIG. 45A, a peripheral driver circuit 4501 formed in an IC chip may have functions of the first scan line driver circuit 4414, the second scan line driver circuit 4413, and the signal line driver circuit 4411 shown in FIG. 44B. It is to be noted that a substrate 4500, a pixel portion 4502, an FPC 4504, IC chips 4505 and 4506, a sealing substrate 4507, and a sealing material 4508 in FIG. 45A correspond to the substrate 3810, the pixel portion 3802, the FPC 3809, the IC chips 3819A and 3819B, the sealing substrate 3804, and the sealing material 3805 in FIG. 38A, respectively.

Figure 45B:
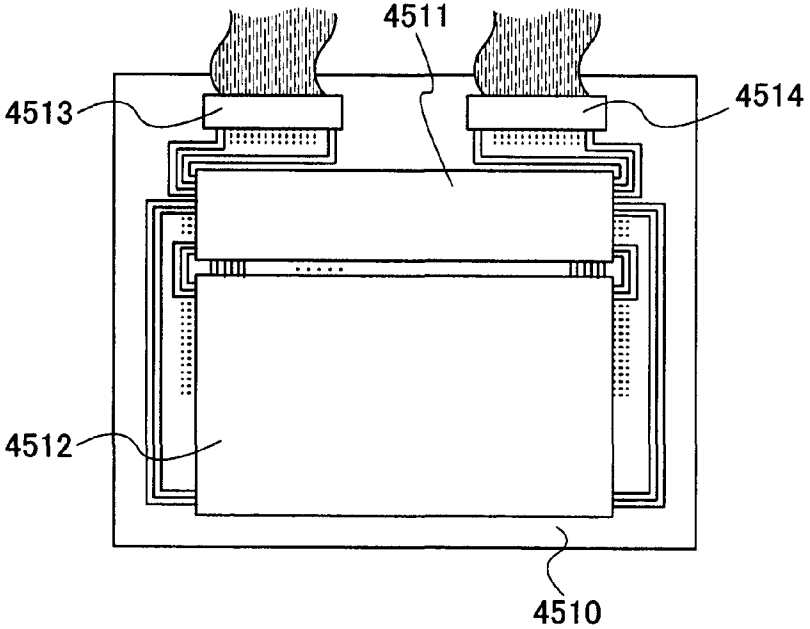
FIGS. 45A and 45B are views each showing a display panel.
Figure 45A:
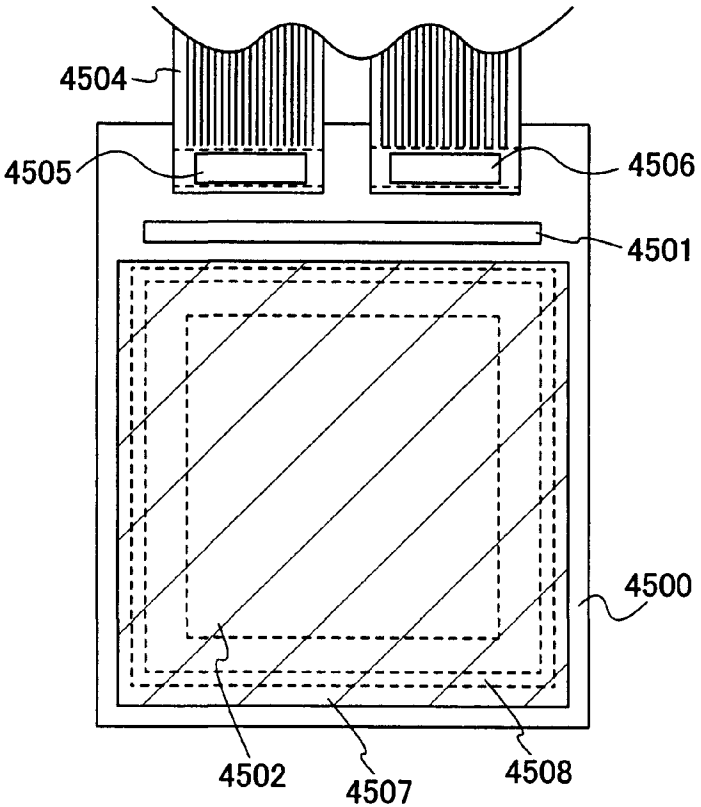

FIG. 45B shows a schematic diagram showing connections of wires of the display device shown in FIG. 45A. A substrate 4510, a peripheral driver circuit 4511, a pixel portion 4512, and FPCs 4513 and 4514 are provided. Signals and a power source potential are externally inputted from the FPC 4513 to the peripheral driver circuit 4511. An output from the peripheral driver circuit 4511 is inputted to wires in the row direction and wires in the column direction, which are connected to the pixels in the pixel portion 4512.

Figure 39A:
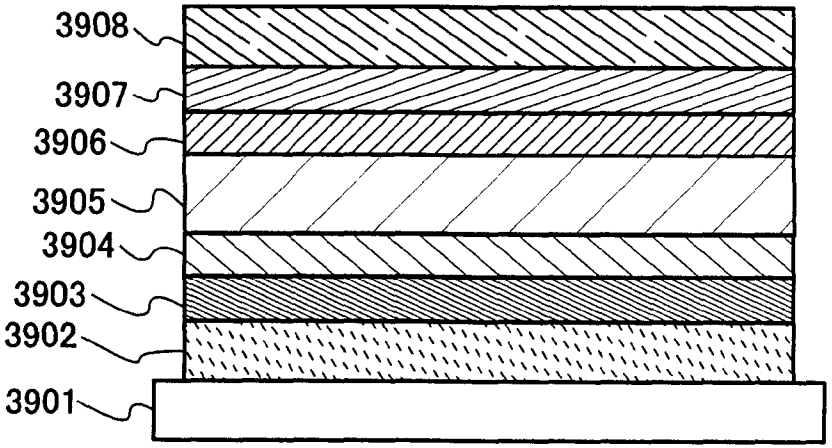
FIGS. 39A and 39B are views each showing a light emitting element which can be applied to a display device.
Figure 39B:
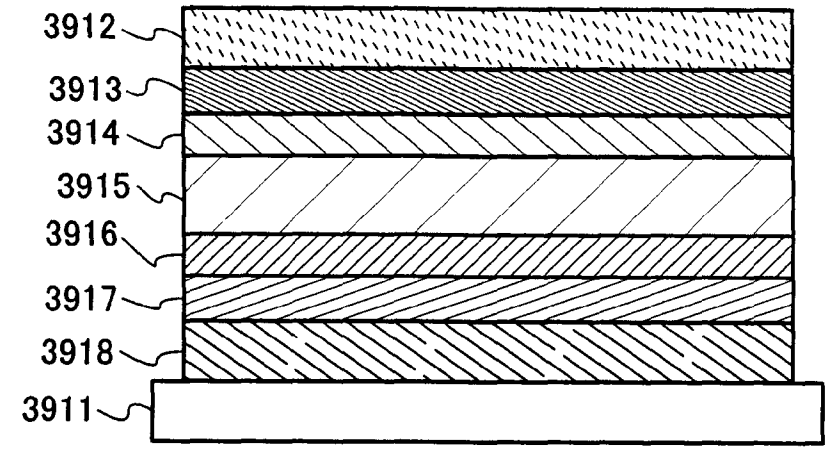

Further, FIGS. 39A and 39B show examples of a light emitting element which can be applied to the light emitting element 3818. That is, description is made of configurations of a light emitting element which can be applied to the pixels described in Embodiment Modes 1 to 4 with reference to FIGS. 39A and 39B.

In a light emitting element shown in FIG. 39A, an anode 3902, a hole injecting layer 3903 formed of a hole injecting material, a hole transporting layer 3904 formed of a hole transporting material, a light emitting layer 3905, an electron transporting layer 3906 formed of an electron transporting material, an electron injecting layer 3907 formed of an electron injecting material, and a cathode 3908 are stacked over a substrate 3901 in this order. Here, the light emitting layer 3905 may be formed of only one kind of light emitting material; however, it may also be formed of two or more kinds of materials. The configuration of the element of the invention is not limited to this.

In addition to the stacked layer structure shown in FIG. 39A where each functional layer is stacked, there are wide variations such as an element formed of a high molecular compound, a high efficiency element which utilizes a triplet light emitting material which emits light from a triplet excitation state in a light emitting layer. It is also possible to apply to a white light emitting element which can be obtained by dividing a light emitting region into two regions by controlling a recombination region of carriers using a hole blocking layer, and the like.

The element of the invention shown in FIG. 39A can be formed by sequentially vapor-depositing a hole injecting material, a hole transporting material, and a light emitting material over the substrate 3901 having the anode 3902 (indium tin oxide: ITO). Next, an electron transporting material and an electron injecting material are vapor-deposited, and finally the cathode 3908 is vapor-deposited.

Materials suitable for the hole injecting material, the hole transporting material, the electron transporting material, the electron injecting material, and the light emitting material are as follows.

As the hole injecting material, an organic compound such as a porphyrin-based compound, a phthalocyanine (hereinafter referred to as "$H_2Pc$"), copper phthalocyanine (hereinafter referred to as "CuPc"), or the like is effective. Further, a material that has a smaller value of an ionization potential than that of the hole transporting material to be used and has a hole transporting function can also be used as the hole injecting material. There is also a material obtained by chemically doping a conductive high molecular compound, which includes polyaniline and polyethylene dioxythiophene (hereinafter referred to as "PEDOT") doped with polystyrene sulfonate (hereinafter referred to as "PSS"). Also, a high molecular compound of an insulator is effective in terms of planarization of an anode, and polyimide (hereinafter referred to as "PI") is often used. Further, an inorganic compound is also used, which includes an extra-thin film of aluminum oxide (hereinafter referred to as "alumina") in addition to a thin film of a metal such as gold or platinum.

It is an aromatic amine-based (that is, one having a bond of benzene ring-nitrogen) compound that is most widely used as the hole transporting material. A material that is widely used includes 4,4'-bis(diphenylamino)-biphenyl (hereinafter referred to as "TAD"), derivatives thereof such as 4,4'-bis[N-(3-methylphenyl)-N-phenyl-amino]-biphenyl (hereinafter referred to as "TPD"), 4,4'-bis[N-(1-naphthyl)-N-phenyl-amino]-biphenyl (hereinafter referred to as "α-NPD"), and star burst aromatic amine compounds such as 4,4',4"-tris(N, N-diphenyl-amino)-triphenylamine (hereinafter referred to as "TDATA") and 4,4',4"-tris[N-(3-methylphenyl)-N-phenyl-amino]-triphenylamine (hereinafter referred to as "MTDATA").

As the electron transporting material, a metal complex is often used, which includes a metal complex having a quinoline skeleton or a benzoquinoline skeleton such as $Alq_3$, BAlq, tris(4-methyl-8-quinolinolato)aluminum (hereinafter referred to as "Almq"), or bis(10-hydroxybenzo[h]-quinolinato)beryllium (hereinafter referred to as "BeBq"), and in addition, a metal complex having an oxazole-based or a thiazole-based ligand such as bis[2-(2-hydroxyphenyl)-benzoxazolato]zinc (hereinafter referred to as "$Zn(BOX)_2$") or bis [2-(2-hydroxyphenyl)-benzothiazolato]zinc (hereinafter referred to as "$Zn(BTZ)_2$"). Further, in addition to the metal complexes, oxadiazole derivatives such as 2-(4-biphenylyl)-5-(4-tert-butylphenyl)-1,3,4-oxadiazole (hereinafter referred to as "PBD") and OXD-7, triazole derivatives such as TAZ and 3-(4-tert-butylphenyl)-4-(4-ethylphenyl)-5-(4-biphenylyl)-2,3,4-triazole (hereinafter referred to as "p-EtTAZ"), and phenanthroline derivatives such as bathophenanthroline (hereinafter referred to as "BPhen") and BCP have an electron transporting property.

As the electron injecting material, the above-mentioned electron transporting materials can be used. In addition, an extra-thin film of an insulator, for example, metal halide such as calcium fluoride, lithium fluoride, or cesium fluoride, alkali metal oxide such as lithium oxide, or the like is often used. Further, an alkali metal complex such as lithium acetyl acetonate (hereinafter referred to as "Li(acac)") or 8-quinolinolato-lithium (hereinafter referred to as "Liq") is also effective.

As the light emitting material, in addition to the above-mentioned metal complexes such as $Alq_3$, Almq, BeBq, BAlq, $Zn(BOX)_2$, and $Zn(BTZ)_2$, various fluorescent pigments are effective. The fluorescent pigments include 4,4'-bis (2,2-diphenyl-vinyl)-biphenyl, which is blue, and 4-(dicyanomethylene)-2-methyl-6-(p-dimethylaminostyryl)-4H-pyran, which is red-orange, and the like. Also, a triplet light emitting material is available, which mainly includes a complex with platinum or iridium as a central metal. As the triplet light emitting material, tris(2-phenylpyridine)iridium, bis(2-(4'-tryl)pyridinato-N,$C^{2'}$)acetylacetonato iridium (hereinafter referred to as "acaclr(tpy)$_2$"), 2,3,7,8,12,13,17,18-octaethyl-21H,23Hporphyrin-platinum, and the like are known.

By using the materials each having a function as described above in combination, a highly reliable light emitting element can be formed.

A light emitting element in which layers are formed in a reverse order to that of FIG. 39A can be used as shown in FIG. 39B. That is, a cathode 3918, an electron injecting layer 3917 formed of an electron injecting material, an electron transporting layer 3916 formed of an electron transporting material, a light emitting layer 3915, a hole transporting layer 3914 formed of a hole transporting material, a hole injecting layer 3913 formed of a hole injecting material, and an anode 3912 are stacked in this order over a substrate 3911.

In addition, in order to extract light emission of a light emitting element, at least one of an anode and a cathode is required to transmit light. A TFT and a light emitting element are formed over a substrate; and there are light emitting elements having a top emission structure where light emission is taken out through a surface opposite to the substrate, having a bottom emission structure where light emission is taken out through a surface on the substrate side, and having a dual emission structure where light emission is taken out through a surface opposite to the substrate and a surface on the substrate side respectively. The pixel configuration of the invention can be applied to the light emitting element having any emission structure.

Figure 40A:
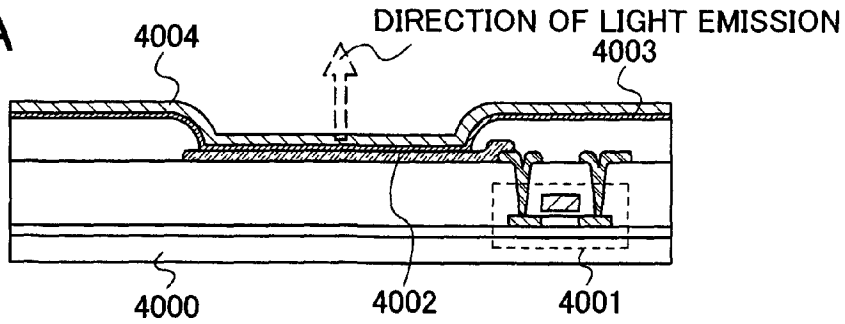
FIGS. 40A to 40C are views showing a display panel.

Description is made of a light emitting element with a top emission structure with reference to FIG. 40A.

A driving TFT 4001 is formed over a substrate 4000 and a first electrode 4002 is formed in contact with a source electrode of the driving TFT 4001, over which a layer 4003 containing an organic compound and a second electrode 4004 are formed.

Further, the first electrode 4002 is an anode of a light emitting element. The second electrode 4004 is a cathode of the light emitting element. That is, a region where the layer 4003 containing an organic compound is interposed between the first electrode 4002 and the second electrode 4004 corresponds to the light emitting element.

Further, as a material used for the first electrode 4002 which functions as an anode, a material having a high work function is preferably used. For example, a single layer of a titanium nitride film, a chromium film, a tungsten film, a Zn film, a Pt film, or the like, a stacked layer of a titanium nitride film and a film containing aluminum as a main component, a stacked layer of three layers of a titanium nitride film, a film containing aluminum as a main component, and a titanium nitride film, or the like can be used. With a stacked layer structure, the resistance as a wire is low, a preferable ohmic contact can be obtained, and further a function as an anode can be obtained. By using a metal film which reflects light, an anode which does not transmit light can be formed.

As a material used for the second electrode 4004 which functions as a cathode, a stacked layer of a metal thin film formed of a material having a low work function (Al, Ag, Li, Ca, or an alloy thereof such as MgAg, MgIn, AlLi, $CaF_2$, or calcium nitride) and a light-transmissive conductive film (of indium tin oxide (ITO), indium zinc oxide (IZO), zinc oxide (ZnO), or the like) is preferably used. By using a metal thin film and a light-transmissive conductive film in this manner, a cathode which can transmit light can be formed.

In this manner, light from the light emitting element can be extracted to the top surface as shown by an arrow in FIG. 40A. That is, in the case of applying to the display panel shown in FIG. 38A, light is emitted to the sealing substrate 3804 side. Therefore, in the case of using a light emitting element with a top emission structure to a display device, a substrate which transmits light is used as the sealing substrate 3804.

In the case of providing an optical film, an optical film may be provided over the sealing substrate 3804.

Note that a metal film formed of a material which functions as a cathode and has a low work function, such as MgAg, MgIn, or AlLi can be used for the first electrode 4002. For the second electrode 4004, a light-transmissive film such as an ITO (indium tin oxide) film or an indium zinc oxide (IZO) film can be used. Accordingly, with this structure, the transmittance of the top light emission can be improved.

Figure 40B:
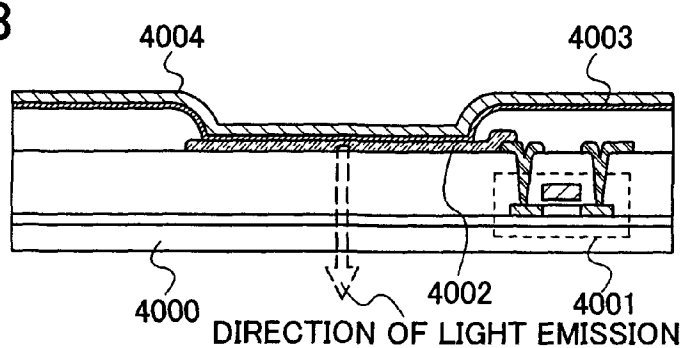

Further, description is made with reference to FIG. 40B of a light emitting element with a bottom emission structure. The same reference numerals as those in FIG. 40A are used since the structures are the same except for the light emission structure.

Here, as a material used for the first electrode 4002 which functions as an anode, a material having a high work function is preferably used. For example, a light-transmissive film such as an indium tin oxide (ITO) film or an indium zinc oxide (IZO) film can be used. By using a light-transmissive conductive film, an anode which can transmit light can be formed.

As a material used for the second electrode 4004 which functions as a cathode, a metal film formed of a material having a low work function (Al, Ag, Li, Ca, or an alloy thereof such as MgAg, MgIn, AlLi, $CaF_2$, or calcium nitride) can be used. By using a metal film which reflects light, a cathode which does not transmit light can be formed.

In this manner, light from the light emitting element can be extracted to a bottom surface as shown by an arrow in FIG. 40B. That is, in the case of applying to the display panel shown in FIGS. 38A and 38B, light is emitted to the substrate 3810 side. Therefore, in the case of using a light emitting element with a bottom emission structure to a display device, a substrate which transmits light is used as the substrate 3810.

In the case of providing an optical film, an optical film may be provided over the substrate 3810.

Figure 40C:
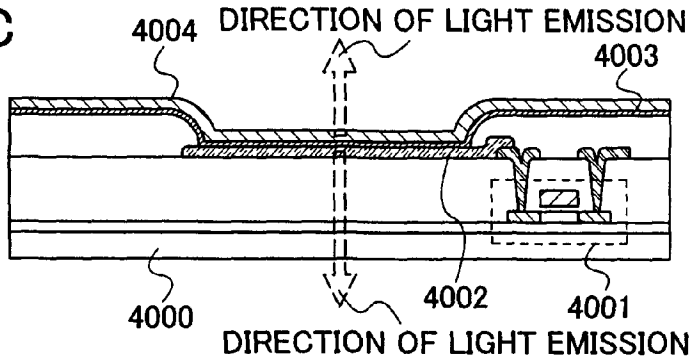

Description is made of a light emitting element with a dual emission structure with reference to FIG. 40C. The same reference numerals as those in FIG. 40A are used since the structures are the same except for the light emission structure.

Here, as a material used for the first electrode 4002 which functions as an anode, a material having a high work function is preferably used. For example, a light-transmissive film such as an ITO (indium tin oxide) film or an indium zinc oxide (IZO) film can be used. By using a light-transmissive conductive film, an anode which can transmit light can be formed.

As a material used for the second electrode 4004 which functions as a cathode, a stacked layer of a metal thin film formed of a material having a low work function (Al, Ag, Li, Ca, or an alloy thereof such as MgAg, MgIn, AlLi, $CaF_2$, or calcium nitride), and a light-transmissive conductive film (ITO (indium tin oxide), indium oxide zinc oxide ($In_2O_3$—ZnO) alloy, zinc oxide (ZnO), or the like) is preferably used. By using a metal thin film and a light-transmissive conductive film in this manner, a cathode which can transmit light can be formed.

In this manner, light from the light emitting element can be extracted to the both surfaces as shown by arrows of FIG. 40C. That is, in the case of applying to the display panel shown in FIGS. 38A and 38B, light is emitted to the substrate 3810 side and the sealing substrate 3804 side. Therefore, in the case of applying a light emitting element with a dual emission structure to a display device, a substrate which can transmit light is used as the substrate 3810 and the sealing substrate 3804.

In the case of providing an optical film, optical films may be provided over both the substrate 3810 and the sealing substrate 3804.

The invention can also be applied to a display device which realizes full color display by using a white light emitting element and a color filter.

Figure 41:
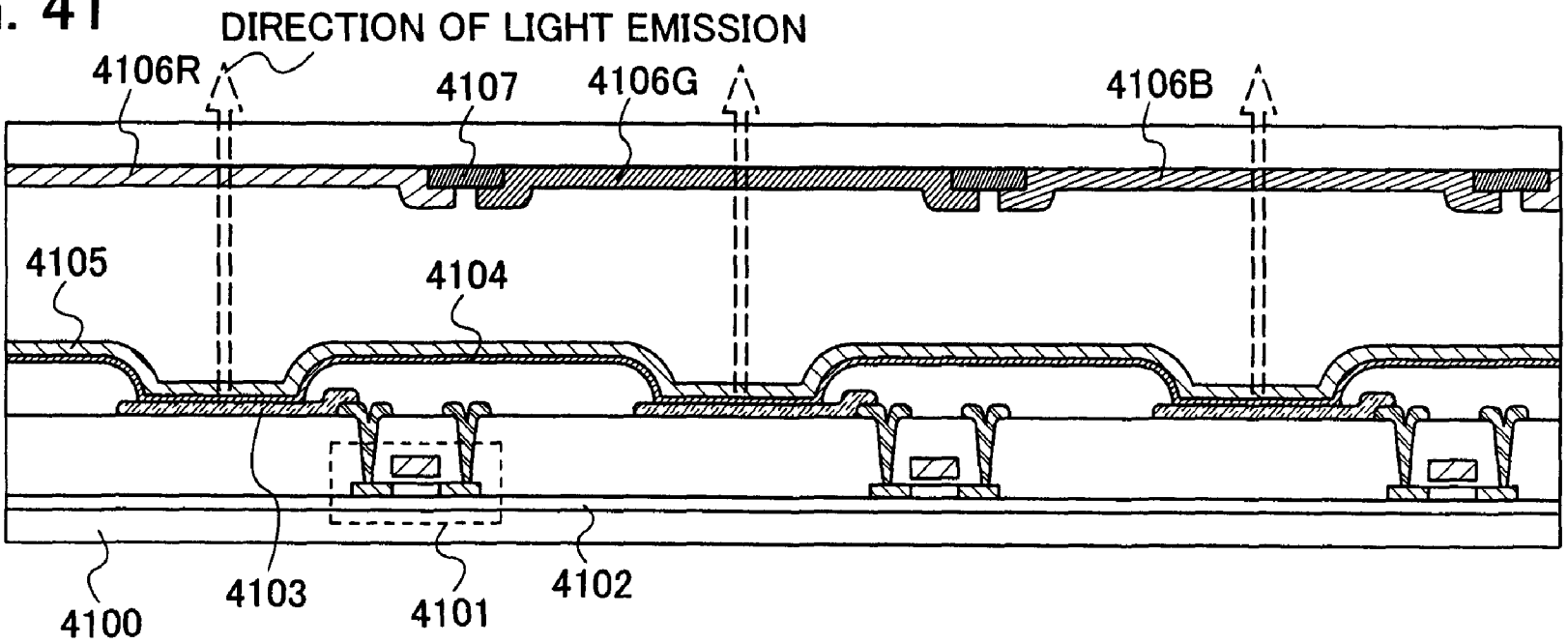
FIG. 41 is a view showing a display panel.

As shown in FIG. 41, a base film 4102 is formed over a substrate 4100 and a driving TFT 4101 is formed thereover. A first electrode 4103 is formed in contact with a source electrode of the driving TFT 4101 and a layer 4104 containing an organic compound and a second electrode 4105 are formed thereover.

The first electrode 4103 is an anode of a light emitting element. The second electrode 4105 is a cathode of the light emitting element. That is, a region where the layer 4104 containing an organic compound is interposed between the first electrode 4103 and the second electrode 4105 corresponds to the light emitting element. In the configuration shown in FIG. 41, white light is emitted. A red color filter 4106R, a green color filter 4106G, and a blue color filter 4106B are provided over the light emitting element, thereby full color display can be performed. Further, a black matrix (also referred to as BM) 4107 for separating these color filters is provided.

The aforementioned configurations of the light emitting element can be used in combination and can be appropriately used for the display device having the pixel configuration of the invention. The configurations of the display panel and the light emitting elements which are described above are examples and it is needless to say that the pixel configuration of the invention can be applied to display devices having other configurations.

Next, a partial cross-sectional view of a pixel portion of a display panel is described.

First, description is made with reference to FIGS. 42A and 42B and FIGS. 43A and 43B of the case of using a crystalline semiconductor film (polysilicon (p-Si:H) film) as a semiconductor layer of a transistor.

Here, the semiconductor layer is obtained by, for example, forming an amorphous silicon (a-Si) film over a substrate by a known film deposition method. Note that the semiconductor film is not limited to the amorphous silicon film, and any semiconductor film having an amorphous structure (including a microcrystalline semiconductor film) may be used. Further, a compound semiconductor film having an amorphous structure, such as an amorphous silicon germanium film may be used.

Then, the amorphous silicon film is crystallized by laser crystallization, thermal crystallization using RTA or an annealing furnace, thermal crystallization using a metal element which promotes crystallization, or the like. Needless to say, such crystallization may be performed in combination.

As a result of the aforementioned crystallization, a crystallized region is formed in a part of the amorphous semiconductor film.

In addition, the crystalline semiconductor film having a partially increased crystallinity is patterned into a desired shape, and an island-shaped semiconductor film is formed with the crystallized region. This semiconductor film is used as the semiconductor layer of the transistor. Note that patterning is to process a film shape, which means forming a film pattern by a photolithography technique (including forming contact hole in photosensitive acrylic and processing photosensitive acrylic so as to be a spacer), forming a mask pattern by a photolithography technique and etching with the use of the mask pattern, or the like.

Figure 42A:
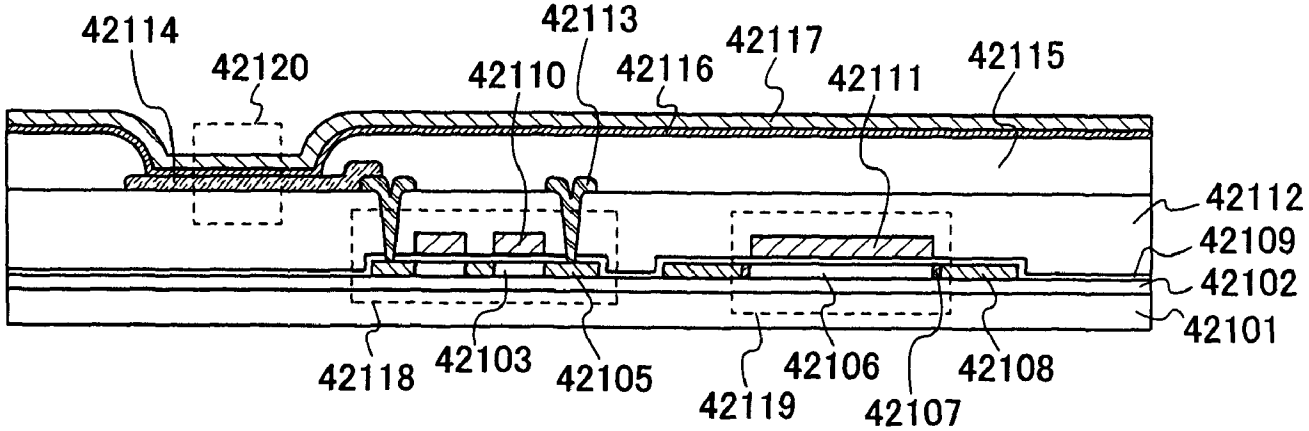
FIGS. 42A and 42B are views each showing a configuration of a transistor and a capacitor which can be applied to a pixel.
Figure 42B:
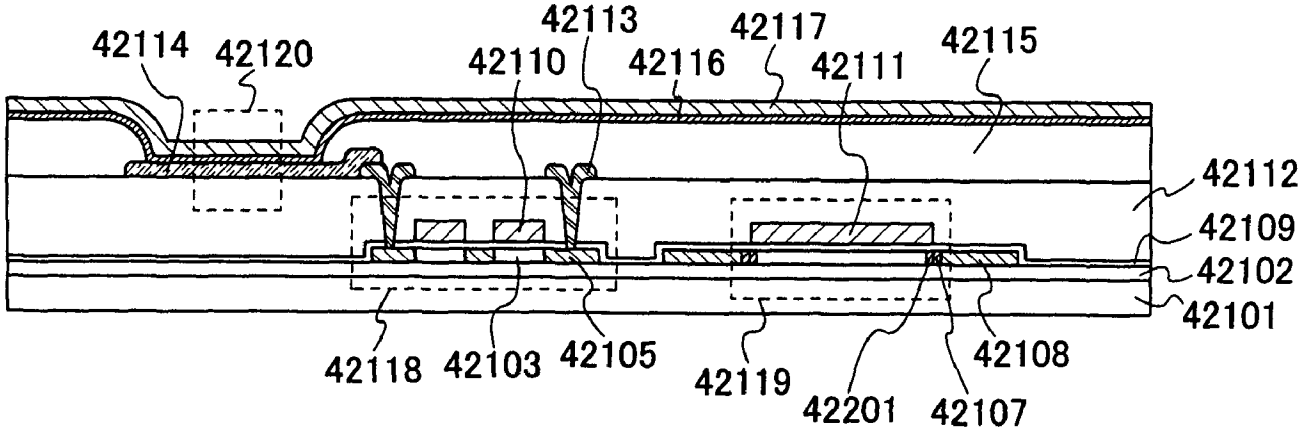

As shown in FIGS. 42A and 42B, a base film 42102 is formed over a substrate 42101, and a semiconductor layer is formed thereover. The semiconductor layer includes a channel forming region 42103 and an impurity region 42105 functioning as a source or drain region, which are in a driving transistor 42118, and a channel forming region 42106, an LDD region 42107, and an impurity region 42108 functioning as a lower electrode, which are in a capacitor 42119. Note that channel doping may be performed to the channel forming regions 42103 and 42106.

As the substrate, a glass substrate, a quartz substrate, a ceramic substrate, a plastic substrate, or the like can be used. The base film 42102 can be formed using a single layer of aluminum nitride (AlN), silicon oxide ($SiO_2$), silicon oxynitride ($SiO_xN_y$), or the like, or stacked layers thereof.

A gate electrode 42110 and an upper electrode 42111 of the capacitor are formed over the semiconductor layer with a gate insulating film 42109 interposed therebetween.

An interlayer insulating film 42112 is formed so as to cover the driving transistor 42118 and the capacitor 42119. Then, a contact hole is formed in the interlayer insulating film 42112, through which a wire 42113 is in contact with the impurity region 42105. A pixel electrode 42114 is formed in contact with the wire 42113, and an interlayer insulator 42115 is formed so as to cover end portions of the pixel electrode 42114 and the wire 42113. Here, the interlayer insulator 42115 is formed using a positive photosensitive acrylic resin film. Then, a layer 42116 containing an organic compound and a counter electrode 42117 are formed over the pixel electrode 42114. Thus, a light emitting element 42120 corresponds to a region where the layer 42116 containing an organic compound is interposed between the pixel electrode 42114 and the counter electrode 42117.

In addition, as shown in FIG. 42B, a region 42201 may be provided so as to overlap the upper electrode 42111 in the LDD region which forms a part of the lower electrode of the capacitor 42119. Note that common portions to those in FIG. 42A are denoted by the same reference numerals, and description thereof is omitted.

Figure 43A:
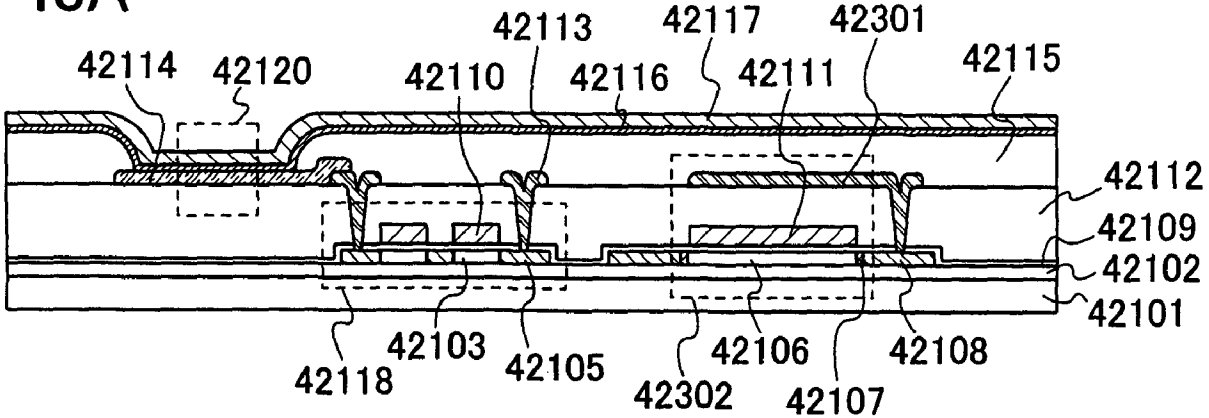
FIGS. 43A and 43B are views each showing a configuration of a transistor and a capacitor which can be applied to a pixel.

In addition, as shown in FIG. 43A, a second upper electrode 42301 may be provided, which is formed in the same layer as the wire 42113 in contact with the impurity region 42105 of the driving transistor 42118. Note that common portions to those in FIG. 42A are denoted by the same reference numerals, and description thereof is omitted. A second capacitor is formed by interposing the interlayer insulating film 42112 between the second upper electrode 42301 and the upper electrode 42111. In addition, since the second upper electrode 42301 is in contact with the impurity region 42108, a first capacitor having such a configuration that the gate insulating film 42109 is interposed between the upper electrode 42111 and the channel forming region 42106, and the second capacitor having such a configuration that the interlayer insulating film 42112 is interposed between the upper electrode 42111 and the second upper electrode 42301 are connected in parallel, so that a capacitor 42302 having the first and second capacitors is obtained. Since the capacitor 42302 has a total capacitance of those of the first and second capacitors, the capacitor having a large capacitance can be formed in a small area. That is, using the capacitor in the pixel configuration of the invention will lead to a further improved aperture ratio.

Figure 43B:
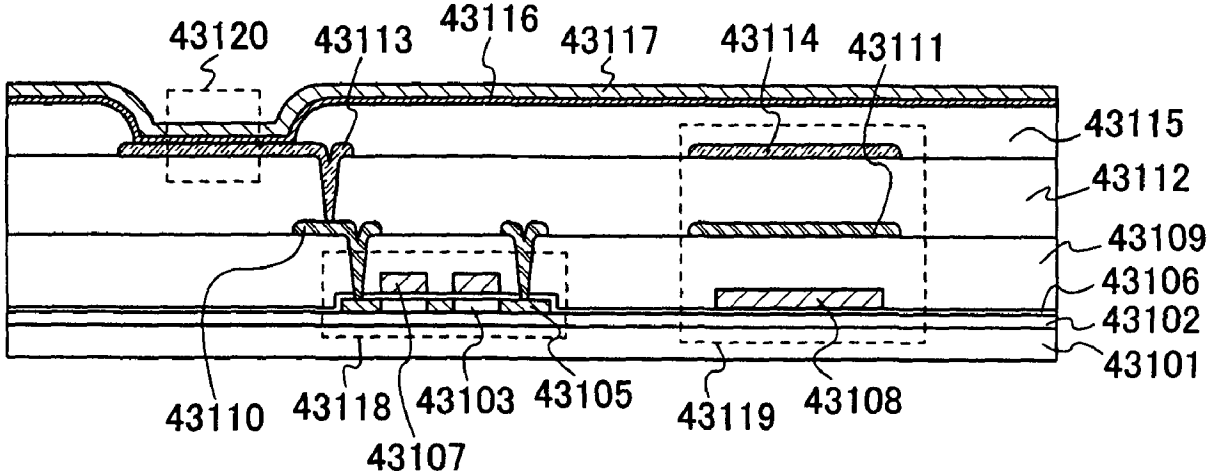

Alternatively, a configuration of a capacitor as shown in FIG. 43B may be adopted. A base film 43102 is formed over a substrate 43101, and a semiconductor layer is formed thereover. The semiconductor layer includes a channel forming region 43103 and an impurity region 43105 to function as a source or drain region of a driving transistor 43118. Note that channel doping may be performed to the channel forming region 43103.

As the substrate, a glass substrate, a quartz substrate, a ceramic substrate, a plastic substrate, or the like can be used. The base film 43102 can be formed using a single layer of aluminum nitride (AlN), silicon oxide ($SiO_2$), silicon oxynitride ($SiO_xN_y$), or the like or stacked layers thereof.

A gate electrode 43107 and a first electrode 43108 are formed over the semiconductor layer with a gate insulating film 43106 interposed therebetween.

A first interlayer insulating film 43109 is formed so as to cover the driving transistor 43118 and the first electrode 43108. Then, a contact hole is formed in the first interlayer insulating film 43109, through which a wire 43110 is in contact with the impurity region 43105. In addition, a second electrode 43111 is formed in the same layer and with the same material as the wire 43110.

Furthermore, a second interlayer insulating film 43112 is formed so as to cover the wire 43110 and the second electrode 43111. Then, a contact hole is formed in the second interlayer insulating film 43112, through which a pixel electrode 43113 is formed in contact with the wire 43110. A third electrode 43114 is formed in the same layer and with the same material as the pixel electrode 43113. Here, a capacitor 43119 is formed of the first electrode 43108, the second electrode 43111, and the third electrode 43114.

An insulating film 43115 is formed so as to cover an end portion of the pixel electrode 43113 and the third electrode 43114, over which a layer 43116 containing an organic compound and a counter electrode 43117 are formed. Then, a light emitting element 43120 corresponds to a region where the layer 43116 containing an organic compound is interposed between the pixel electrode 43113 and the counter electrode 43117.

As described above, each of the configurations shown in FIGS. 42A and 42B and FIGS. 43A and 43B can be given as a configuration of a transistor using a crystalline semiconductor film for its semiconductor layer. Note that the transistors having the configurations shown in FIGS. 42A and 42B and FIGS. 43A and 43B are examples of transistors with a top-gate structure. That is, the transistor may be either a p-channel transistor or an n-channel transistor. In the case where the transistor is an n-channel transistor, the LDD region may be formed either so as to overlap the gate electrode or not to overlap, or to partially overlap the gate electrode. Further, the gate electrode may have a tapered shape and the LDD region may be provided below the tapered portion of the gate electrode in a self-aligned manner. In addition, the number of gate electrodes is not limited to two, and a multi-gate structure with three or more gate electrodes may be employed, or a single gate structure may also be employed.

Figure 46A:
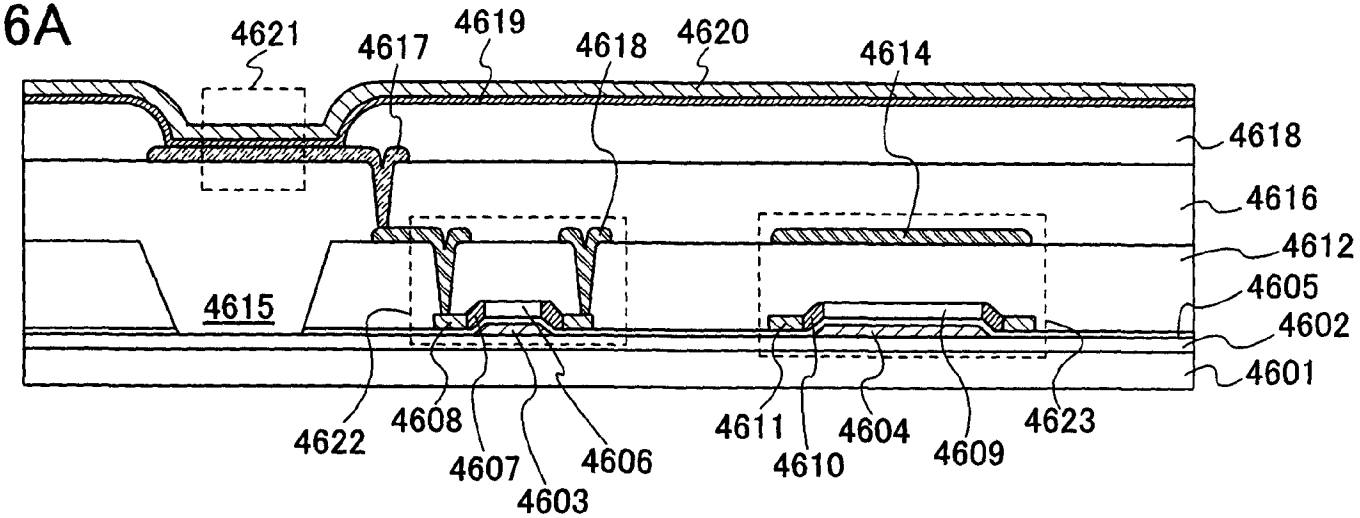
FIGS. 46A and 46B are views each showing a configuration of a transistor and a capacitor which can be applied to a pixel.

Next, as a configuration of a transistor which uses polysilicon (p-Si:H) for its semiconductor layer, FIG. 46A shows a partial cross-sectional view of a display panel using a transistor which has a configuration where a gate electrode is interposed between a substrate and a semiconductor layer, that is, a transistor with a bottom-gate structure where a gate electrode is located below a semiconductor layer.

A base film 4602 is formed over a substrate 4601. Then, a gate electrode 4603 is formed over the base film 4602. A first electrode 4604 is formed in the same layer and with the same material as the gate electrode. As a material of the gate electrode 4603, polycrystalline silicon to which phosphorus is added can be used. Besides polycrystalline silicon, silicide which is a compound of metal and silicon may be used.

Then, a gate insulating film 4605 is formed so as to cover the gate electrode 4603 and the first electrode 4604. As the gate insulating film 4605, a silicon oxide film, a silicon nitride film, or the like is used.

A semiconductor layer is formed over the gate insulating film 4605. The semiconductor layer includes a channel forming region 4606, an LDD region 4607, and an impurity region 4608 functioning as a source or drain region, which are in a driving transistor 4622, and a channel forming region 4609, an LDD region 4610, and an impurity region 4611, which function as a second electrode of a capacitor 4623. Note that channel doping may be performed to the channel forming regions 4606 and 4609.

As the substrate, a glass substrate, a quartz substrate, a ceramic substrate, a plastic substrate, or the like can be used. The base film 4602 can be formed using a single layer of aluminum nitride (AlN), silicon oxide ($SiO_2$), silicon oxynitride ($SiO_xN_y$), or the like or stacked layers thereof.

A first interlayer insulating film 4612 is formed so as to cover the semiconductor layer. Then, a contact hole is formed in the first interlayer insulating film 4612, through which a wire 4613 is in contact with the impurity region 4608. A third electrode 4614 is formed in the same layer and with the same material as the wire 4613. The capacitor 4623 is formed with the first electrode 4604, the second electrode, and the third electrode 4614.

In addition, an opening portion 4615 is formed in the first interlayer insulating film 4612. A second interlayer insulating film 4616 is formed so as to cover the driving transistor 4622, the capacitor 4623, and the opening portion 4615. Then, a contact hole is formed in the second interlayer insulating film 4616, through which a pixel electrode 4617 is formed. Then, an insulating film 4618 is formed so as to cover end portions of the pixel electrode 4617. For example, a positive photosensitive acrylic resin film can be used. Subsequently, a layer 4619 containing an organic compound and a counter electrode 4620 are formed over the pixel electrode 4617. Thus, a light emitting element 4621 corresponds to a region where the layer 4619 containing an organic compound is interposed between the pixel electrode 4617 and the counter electrode 4620. The opening portion 4615 is located below the light emitting element 4621. That is, in the case where light emitted from the light emitting element 4621 is extracted from the substrate side, the transmittance can be improved due to the existence of the opening portion 4615.

Figure 46B:
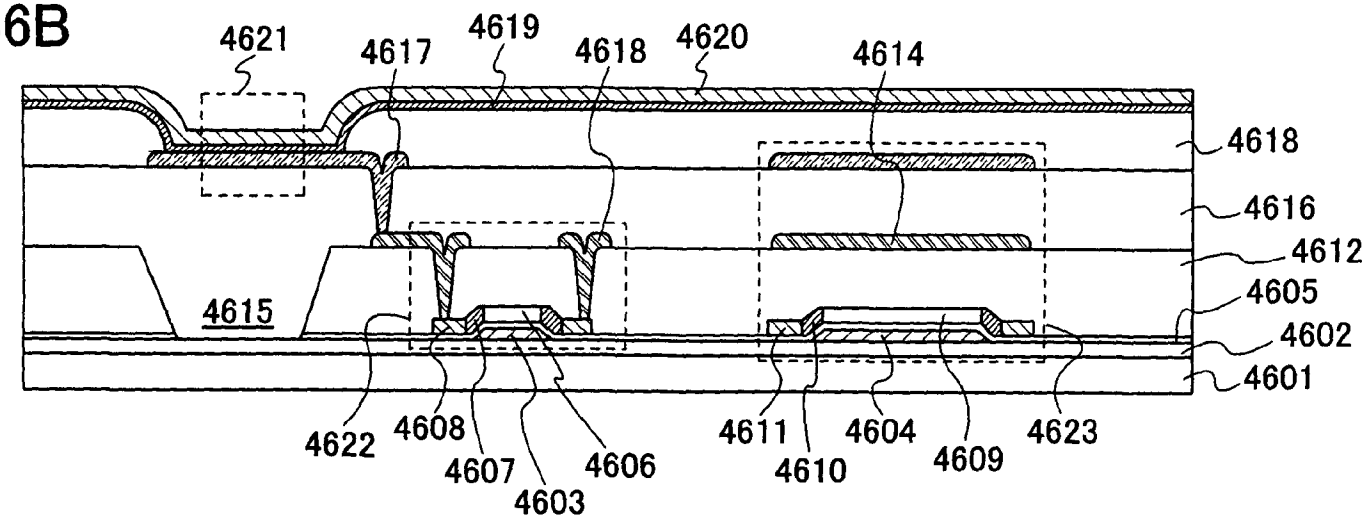

Furthermore, a fourth electrode 4624 may be formed in the same layer and with the same material as the pixel electrode 4617 in FIG. 46A so as to obtain a configuration shown in FIG. 46B. In this case, a capacitor 4625 can be formed with the first electrode 4604, the second electrode, the third electrode 4614, and the fourth electrode 4624.

Figure 47A:
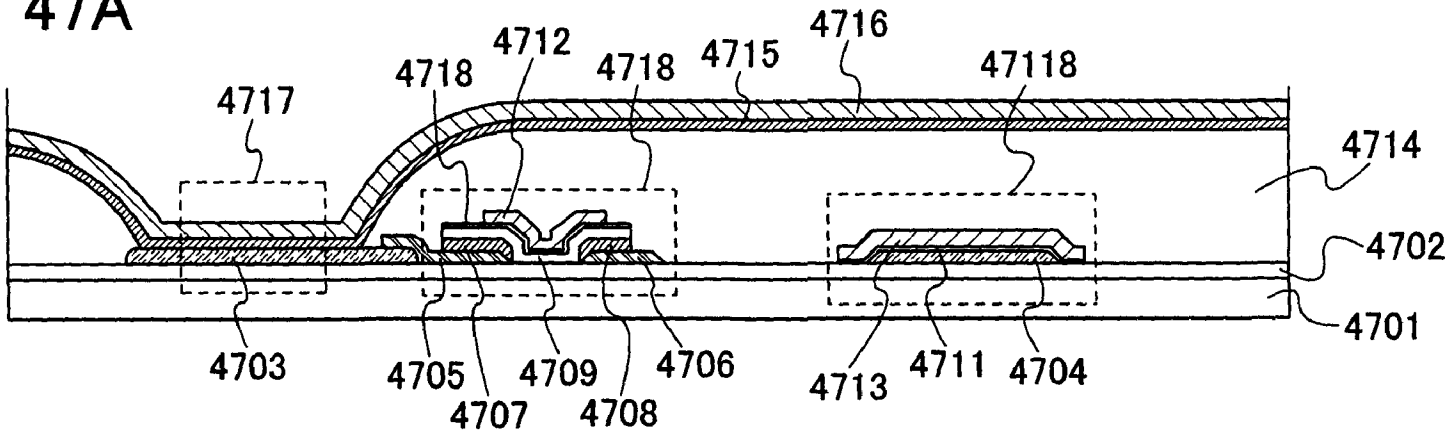
FIGS. 47A and 47B are views each showing a configuration of a transistor and a capacitor which can be applied to a pixel.
Figure 47B:
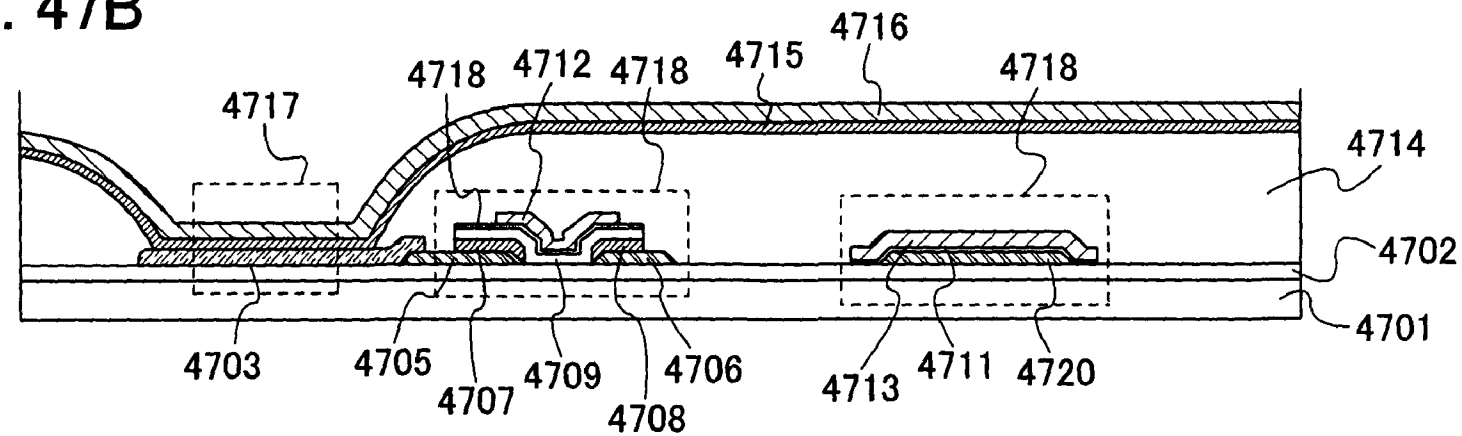

Next, description is made of the case of using an amorphous silicon (a-Si:H) film as a semiconductor layer of a transistor. FIGS. 47A and 47B show cases of a top-gate transistor, and FIGS. 48A, 48B, 49A, and 49B show cases of a bottom-gate transistor.

FIG. 47A shows a cross sectional view of a transistor having a forward staggered structure, which uses amorphous silicon for its semiconductor layer. A base film 4702 is formed over a substrate 4701. Further, a pixel electrode 4703 is formed over the base film 4702. In addition, a first electrode 4704 is formed in the same layer and with the same material as the pixel electrode 4703.

As the substrate, a glass substrate, a quartz substrate, a ceramic substrate, a plastic substrate, or the like can be used. The base film 4702 can be formed using a single layer of aluminum nitride (AlN), silicon oxide ($SiO_2$), silicon oxynitride ($SiO_xN_y$), or the like or stacked layers thereof.

Wires 4705 and 4706 are formed over the base film 4702, and an end portion of the pixel electrode 4703 is covered with the wire 4705. N-type semiconductor layers 4707 and 4708 each having N-type conductivity are formed over the wires 4705 and 4706 respectively. In addition, a semiconductor layer 4709 is formed between the wires 4705 and 4706 and over the base film 4702, which is partially extended so as to cover the N-type semiconductor layers 4707 and 4708. Note that this semiconductor layer is formed with an amorphous semiconductor film such as an amorphous silicon (a-Si:H) film or a microcrystalline semiconductor (μ-Si:H) film. Then, a gate insulating film 4710 is formed over the semiconductor layer 4709, and an insulating film 4711 is formed in the same layer and with the same material as the gate insulating film 4710, and also over the first electrode 4704. Note that as the gate insulating film 4710, a silicon oxide film, a silicon nitride film, or the like is used.

A gate electrode 4712 is formed over the gate insulating film 4710. In addition, a second electrode 4713 is formed in the same layer and with the same material as the gate electrode, and over the first electrode 4704 with the insulating film 4711 interposed therebetween. A capacitor 4719 corresponds to a region where the insulating film 4711 is interposed between the first electrode 4704 and the second electrode 4713. An interlayer insulating film 4714 is formed so as to cover end portions of the pixel electrode 4703, the driving transistor 4718, and the capacitor 4719.

A layer 4715 containing an organic compound and a counter electrode 4716 are formed over the interlayer insulating film 4714 and the pixel electrode 4703 located in an opening portion of the interlayer insulating film 4714. Thus, a light emitting element 4717 corresponds to a region where the layer 4715 containing an organic compound is interposed between the pixel electrode 4703 and the counter electrode 4716.

The first electrode 4704 shown in FIG. 47A may be formed like a first electrode 4720 as shown in FIG. 47B. The first electrode 4720 is formed in the same layer and with the same material as the wires 4705 and 4706.

Figure 48A:
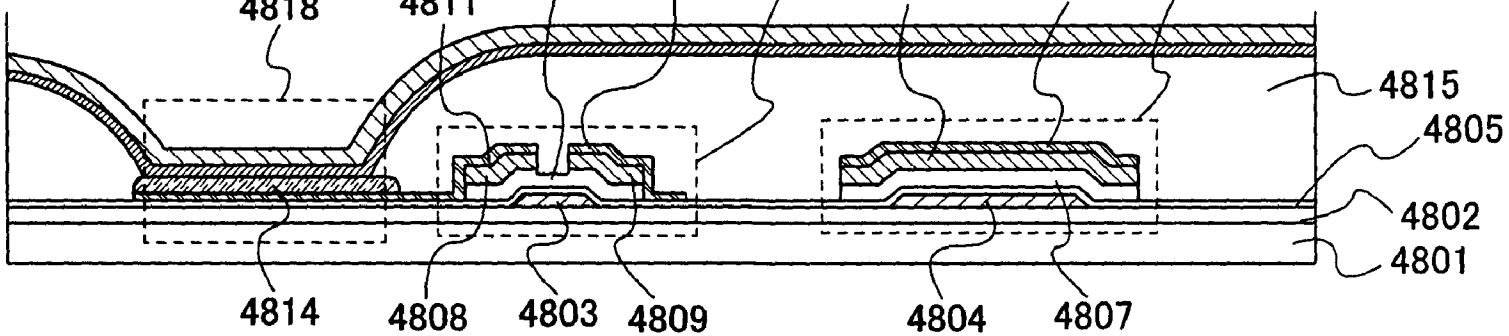
FIGS. 48A and 48B are views each showing a configuration of a transistor and a capacitor which can be applied to a pixel.
Figure 48B:
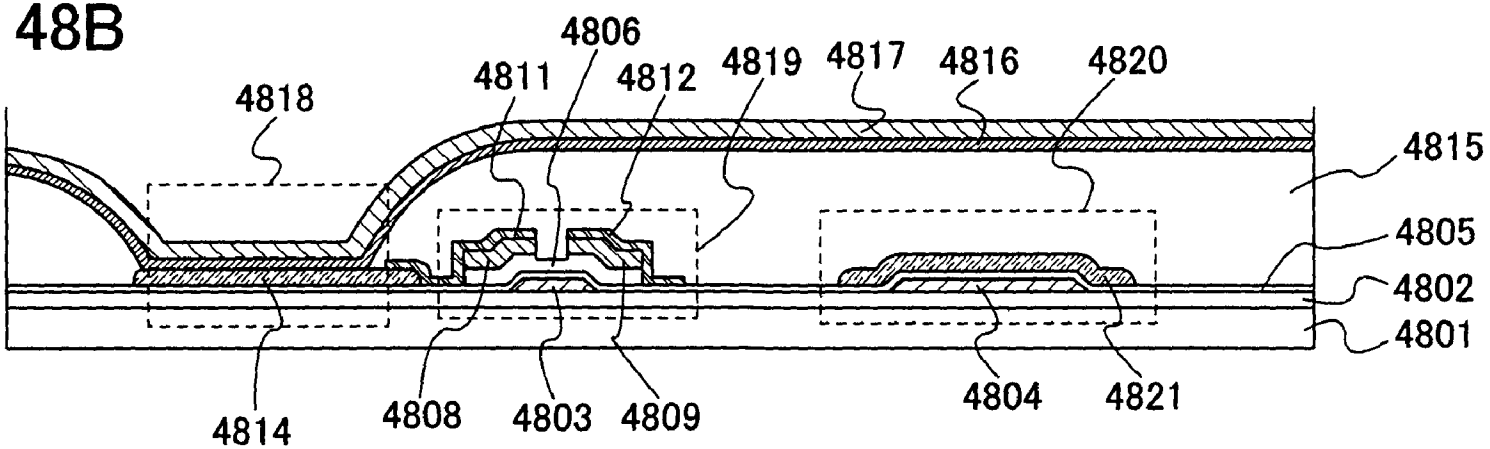

FIGS. 48A and 48B are partial cross-sectional views of a display panel having a bottom-gate transistor which uses amorphous silicon as its semiconductor layer.

A base film 4802 is formed over a substrate 4801. A gate electrode 4803 and a first electrode 4804 formed in the same layer and with the same material over the base film 4802. As a material of the gate electrode 4803, polycrystalline silicon to which phosphorus is added can be used. Besides polycrystalline silicon, silicide which is a compound of metal and silicon may be used.

Then, a gate insulating film 4805 is formed so as to cover the gate electrode 4803 and the first electrode 4804. As the gate insulating film 4805, a silicon oxide film, a silicon nitride film, or the like is used.

A semiconductor layer 4806 is formed over the gate insulating film 4805. In addition, a semiconductor layer 4807 is formed in the same layer and with the same material as the semiconductor layer 4806.

As the substrate, a glass substrate, a quartz substrate, a ceramic substrate, a plastic substrate, or the like can be used. The base film 4802 can be formed using a single layer of aluminum nitride (AlN), silicon oxide ($SiO_2$), silicon oxynitride ($SiO_xN_y$), or the like or stacked layers thereof.

N-type semiconductor layers 4808 and 4809 having N-type conductivity are formed over the semiconductor layer 4806, and an N-type semiconductor layer 4810 is formed over the semiconductor layer 4807.

Wires 4811 and 4812 are formed over the N-type semiconductor layers 4808 and 4809 respectively, and a conductive layer 4813 is formed in the same layer and with the same material as the wires 4811 and 4812, over the N-type semiconductor layer 4810.

Thus, a second electrode is formed with the semiconductor layer 4807, the N-type semiconductor layer 4810, and the conductive layer 4813. Note that a capacitor 4820 having a configuration where the gate insulating film 4805 is interposed between the second electrode and the first electrode 4804 is formed.

One end portion of the wire 4811 is extended, and a pixel electrode 4814 is formed so as to be in contact with an upper potion of the extended wire 4811.

In addition, an insulating film 4815 is formed so as to cover end portions of the pixel electrode 4814, a driving transistor 4819, and the capacitor 4820.

Then, a layer 4816 containing an organic compound and a counter electrode 4817 are formed over the pixel electrode 4814 and the insulating film 4815. A light emitting element 4818 corresponds to a region where the layer 4816 containing an organic compound is interposed between the pixel electrode 4814 and the counter electrode 4817.

The semiconductor layer 4807 and the N-type semiconductor layer 4810 to be a part of the second electrode of the capacitor are not necessarily required. That is, the second electrode may be the conductive layer 4813, so that the capacitor may have such a configuration that the gate insulating film is interposed between the first electrode 4804 and the conductive layer 4813.

Note that the pixel electrode 4814 is formed before forming the wire 4811 in FIG. 48A, thereby a capacitor 4822 as shown in FIG. 48B can be obtained, which has a configuration where the gate insulating film 4805 is interposed between the first electrode 4804 and a second electrode 4821 formed of the pixel electrode 4814.

Although FIGS. 48A and 48B show inverted staggered channel-etched transistors, a channel-protective transistor may be used. Description of channel-protective transistors is made with reference to FIGS. 49A and 49B.

Figure 49A:
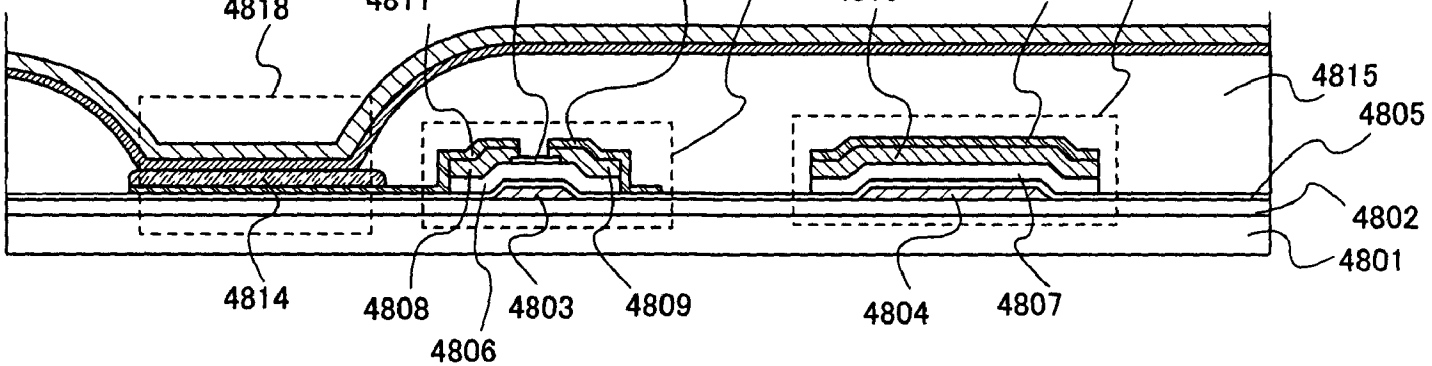
FIGS. 49A and 49B are views each showing a configuration of a transistor and a capacitor which can be applied to a pixel.

A channel-protective transistor shown in FIG. 49A is different from the channel-etched driving transistor 4819 shown in FIG. 48A in that an insulator 4901 functioning as an etching mask is provided over the channel forming region in the semiconductor layer 4806. Common portions except that point are denoted by the same reference numerals.

Figure 49B:
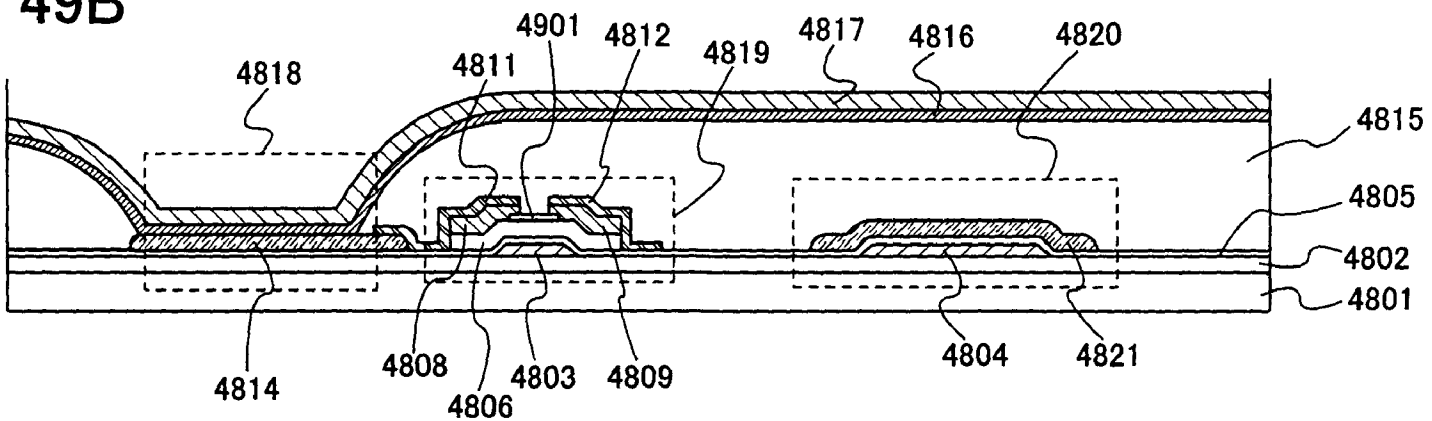

Similarly, a channel-protective transistor shown in FIG. 49B is different from the channel-etched driving transistor 4819 shown in FIG. 48B in that the insulator 4901 functioning as an etching mask is provided over the channel forming region in the semiconductor layer 4806. Common portions except that point are denoted by the same reference numerals.

By using an amorphous semiconductor film as a semiconductor layer (channel forming region, source region, drain region, and the like) of a transistor included in the pixel of the invention, the manufacturing cost can be reduced.

Note that configurations of the transistors and capacitors to which the pixel configuration of the invention can be applied are not limited to those described above, and various configurations of transistors and capacitors can be used.

Embodiment Mode 10

The display device of the invention can be applied to a circuit portion of various electronic appliances, specifically a circuit which constitutes a display portion of electronic appliances. The electronic appliances include cameras such as a video camera and a digital camera, a goggle-type display, a navigation system, an audio reproducing device (car audio component stereo, audio component stereo, or the like), a computer, a game machine, a portable information terminal (mobile computer, mobile phone, mobile game machine, electronic book, or the like), an image reproducing device having a recording medium (specifically, a device for reproducing a recording medium such as a digital versatile disc (DVD) and having a display for displaying the reproduced image) and the like.

Figure 50A:
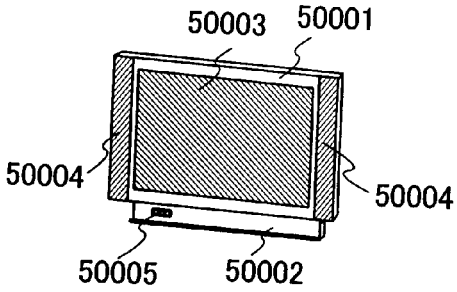
FIG. 50A to 50H are views each showing an electronic appliance having a display device for a display portion.

FIG. 50A shows a display which includes a housing 50001, a supporting base 50002, a display portion 50003, a speaker portion 50004, a video inputting terminal 50005, and the like. Note that the display includes all display devices for displaying information such as for a personal computer, receiving television broadcasting, and displaying an advertisement.

Figure 50B:
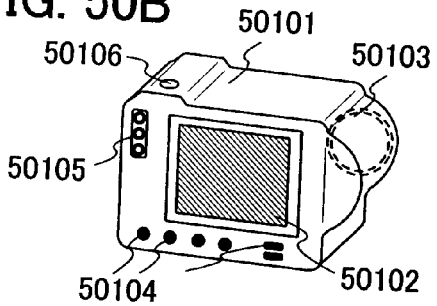

FIG. 50B shows a camera which includes a main body 50101, a display portion 50102, an image receiving portion 50103, operating keys 50104, an external connection port 50105, a shutter 50106, and the like.

Figure 50C:
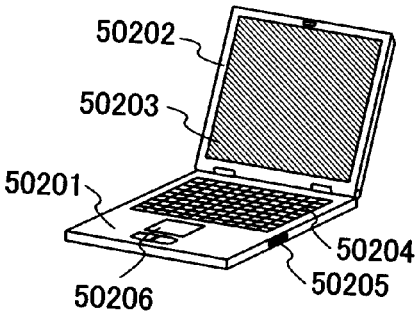

FIG. 50C shows a computer which includes a main body 50201, a housing 50202, a display portion 50203, a keyboard 50204, an external connection port 50205, a pointing mouse 50206, and the like.

Figure 50D:
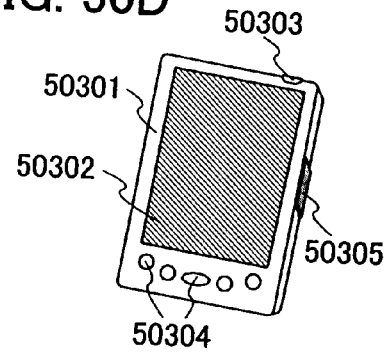

FIG. 50D shows a mobile computer which includes a main body 50301, a display portion 50302, a switch 50303, operating keys 50304, an infrared port 50305, and the like.

Figure 50E:
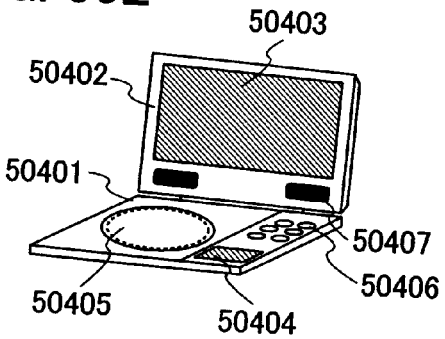

FIG. 50E shows a portable image reproducing device having a recording medium (specifically, a DVD reproducing device), which includes a main body 50401, a housing 50402, a display portion A 50403, a display portion B 50404, a recording medium (DVD or the like) reading portion 50405, an operating key 50406, a speaker portion 50407, and the like.

Figure 50F:
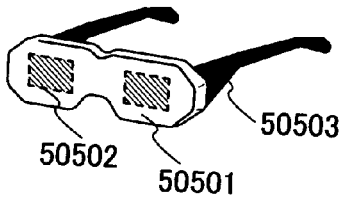

FIG. 50F shows a goggle-type display which includes a main body 50501, a display portion 50502, and an arm portion 50503.

Figure 50G:
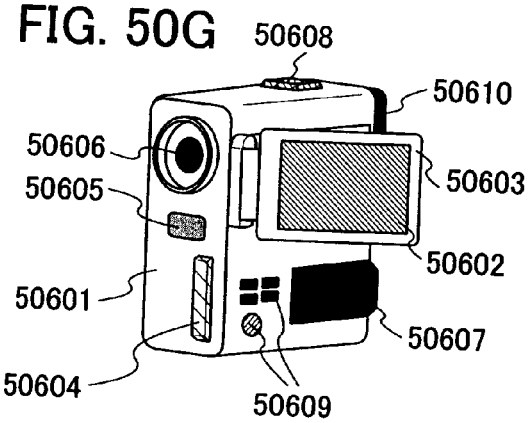

FIG. 50G shows a video camera which includes a main body 50601, a display portion 50602, a housing 50603, an external connection port 50604, a remote control receiving portion 50605, an image receiving portion 50606, a battery 50607, an audio input portion 50608, operating keys 50609, an eye piece portion 50610, and the like.

Figure 50H:
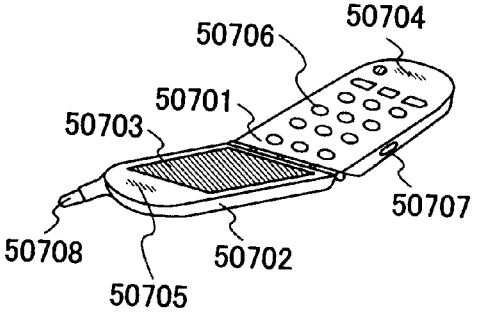

FIG. 50H shows a mobile phone which includes a main body 50701, a housing 50702, a display portion 50703, an audio inputting portion 50704, an audio outputting portion 50705, operating keys 50706, an external connection port 50707, an antenna 50708, and the like.

Thus, the invention can be applied to various electronic appliances.

Embodiment Mode 11

Figure 53:
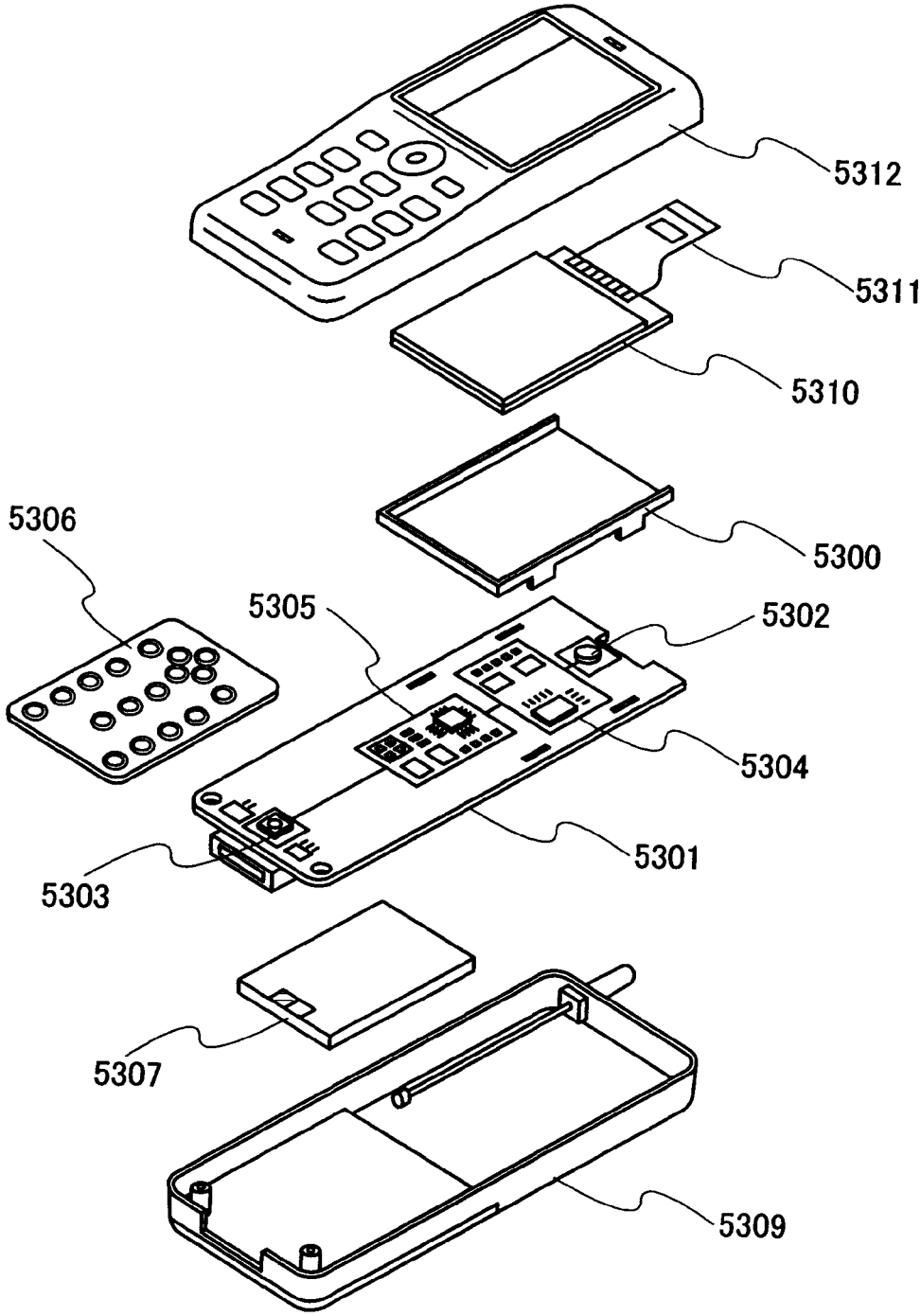
FIG. 53 is a view showing a configuration example of a mobile phone.
Figure 54:
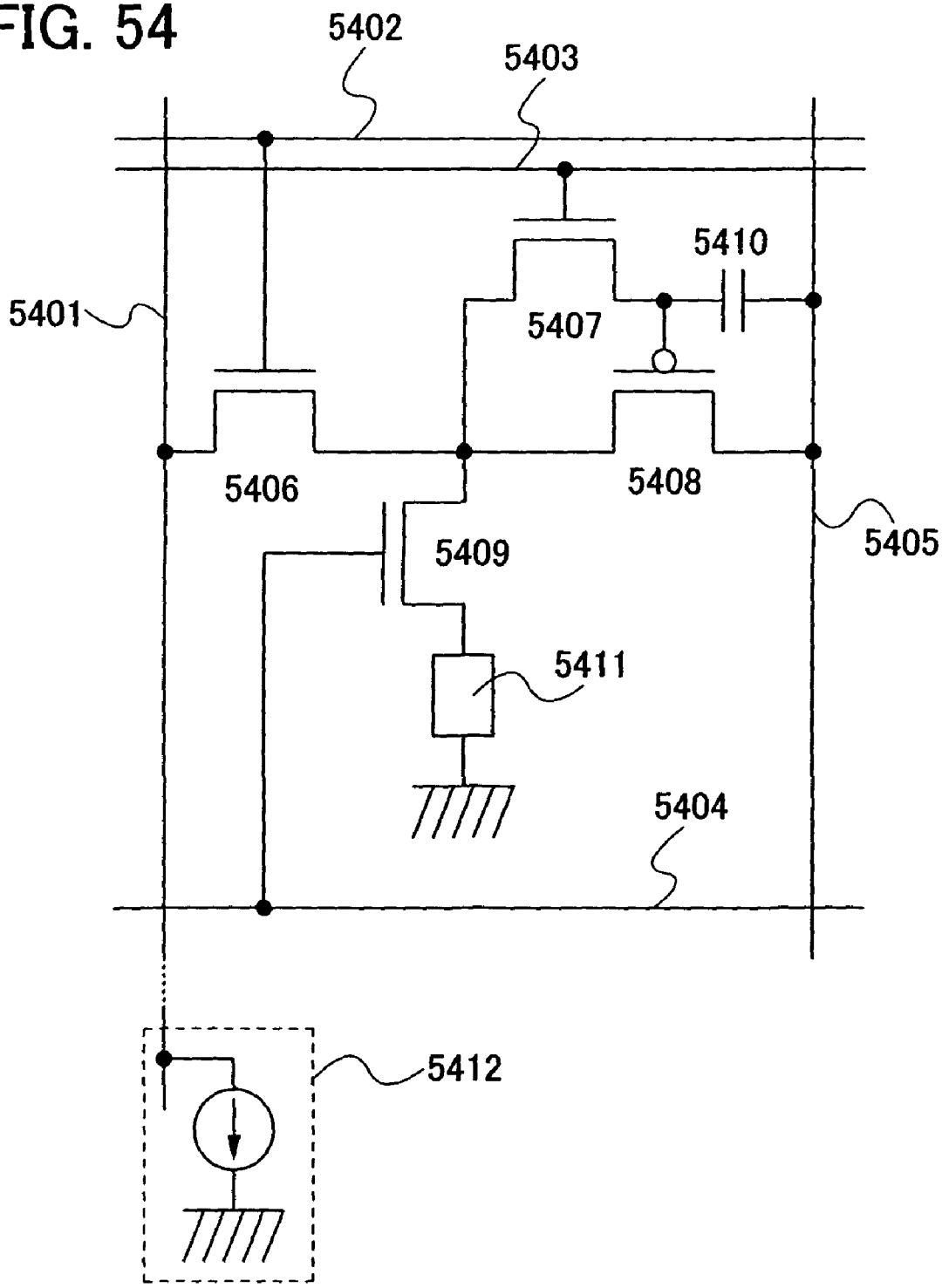
FIG. 54 is a diagram showing a conventional pixel configuration.
Figure 55A:
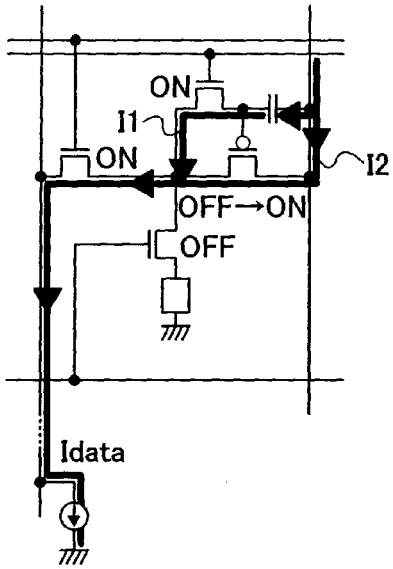
FIGS. 55A to 55E are diagrams each showing an operation of a conventional pixel configuration.
Figure 55B:
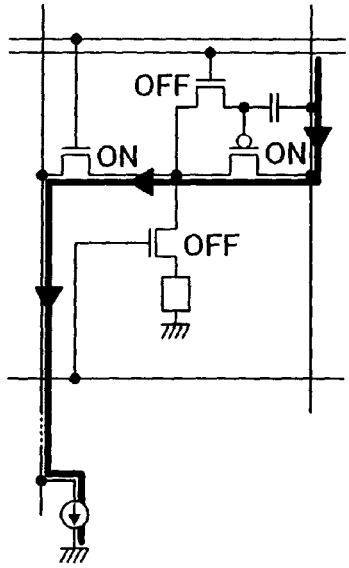
Figure 55C:
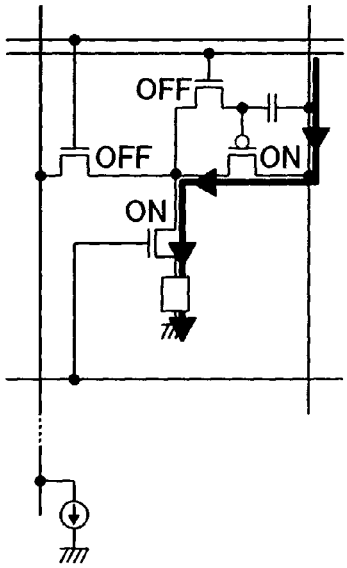
Figure 55D:
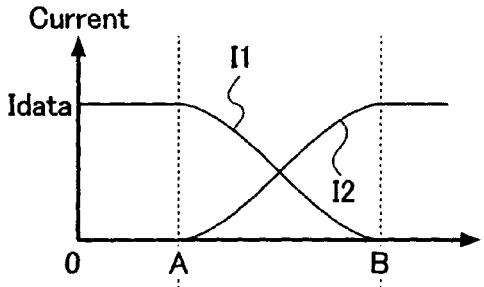
Figure 55E:
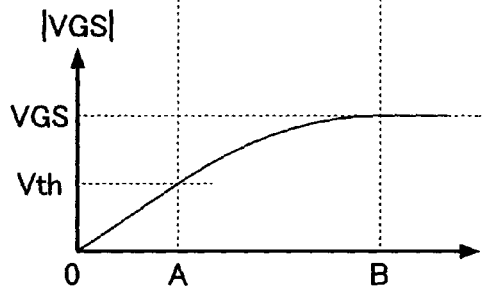
Figure 56:
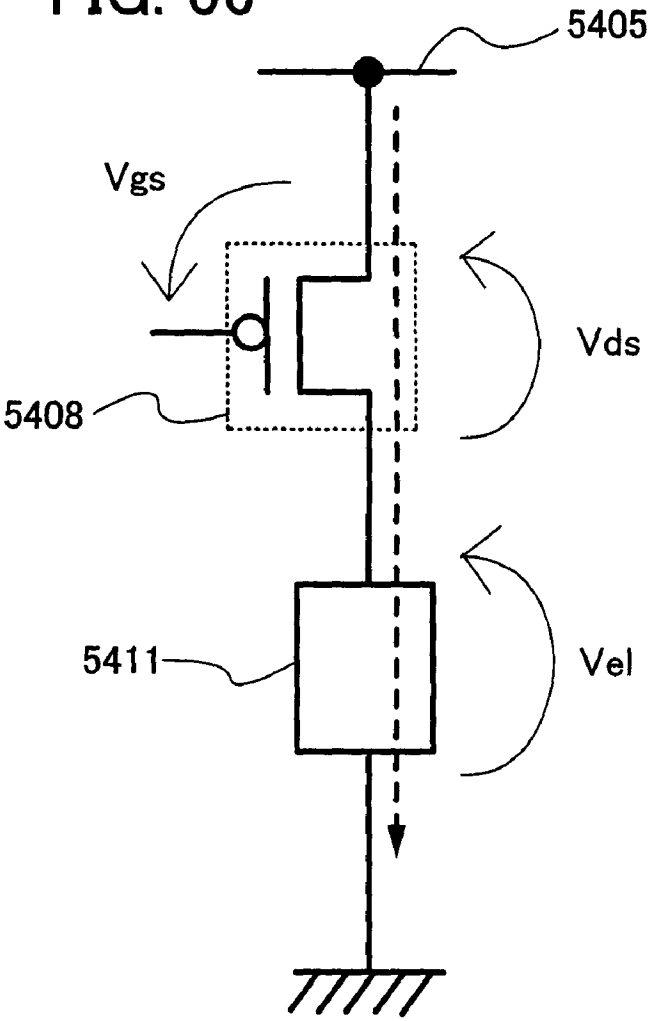
FIG. 56 is a diagram showing a conventional pixel configuration.
Figure 57:
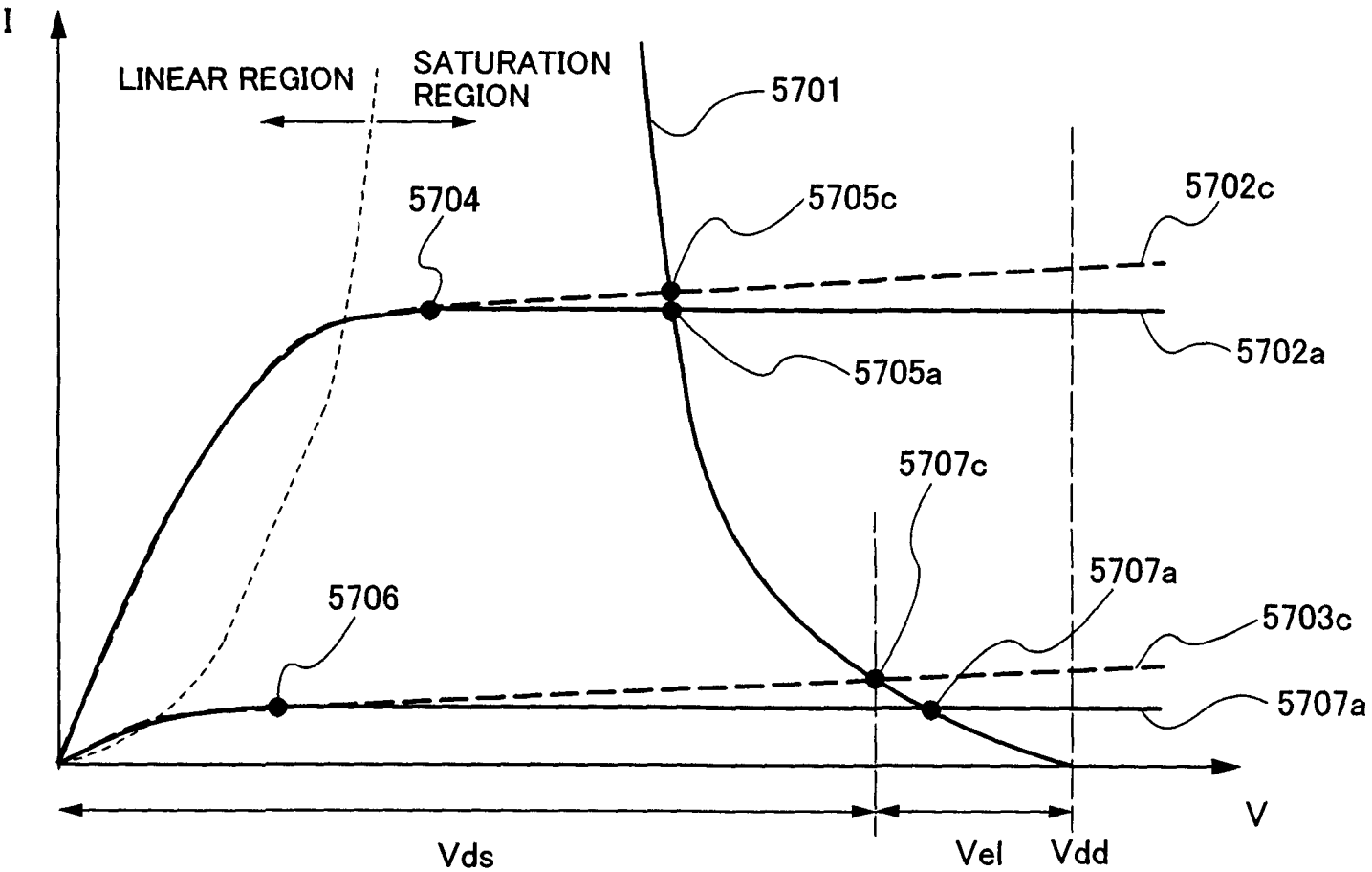
FIG. 57 is a diagram showing an operating point of a conventional circuit.
Figure 58:
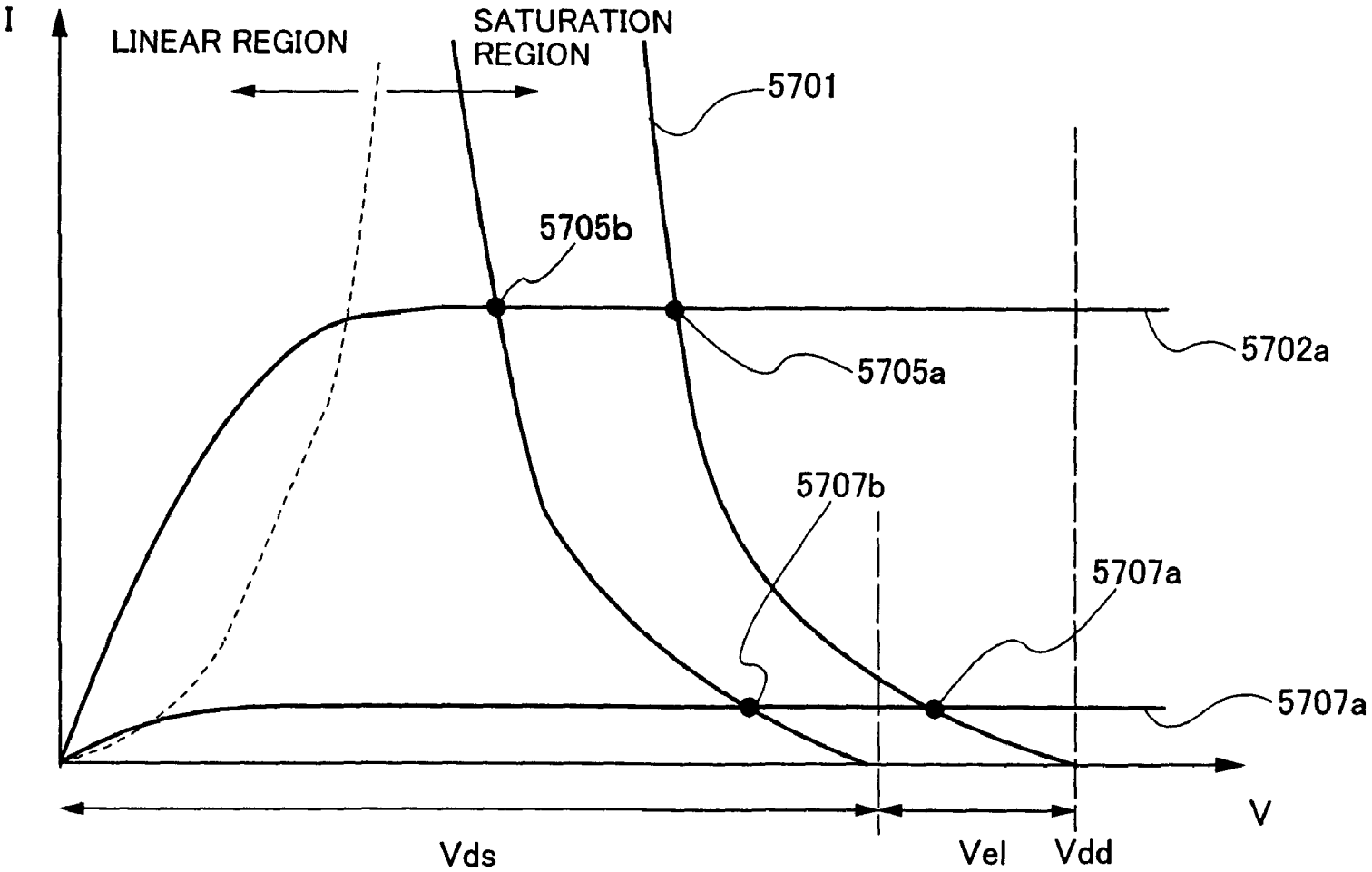
FIG. 58 is a diagram showing an operating point of a conventional circuit.

In this embodiment mode, description is made of a configuration example of a mobile phone with reference to FIG. 53.

A display panel 5310 is incorporated in a housing 5300 so as to be freely attached and detached. The shape and size of the housing 5300 can be appropriately changed in accordance with the size of the display panel 5310. The housing 5300 provided with the display panel 5310 is fitted in a printed circuit board 5301 so as to be assembled as a module.

The display panel 5310 is connected to the printed circuit board 5301 through an FPC 5311. A speaker 5302, a microphone 5303, a transmitting and receiving circuit 5304, and a signal processing circuit 5305 including a CPU, a controller, and the like are formed over the printed circuit board 5301. Such a module, an inputting means 5306, and a battery 5307 are combined, which is stored in a housing 5309. A pixel portion of the display panel 5310 is disposed so as to be seen from an opening window formed in the housing 5309.

The display panel 5310 may be formed by forming a pixel portion and a part of peripheral driver circuits (a driver circuit whose operation frequency is low among a plurality of driver circuits) using TFTs over the same substrate; forming a part of the peripheral driver circuits (a driver circuit whose operation frequency is high among the plurality of driver circuits) into an IC chip; and mounting the IC chip on the display panel 5310 by COG (Chip On Glass). The IC chip may be, alternatively, connected to a glass substrate by using TAB (Tape Automated Bonding) or a printed circuit board. It is to be noted that FIG. 44A shows an example of configuration of such a display panel that a part of peripheral driver circuits is formed over the same substrate as a pixel portion and an IC chip provided with the other part of the peripheral driver circuits is mounted by COG or the like. By employing the above-described configuration, power consumption of a display device can be reduced and the life per charge of a mobile phone can be made long. In addition, cost reduction of the mobile phone can be achieved.

In addition, in order to further reduce the power consumption, the pixel portion may be formed using TFTs over a substrate, all of the peripheral driver circuits may be formed into an IC chip, and the IC chip may be mounted on the display panel by COG (Chip On Glass) or the like as shown in FIGS. 44B and 45A. The pixel configuration of FIG. 2 is used for the pixel portion and an amorphous semiconductor film is used for a semiconductor layer of a transistor, thereby reducing manufacturing cost.

It is to be noted that the configuration described in this embodiment mode is an example of a mobile phone, and a principle of a semiconductor device of the invention can be applied not only to a mobile phone having the above-described configuration but also to mobile phones having various configurations.

Embodiment Mode 12

Figure 51:
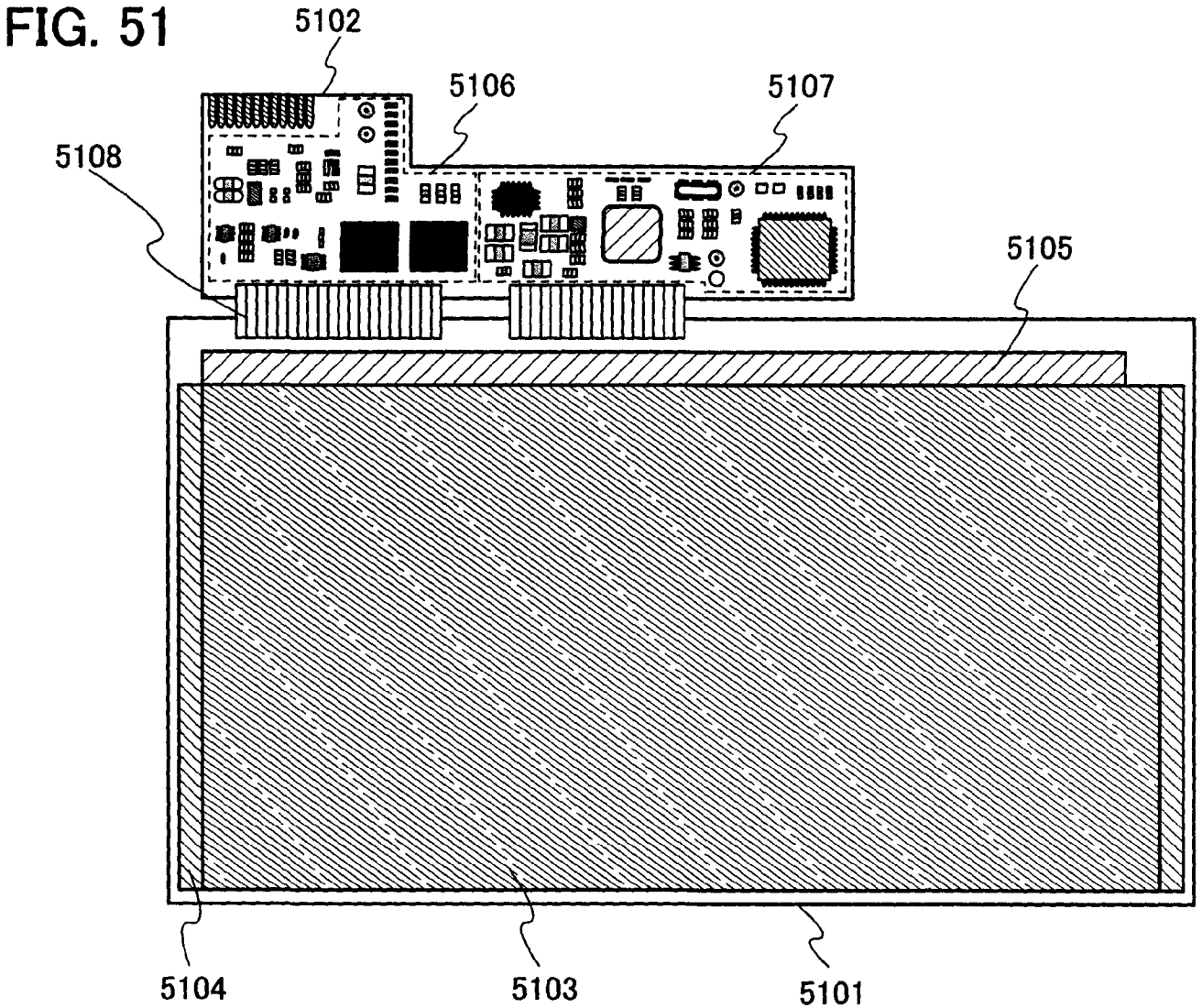
FIG. 51 is a view showing an example of an EL module.

FIG. 51 shows an EL module combining a display panel 5101 and a circuit board 5102. The display panel 5101 includes a pixel portion 5103, a scan line driver circuit 5104, and a signal line driver circuit 5105. A control circuit 5106, a signal dividing circuit 5107, and the like are formed over the circuit board 5102. The display panel 5101 and the circuit board 5102 are connected to each other by a connecting wire 5108. As the connecting wire, an FPC or the like can be used.

The display panel 5101 may be formed by forming a pixel portion and a part of peripheral driver circuits (a driver circuit whose operation frequency is low among a plurality of driver circuits) using TFTs over the same substrate; forming a part of the peripheral driver circuits (a driver circuit whose operation frequency is high among the plurality of driver circuits) into an IC chip; and mounting the IC chip on the display panel 5101 by COG (Chip On Glass) or the like. The IC chip may be, alternatively, mounted on the display panel 5101 by using TAB (Tape Automated Bonding) or a printed circuit board. It is to be noted that FIG. 44A shows an example of configuration where a part of peripheral driver circuits is formed over the same substrate as a pixel portion and an IC chip provided with the other part of the peripheral driver circuits is mounted by COG or the like.

In addition, in order to further reduce the power consumption, the pixel portion may be formed using TFTs over a glass substrate, all of the peripheral driver circuits may be formed into an IC chip, and the IC chip may be mounted on the display panel by COG (Chip On Glass) or the like.

It is preferable that, in the case where an amorphous semiconductor film is applied to a semiconductor layer of a transistor constituting a pixel, the pixel portion be formed using TFTs over a substrate, all of the peripheral driver circuits be formed into an IC chip, and the IC chip be mounted on the display panel by COG (Chip On Glass). Note that FIG. 44B shows an example of the configuration where a pixel portion is formed over a substrate and an IC chip provided with a peripheral driver circuit is mounted on the substrate by COG or the like.

Figure 52:
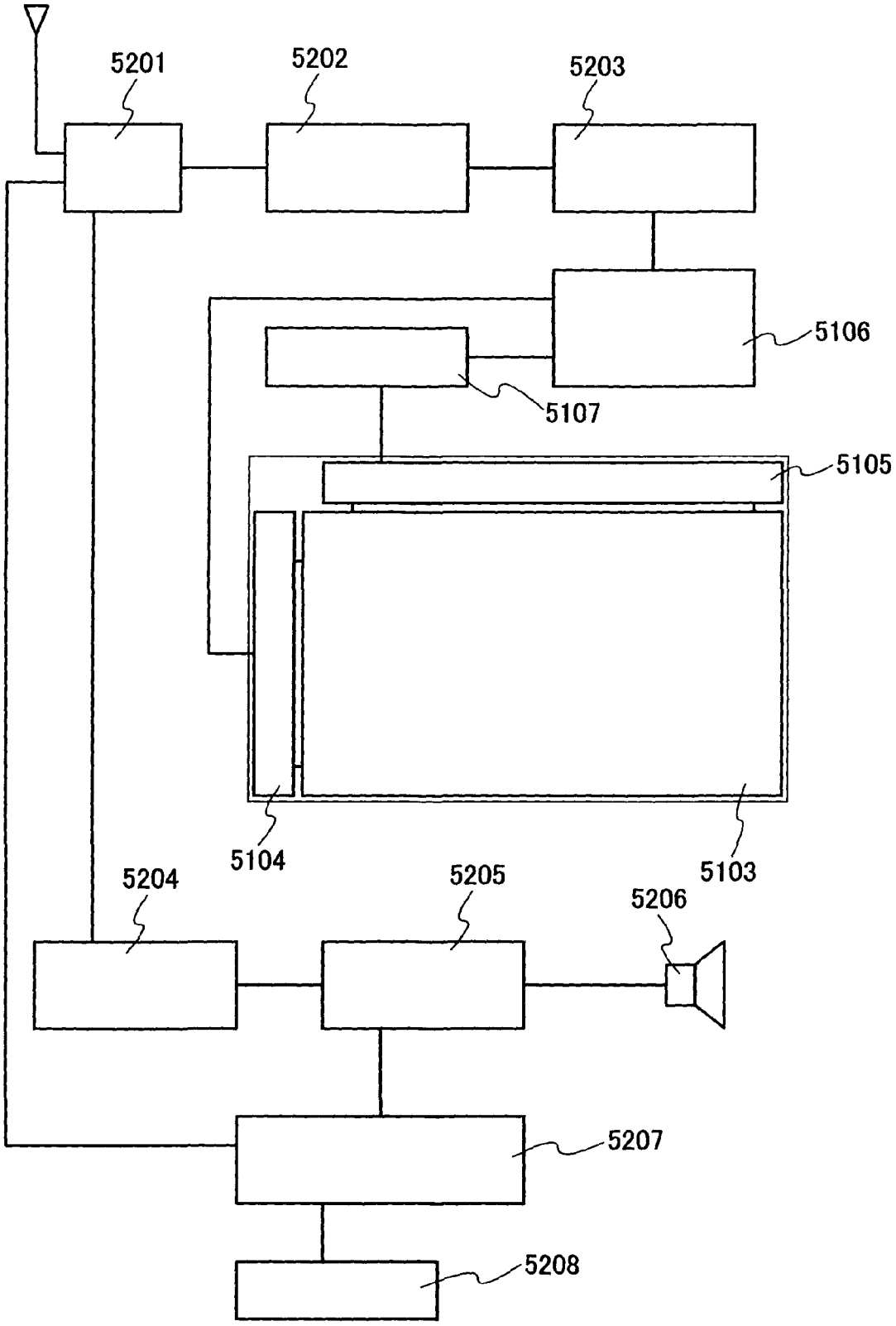
FIG. 52 is a block diagram showing a main configuration of an EL TV receiver.

An EL television receiver can be completed with the above-described EL module. FIG. 52 is a block diagram showing a main configuration of an EL television receiver. A tuner 5201 receives a video signal and an audio signal. The video signals are processed by a video signal amplifier circuit 5202, a video signal processing circuit 5203 for converting a signal outputted from the video signal amplifier circuit 5202 into a color signal corresponding to each color of red, green and blue, and the control circuit 5106 for converting the video signal into the input specification of a driver circuit. The control circuit 5106 outputs a signal to each of the scan line side and the signal line side. In the case of driving in a digital manner, a configuration where the signal dividing circuit 5107 is provided on the signal line side to supply an input digital signal by dividing into m signals may be employed.

An audio signal received by the tuner 5201 is transmitted to an audio signal amplifier circuit 5204, an output thereof is supplied to a speaker 5206 through an audio signal processing circuit 5205. A control circuit 5207 receives receiving station (received frequency) and volume control data from an input portion 5208, and transmits signals to the tuner 5201 and the audio signal processing circuit 5205.

By incorporating the EL module shown in FIG. 51 into the housing 50001, a TV receiver can be completed as shown in FIG. 50A. The display portion 50003 is constituted by the EL module. In addition, the speaker portion 50004, the video inputting terminal 50005, and the like are provided appropriately.

It is needless to say that a principle of a semiconductor device of the invention can also be applied to a circuit portion of a monitor of a personal computer, an information display panel at the station or the airport, an advertisement board on the street, or the like.

Embodiment 1

In this embodiment mode, description is made of a configuration example of a pixel layout in a case of applying a semiconductor device of the invention to a display device.

Figure 63:
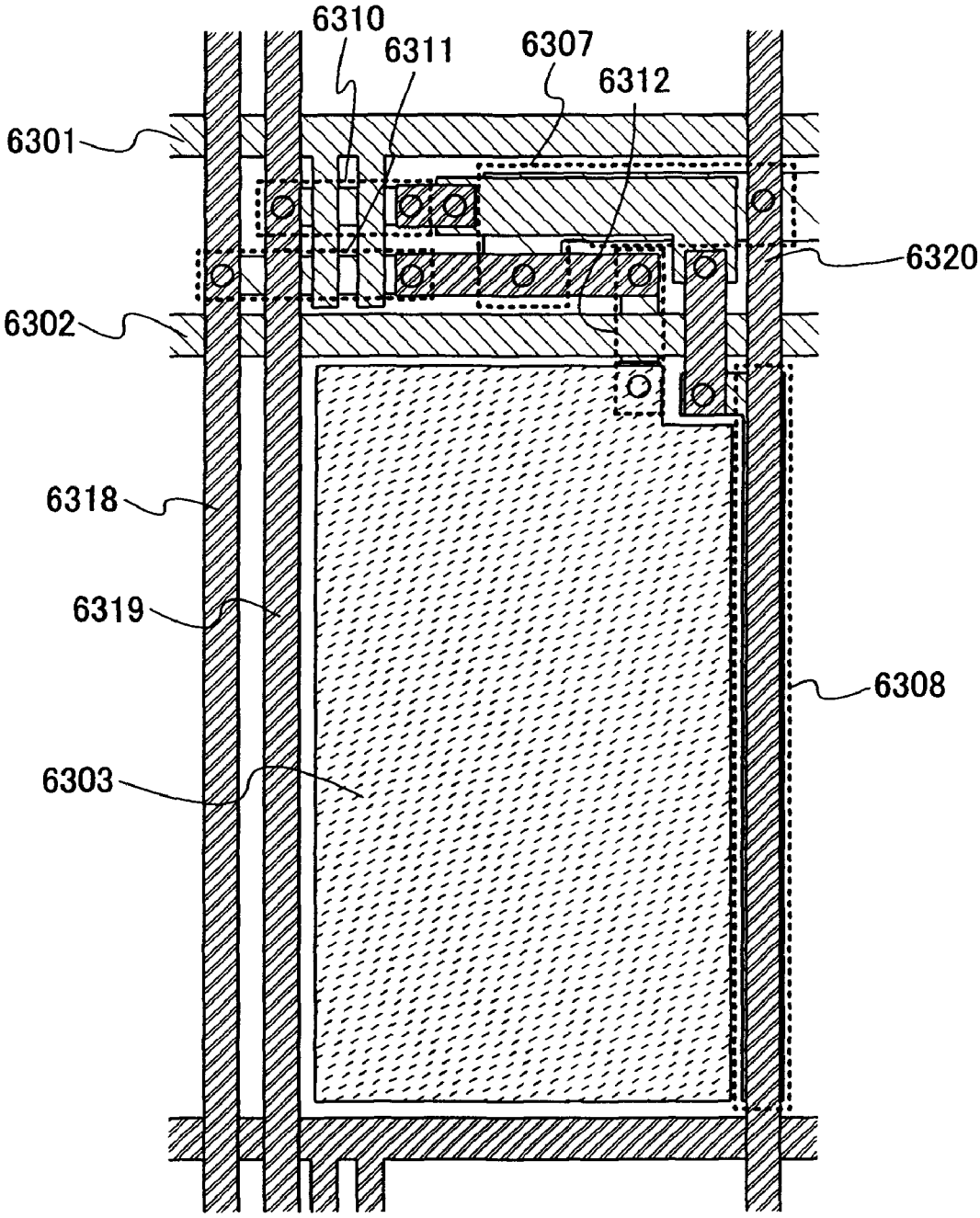
FIG. 63 is a view showing a pixel layout.

FIG. 63 shows a pixel layout of the pixel 2917 shown in FIG. 29.

A pixel in FIG. 63 includes a scan line 6301, a wire 6302, a transistor 6307, a capacitor 6308, a pixel electrode 6309, switch transistors 6310, 6311, and 6312, a first signal line 6318, a second signal line 6319, and a power source line 6320.

The capacitor 6308 is formed of a wire which is electrically connected to a gate terminal of the transistor 6307 and a part of the power source line 6320. The transistor 6307 has a first terminal (one of a source terminal and a drain terminal) connected to the power source line 6320; a second terminal (the other of the source terminal and the drain terminal) connected to a first terminal (one of a source terminal and a drain terminal) of the switch transistor 6312 and a first terminal (one of a source terminal and a drain terminal) of the switch transistor 6311; and a gate terminal connected to a first terminal (one of a source terminal and a drain terminal) of the switch transistor 6310. A second terminal (the other of the source terminal and the drain terminal) of the switch transistor 6310 is connected to the second signal line 6319. A second terminal (the other of the source terminal and the drain terminal) of the switch transistor 6311 is connected to the first signal line 6318. Gate terminals of the switch transistors 6310 and 6311 are connected to the scan line 6301. The switch transistor 6312 has a gate terminal connected to the wire 6302 and a second terminal (the other of the source terminal and the drain terminal) connected to the pixel electrode 6309.

Note that the transistor 6307, the capacitor 6308, the switch transistors 6310, 6311, and 6312, the first signal line 6318, the second signal line 6319, and the power source line 6320 correspond to the transistor 2907, the capacitor 2908, the switches 2910, 2911, and 2912, the first signal line 2918, the second signal line 2919, and the power source line 2920 which are included in the pixel in FIG. 29 respectively. A layer containing an organic compound and a counter electrode are formed over the pixel electrode 6309, and thus the light emitting element 2909 shown in FIG. 29 is formed.

Note that a pixel layout of this embodiment is one example, and the invention is not limited to this.

This application is based on Japanese Patent Application serial no. 2005-350023 filed in Japan Patent Office on 2, Dec., 2005, the entire contents of which are hereby incorporated by reference.

What is claimed is:

1. A semiconductor device comprising:

a current-voltage converting element including a first terminal and a second terminal;

a transistor wherein a first terminal of the transistor is electrically connected to the first terminal of the current-voltage converting element through an electrical path that does not include the second terminal of the current-voltage converting element; and an amplifier circuit wherein an input terminal of the amplifier circuit is electrically connected to the first terminal of the current-voltage converting element and the first terminal of the transistor through an electrical path that does not include the second terminal of the current-voltage converting element, and an output terminal of the amplifier circuit is electrically connected to a gate terminal of the transistor through an electrical path that does not include the second terminal of the current-voltage converting element.

2. A semiconductor device comprising:

a current-voltage converting element including a first terminal and a second terminal;

a transistor wherein a first terminal of the transistor is electrically connected to the first terminal of the current-voltage converting element through an electrical path that does not include the second terminal of the current-voltage converting element and a second terminal of the transistor is electrically connected to a first wiring;

an amplifier circuit wherein a first input terminal of the amplifier circuit is electrically connected to the first terminal of the current-voltage converting element and the first terminal of the transistor through an electrical path that does not include the second terminal of the current-voltage converting element, a second input terminal of the amplifier circuit is electrically connected to a second wiring, and an output terminal of the amplifier circuit is electrically connected to a gate terminal of the transistor through an electrical path that does not include the second terminal of the current-voltage converting element; and a capacitor wherein a first electrode of the capacitor is electrically connected to the gate terminal of the transistor and a second electrode of the capacitor is electrically connected to the second wiring.

3. A semiconductor device according to claim 1, wherein the amplifier circuit is an operational amplifier.

4. A semiconductor device according to claim 2, wherein the amplifier circuit is an operational amplifier.

5. A semiconductor device according to claim 1, wherein the current-voltage converting element is a resistor or a rectifying element.

6. A semiconductor device according to claim 2, wherein the current-voltage converting element is a resistor or a rectifying element.

7. A semiconductor device according to claim 1, wherein the input terminal of the amplifier circuit is a non-inverting input terminal.

8. A semiconductor device according to claim 2, wherein the first input terminal of the amplifier circuit is a non-inverting input terminal and the second input terminal of the amplifier circuit is an inverting input terminal.

9. A semiconductor device according to claim 5, wherein the rectifying element is a diode-connected transistor.

10. A semiconductor device according to claim 6, wherein the rectifying element is a diode-connected transistor.

* * * * *

UNITED STATES PATENT AND TRADEMARK OFFICE

CERTIFICATE OF CORRECTION

PATENT NO. : 8,400,374 B2
APPLICATION NO. : 11/565203
DATED : March 19, 2013
INVENTOR(S) : Kimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1119 days.

Signed and Sealed this
Second Day of December, 2014

Michelle K. Lee

Michelle K. Lee
*Deputy Director of the United States Patent and Trademark Office*